US006077635A

United States Patent [19]

Okado et al.

[11] Patent Number: 6,077,635

[45] Date of Patent: Jun. 20, 2000

[54] TONER, TWO-COMPONENT DEVELOPER AND IMAGE FORMING METHOD

[75] Inventors: Kenji Okado, Yokohama; Ryoichi Fujita, Odawara; Wakashi Iida, Numazu; Yuji Moriki, Susono; Kazumi Yoshizaki, Mishima; Michihisa Magome, Shizuoka-ken, all of Japan

[73] Assignee: Canon Kabushiki Kaisha, Tokyo, Japan

[21] Appl. No.: 09/099,527

[22] Filed: Jun. 18, 1998

[30] Foreign Application Priority Data

Jun. 18, 1997 [JP] Japan ..... 9-160792
Oct. 7, 1997 [JP] Japan ..... 9-274049

[51] Int. Cl.[7] ..... G03G 13/01; G03G 9/097

[52] U.S. Cl. ..... 430/45; 430/106.6; 430/110; 430/111; 430/126

[58] Field of Search ..... 430/45, 106.6, 430/110, 111, 126

[56] References Cited

U.S. PATENT DOCUMENTS

| | | | |
|---|---|---|---|
| 4,904,558 | 2/1990 | Nagatsuka et al. | 430/122 |
| 4,950,575 | 8/1990 | Shiozaki et al. | 430/110 |
| 5,240,803 | 8/1993 | Ota | 430/110 |
| 5,600,431 | 2/1997 | Takeda et al. | 399/226 |
| 5,712,072 | 1/1998 | Inaba et al. | 430/111 |
| 5,774,771 | 6/1998 | Kukimoto et al. | 399/223 |

FOREIGN PATENT DOCUMENTS

| | | |
|---|---|---|
| 0564002 | 10/1993 | European Pat. Off. . |
| 0658816 | 6/1995 | European Pat. Off. . |
| 0729075 | 8/1996 | European Pat. Off. . |
| 10231 | 7/1961 | Japan . |
| 3244 | 1/1976 | Japan . |
| 32060 | 3/1980 | Japan . |
| 129437 | 8/1983 | Japan . |
| 53856 | 3/1984 | Japan . |
| 61842 | 4/1984 | Japan . |
| 133573 | 7/1984 | Japan . |
| 165082 | 8/1984 | Japan . |
| 32060 | 2/1985 | Japan . |
| 136752 | 7/1985 | Japan . |
| 146794 | 7/1986 | Japan . |
| 188546 | 8/1986 | Japan . |
| 203182 | 9/1987 | Japan . |
| 133179 | 6/1988 | Japan . |
| 289559 | 11/1988 | Japan . |
| 20587 | 1/1989 | Japan . |
| 222966 | 9/1990 | Japan . |
| 259784 | 10/1990 | Japan . |
| 302772 | 12/1990 | Japan . |
| 50886 | 2/1992 | Japan . |
| 155361 | 5/1992 | Japan . |
| 234063 | 8/1992 | Japan . |
| 2287 | 1/1993 | Japan . |
| 2289 | 1/1993 | Japan . |
| 53482 | 3/1993 | Japan . |
| 61383 | 3/1993 | Japan . |
| 69427 | 3/1993 | Japan . |
| 165378 | 7/1993 | Japan . |
| 230652 | 8/1994 | Japan . |
| 72319 | 3/1995 | Japan . |
| 261446 | 10/1995 | Japan . |

OTHER PUBLICATIONS

Polymer Handbook, 2d Ed., publ. by J. Wiley, "The Glass Transition Temperature of Polymers", pp. 111–192 to –192, 1971.

*Primary Examiner*—Roland Martin
*Attorney, Agent, or Firm*—Fitzpatrick, Cella, Harper & Scinto

[57] ABSTRACT

A toner is disclosed which has toner particles and an external additive. The toner has (a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method. The external additive has, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150. Also, a two-component developer and an image forming method, using the toner, are disclosed.

164 Claims, 8 Drawing Sheets

TONER, TWO-COMPONENT DEVELOPER AND IMAGE FORMING METHOD

BACKGROUND OF THE INVENTION

1. Field of the Invention

This invention relates to a toner used in recording processes utilizing electrophotography, electrostatic recording, magnetic recording, toner-jet recording or the like. More particularly, this invention relates to a toner for developing an electrostatically charged image used in copying machines, printers and facsimile machines in which a toner image is previously formed on an electrostatic latent image bearing member and thereafter the toner image is transferred to a transfer medium to form an image, and also relates to a two-component developer and an image forming method which make use of the toner.

2. Related Background Art

Methods are conventionally well known in which a dry-process developer as an agent for rendering latent images visible is carried on the surface of a developer carrying member, the developer is transported and supplied to the vicinity of the surface of a latent image bearing member holding an electrostatic latent image thereon and the electrostatic latent image is developed by a toner of the developer while applying an alternating electric field across the latent image bearing member and the developer carrying member, to render the electrostatic latent image visible.

The developer carrying member is often called "developing sleeve" in the following description because developing sleeves are commonly in wide use as the developer carrying member. The latent image bearing member (photosensitive member) is also often called "photosensitive drum" in the following description because photosensitive drums are commonly in wide use as the latent image bearing member.

As the above developing method, so called magnetic-brush development method is conventionally known in which a magnetic brush is formed on the surface of a developing sleeve internally provided with a magnet, by the use of, e.g., a developer (two-component developer) comprised of two components (carrier particles and toner particles), the magnetic brush thus formed is rubbed with, or brought close to, a photosensitive drum set opposingly to the developing sleeve while keeping a minute development gap between them, and an alternating electric field is continuously applied across the developing sleeve and the photosensitive drum (between S-D) to repeatedly cause the toner particles to transit from the developing sleeve side to the photosensitive drum side and vice versa, to carry out development (see, e.g., Japanese Patent Application Laid-Open No. 55-32060 and No. 59-165082).

In such a magnetic brush development method making use of a two-component developer, the toner particles are triboelectrically charged by mixing them with carrier particles. Since the carrier particles have a higher specific gravity than the toner particles, the toner particles undergo a high mechanical strain because of their friction with the carrier particles when mixed, so that the deterioration of toner tends to accelerate with the progress of development operated repeatedly.

Once such deterioration of toner has occurred, it may cause concretely the phenomena that the density of fixed images changes as a result of long-term service, that the toner particles adhere to non-image areas to cause what is so-called "fog" and that the minute-image reproducibility becomes poor.

In the electrophotographic process, after the toner image formed on the photosensitive drum has been transferred to the transfer medium, the toner remaining on the photosensitive drum without being transferred to the transfer medium is removed from the surface of the photosensitive drum by a cleaning means in the step of cleaning and is collected. Blade cleaning, fur brush cleaning or roller cleaning are used as the cleaning means.

When, however, the toner on the photosensitive drum is removed and collected by using the cleaning means, from the aspect of apparatus the apparatus must be made larger due to providing such a cleaning means. This has been a bottleneck in attempts to make apparatus compact. Accordingly, image forming apparatus having no cleaning means are desired.

From the viewpoint of ecology, a cleanerless system or toner reuse system that may produce no waste toner is long-awaited in the sense of effective utilization of toners.

Such a technique is known as a technique called cleaning-at-development in which the toner remaining on the photosensitive drum after transfer (transfer residual toner) is collected at the time of development in a developing assembly and the toner collected is again used in the development.

As this technique called "cleaning-at-development" (or "cleanerless") system, for example, Japanese Patent Publication No. 5-69427 discloses that one image is formed at one rotation of the photosensitive drum so that any effect of the transfer residual toner does not appear on the same image. Japanese Patent Application Laid-Open No. 64-20587, No. 2-259784, No. 4-50886 and No. 5-165378 disclose a system in which the transfer residual toner is dispersed or driven off by a drive-off member to make it into non-patterns so that it may hardly appear on images even when the surface of the same photosensitive drum is utilized several times for one image.

Japanese Patent Application Laid-Open No. 5-2287 discloses a system in which a relation of toner charge quantity around the photosensitive drum is specified so that any positive memory or negative memory caused by the transfer residual toner may not appear on images. It, however, does not disclose any specific constitution for how to control the toner charge quantity.

In Japanese Patent Application Laid-Open No. 59-133573, No. 62-203182, No. 63-133179, No. 2-302772, No. 4-155361, No. 5-2289, No. 5-53482 and No. 5-61383, which disclose techniques relating to the cleanerless system, it is proposed, in relation to imagewise exposure, to make exposure using light having a high intensity or to use a toner capable of transmitting light having an exposure wavelength. However, only making exposure intensity higher may cause a blur in dot formation of a latent image itself to cause an insufficient isolated-dot reproducibility, resulting in images having a poor resolution in respect of image quality, in particular, images lacking in gradation in graphic images.

As for the means making use of the toner capable of transmitting light having an exposure wavelength, the transmission of light certainly has a great influence on the fixed toner having been made smooth and having no particle boundary. However, as a mechanism of screening exposure light, it has less effect because it more chiefly concerns the scattering of light on the toner particle surfaces than the coloring of toner itself. Moreover, colorants of toners must be selected in a narrower range, and also at least three types of exposure means having different wavelengths are required when full-color formation is intended. This goes against making apparatus simple, which is one of features of the cleaning-at-development.

In an image forming method employing a contact charging system in which the photosensitive drum which is the member to be charged is primarily charged by injecting charges into it by means of a contact charging member, any faulty charging due to contamination (toner-spent) of the charging member tends to cause faulty images and to cause a problem on running performance. Thus, it has been a pressing need for enabling many-sheet printing to restrain the influence of the faulty charging due to contamination of the charging member.

Examples in which the contact charging system is used in the image forming system employing the cleanerless or cleaning-at-development system are seen in Japanese Patent Application Laid-Open No. 4-234063 and No. 6-230652, which disclose an image forming method in which the cleaning to remove transfer residual toner from the photosensitive drum is also carried out simultaneously in a back-exposure simultaneous developing system.

However, the proposals in these publications are applicable to an image forming method in which charge potential and developing applied bias are formed at low electric fields. In image formation under a higher electric field charging-developing applied bias, which is conventionally widely applied in electrophotographic apparatus, leak may occur to cause faulty images such as lines and spots.

A method is also proposed in which the toner having adhered to the charging member is moved to the photosensitive drum at the time of formation of no image so that any ill effect caused by adhesion of the transfer residual toner can be prevented. However, the proposal does not mention anything about improvement in recovery rate in the developing step, of the toner moved to the photosensitive drum, and about any influence on development that may be caused by the collection of toner in the developing step.

In addition, if the cleaning effect against the transfer residual toner is insufficient at the time of development, there may be caused problems that a positive ghost may appear, since the subsequent toner participates in development on the photosensitive drum on which the transfer residual toner is present and hence an image formed thereat may have a higher density than its surroundings and that, if the transfer residual toner is in a too large quantity, a positive memory may be caused on images, since the toner may not be completely collected at the development part. No fundamental solution of these problems has been achieved.

Light screening caused by the transfer residual toner especially comes into question when the photosensitive drum is repeatedly used on one sheet of transfer medium, i.e., when the length corresponding to one round of the photosensitive drum is smaller than the length in the moving direction of the transfer medium. Since the charging, exposure and development must be made in the state the transfer residual toner is present on the photosensitive drum, the electric potential at the photosensitive drum surface portion where the transfer residual toner is present can not be completely dropped to make development contrast insufficient, which, in reverse development, appears on images as a negative ghost, having a lower density than the surroundings. The photosensitive drum having passed through an electrostatic transfer step stands charged in a polarity reverse to the polarity of toner charge on the whole, where, because of any deterioration of charge injection performance in the photosensitive drum as a result of repeated use, the transfer residual toner not controlled to have the normal charge polarity in the charging member may leak from the charging member during image formation to intercept exposure light, so that latent images are disordered and any desired electric potential cannot be attained, thereby causing a negative memory on images. Such problems may further occur, and it is sought to make fundamental solution of these problems.

In recent years, output instruments such as copying machines and laser beam printers employing the above electrophotographic process have become low-cost and have made a progress in digital techniques. Accordingly, it is required to form high-quality images more faithful to originals by using much image information. Especially when images such as printed photographs, catalogs and maps are copied, it is demanded to reproduce them very finely and faithfully throughout details, without causing crushed line images and broken line images.

In such trends of techniques, toners are sought to have such performance that, in the course of development, transfer and fixing, the toner may cause less scatter of toner around latent images, the toner itself maintains a high charging performance and simultaneously the toner after development can be transferred to the transfer medium at a transfer efficiency of almost 100%.

As means for improving an image quality in the electrophotographic process, the following methods are available: (i) a method in which the latent image on the latent image bearing member is rubbed with ears of developer while keeping dense the rise of ears of developer on the developer carrying member; (ii) a method in which a bias electric field is applied across the developer carrying member and the latent image bearing member to thereby make the toner readily flown; (iii) a method in which the developing assembly itself is made to have a higher agitation performance inside the assembly so that a high chargeability can be permanently maintained; and also (iv) a method in which dot size itself of the latent image is made finer to improve resolution.

Such means concerned with the development are very effective and hold a part of important techniques for achieving a high image quality. However, taking account of more improvement in image quality, the performance of the developer itself is considered to have a great influence.

Especially in the image formation for full-color images, monochromatic toners are used in development and transferred many times, so that toners are formed in multi-layer at the latent image areas, where the layers tend to have a lower electric potential as they come near to the outermost layer, resulting in a difference in developing performance of toners between the lowermost layer and the uppermost layer in some cases.

Further, there cannot only be attained a faithful color reproducibility due to poor color mixing after a heat-melting treatment, but also there may often be caused drawbacks such as lowering of transfer performance and scatter of toner on non-latent-image electric-potential areas.

From the viewpoint of process factors, a great influence of toner performance on the improvement in image quality is considered as stated above. For the purpose of improving image quality, various developers are hitherto proposed. For example, Japanese Patent Application Laid-open No. 51-3244 discloses a non-magnetic toner in which its particle size distribution is controlled so that the image quality can be improved. This toner is composed chiefly of toner particles having a particle diameter of from 8 to 12 $\mu$m, which are relatively coarse. According to studies made by the present inventors, it is difficult for the toner with such particle diameter to fly onto latent images in a dense state.

Also, the toner, as having the feature that particles with particle diameters of 5 μm or smaller are contained in an amount of not more than 30% by number and particles with particle diameters of 20 μm or larger are contained in an amount of not more than 5% by number, tends to result in a low uniformity because of a broadness of its particle size distribution. In order to form sharp images by the use of the toner comprising such relatively coarse toner particles and having a broad particle size distribution, the toner particles in each layer under the multi-layer configuration as described above must be thickly overlaid so that any spaces between toner particles can be filled up to increase apparent image density. This brings about the problem of an increase in the consumption of toner necessary to attain a given image density.

Japanese Patent Application Laid-Open No. 58-129437 discloses a non-magnetic toner having an average particle diameter of from 6 to 10 μm and being held by particles with particle diameters of 5 to 8 μm in the greatest number. This toner, however, contains particles with particle diameters of 5 μm or smaller in an amount of as small as 15% by number, and tends to form images lacking in sharpness.

As a result of studies made by the present inventors, they have ascertained that toner particles with particle diameters of 5 μm or smaller contribute the clear reproduction of minute dots of latent images and have a chief function to densely lay the toner onto the whole latent image. In particular, electrostatic latent images on a photosensitive drum have a higher electric field intensity at their edges than at their inner sides because of concentrated lines of electric force, and the quality of toner particles gathered at that portions influences the sharpness of an image quality. The studies made by the present inventors have revealed that the control of the quantity of toner particles with particle diameters of 5 μm or smaller is effective for improving a high-light gradation.

However, the toner particles with particle diameters of 5 μm or smaller have a strong adhesion to the surface of the latent image bearing member, so that the transfer residual toner can be removed by cleaning with difficulty. In addition, as a result of continuous printing, some low-electrical-resistance matters such as paper dust or ozonides and the toner may consequently stick to the photosensitive drum.

For the purpose of scraping off such low-electrical-resistance matters and the toner having stuck, Japanese Patent Application Laid-Open No. 60-32060 and No. 60-136752 disclose a proposal to add as an abrasive an inorganic fine powder having a BET specific surface area of from 0.5 to 30 $m^2/g$ as measured by nitrogen adsorption. This is effective for preventing the toner from sticking, but it is difficult to attain the desired abrasive effect unless the developer is improved in charging stability. Consequently, this has been insufficient for achieving stable cleaning.

Japanese Patent Application Laid-Open No. 61-188546, No. 63-289559 and No. 7-261446 also disclose a proposal of a toner in which two or three kinds of inorganic fine particles are added and mixed in a toner. This, however, chiefly aims at abrasive effect for the purpose of imparting fluidity and removing the matters stuck to the photosensitive drum, and has not attained the effect of greatly improving the transfer performance of the toner. Use of the same kind of inorganic fine particles (of, e.g., silica) may make unstable not only the fluidity-providing effect but also the charge-providing properties of the toner, to cause a possibility of toner scatter and fog. Moreover, the proposal is concerned with only average particle diameter of the inorganic fine particles and is unclear about their particle size distribution. Accordingly, there is also a possibility of causing the sticking of toner to the photosensitive drum.

For the purpose of achieving much higher image quality, Japanese Patent Application Laid-Open No. 2-222966 discloses using fine silica particles and fine alumina particles in combination. However, the fine silica particles have so large a BET specific surface area as to make it difficult to attain any remarkable effect as a spacer between toner particles.

SUMMARY OF THE INVENTION

An object of the present invention is to provide a toner that can form fog-free images with superior image-density stability and minute-image reproducibility, without causing deterioration of toner even in its long-term service; and a two-component developer and an image forming method which make use of such a toner.

Another object of the present invention is to provide a toner that can be transferred to a transfer medium at a transfer efficiency of almost 100%; and a two-component developer and an image forming method which make use of such a toner.

Still another object of the present invention is to provide a toner that may hardly cause all of deterioration of toner due to its long-term service, surface deterioration of the developer carrying member and surface deterioration and wear of the latent image bearing member, and especially can restrain the toner from sticking to the photosensitive drum surface; and a two-component developer and an image forming method which make use of such a toner.

A further object of the present invention is to provide an image forming method making use of a charging member having a superior charging performance.

A still further object of the present invention is to provide an image forming method making use of substantially no cleaning assembly and promising a superior running performance.

A still further object of the present invention is to provide an image forming method that can simplify the image forming apparatus itself.

A still further object of the present invention is to provide an image forming method making use of a toner having spacer particles and having a superior charge-providing properties and a charging member that can maintain a good charging performance together with such a toner.

To achieve the above objects, the present invention provides a toner comprising toner particles and an external additive;

the toner having;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method; and the external additive having, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150.

The present invention also provides a two-component developer comprising a toner having at least toner particles and an external additive, and a carrier, wherein;

the toner has;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method; and the external additive has, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150.

The present invention still also provides an image forming method comprising the steps of;

(I) electrostatically charging a latent image bearing member on which an electrostatic latent image is to be held;

(II) forming the electrostatic latent image on the latent image bearing member thus charged;

(III) developing the electrostatic latent image on the latent image bearing member by the use of a toner to form a toner image; and (IV) transferring to a transfer medium the toner image formed on the latent image bearing member;

wherein;

the toner comprises toner particles and an external additive; and the toner has;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method; and the external additive has, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150.

DESCRIPTION OF THE PREFERRED EMBODIMENTS

Figure 1:
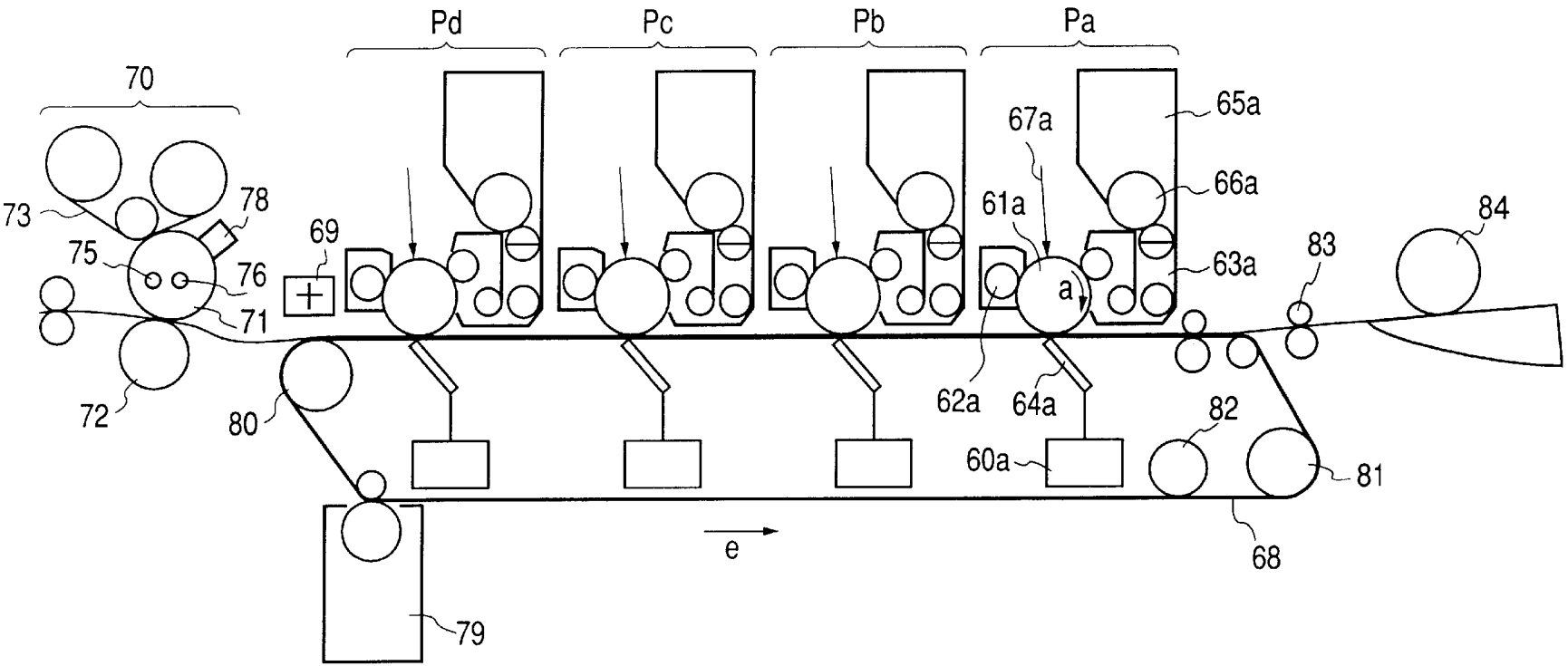
FIG. 1 schematically illustrates an example of a preferred image forming apparatus that can carry out the image forming method of the present invention.

The present invention can provide a toner having superior image-density stability and minute-image reproducibility and can form fog-free images, without causing deterioration of toner even in its long-term service.

The causes of the deterioration of toner lie in three points: break of toner particles at their convexes into fine particles; becoming the external additive buried in toner particle surfaces; and becoming toner particles non-uniform in charging performance.

In the present invention, toner particles having specific shape and circularity distribution and at least two kinds of external additive fine particles having different shapes and particle diameters are used, whereby the fog-free images with superior image-density stability and minute-image reproducibility can be formed without causing deterioration of toner even in its long-term service.

The embodiments of the present invention will be described below in detail.

The toner of the present invention has an average circularity of from 0.920 to 0.995, preferably from 0.950 to 0.995, and more preferably from 0.960 to 0.995, as measured with a flow type particle image analyzer. Herein, the flow type particle image analyzer refers to an apparatus that statistically analyzes images of photographed particles. The average circularity is calculated by an arithmetic mean of circularity determined according to the following circularity.

$$\text{Circularity} = \frac{\text{Circumferential length of corresponding circle}}{\text{Circumferential length of particle projected image}}$$

In the above expression, the circumferential length of particle projected image is meant to be the length of a contour line formed by connecting edge points of a binary-coded particle image. The circumferential length of corresponding circle is meant to be the length of of circumference of a circle having the same area as the binary-coded particle image.

If the toner has an average circularity of less than 0.920, the external additive tends to localize on the toner particle surfaces, tending to result in an unstable image density. If the toner has an average circularity of more than 0.995, the external additive tends to be held on the toner particle surfaces with difficulty, resulting in an unstable charging to tend to cause fog.

The toner contains particles with a circularity of less than 0.950 in an amount of from 2 to 40% by number, and preferably from 3 to 30% by number.

If the toner contains the particles with a circularity of less than 0.950 in an amount less than 2% by number, the toner tends to come into closest packing, resulting in an unstable charging to tend to cause fog. If the toner contains the particles with a circularity of less than 0.950 in an amount more than 40% by number, the toner tends to have a low fluidity to tend to cause image deterioration such as a lowering of fine-line reproducibility.

In the present invention, the toner having the above specific average circularity and specific circularity distribution may preferably be produced by a hot-water bath method in which toner particles produced by pulverization described later are dispersed in water and heated, a heat treatment method in which they are passed through a hot-air stream, or a mechanical impact method in which they are treated by applying a mechanical energy thereto. In the present invention, from the viewpoint of prevention of agglomeration and productivity, the mechanical impact method is preferred, in particular, a heat mechanical impact method in which they are treated at a temperature around the glass transition temperature Tg of the toner particles (Tg plus-minus 10° C.). They may more preferably be treated at a temperature within the range of plus-minus 5° C. of the glass transition temperature Tg of the toner particles. This is especially effective for lessening pores of at least 10 nm in radius on the toner particle surfaces so that the external additive particles can effectively act to improve transfer efficiency.

As a method used to produce the toner particles by pulverization mentioned above, they may be produced by uniformly dispersing constituent materials such as a binder resin and a colorant and also optionally a release agent and a charge control agent by means of a mixing machine such as a Henschel mixer or a media dispersion machine to prepare a mixture, thereafter kneading the mixture by means of a kneading machine such as a pressure kneader or an extruder to obtain a kneaded product, cooling the kneaded product, thereafter crushing it by means of a crusher such as a hammer mill, finely pulverizing the resultant crushed product to have the desired toner particle diameters by a mechanical means or by causing the crushed product to collide against a target under jet streams, and further bringing the resultant pulverized product to a classification step to make its particle size distribution sharp to obtain the toner particles.

In the present invention, in addition to the method of treatment to make spherical the toner particles produced by the above pulverization, the toner having the above specific average circularity and specific circularity distribution may preferably be produced also by the method disclosed in Japanese Patent Publication No. 56-13945, in which a melt-kneaded product is atomized in the air by means of a disk or a multiple fluid nozzle to obtain spherical toner particles; the method as disclosed in Japanese Patent Publication No. 36-10231, and Japanese Patent Applications Laid-Open No. 59-53856 and No. 59-61842, in which polymerization toner particles are produced by suspension polymerization; a dispersion polymerization method in which polymerization toner particles are produced using an aqueous organic solvent capable of dissolving polymerizable monomers and capable of sparingly dissolving the resulting polymer; and an emulsion polymerization method as typified by soap-free polymerization in which toner particles are produced by polymerization of polymerizable monomers in the presence of a water-soluble polar polymerization initiator.

In the present invention, the suspension polymerization is preferred because the toner particles produced can have a sharp particle size distribution and also a wax as the release agent can be incorporated into the toner particles in a large quantity. Seed polymerization, in which monomers are further adsorbed on polymerization toner particles once obtained and thereafter a polymerization initiator is added to carry out polymerization, may also preferably be used in the present invention.

In the toner of the present invention, when it has the toner particles produced by polymerization, the toner particles can be specifically produced by a production process as described below: A monomer composition comprising polymerizable monomers and added therein the release agent comprising a low-softening substance, a colorant, a charge control agent, a polymerization initiator and other additives, having been uniformly dissolved or dispersed by means of a homogenizer or an ultrasonic dispersion machine, is dispersed in an aqueous phase containing a dispersion stabilizer, by means of a conventional agitator, or a dispersion machine such as a homomixer or a homogenizer. Granulation is carried out preferably while controlling the agitation speed and time so that droplets of the monomer composition can have the desired toner particle size. After the granulation, agitation may be carried out to such an extent that the state of particles is maintained and the particles can be prevented from settling by the acton of the dispersion stabilizer. The polymerization may be carried out at a polymerization temperature set at 40° C. or above, usually from 50 to 90° C.

Here, the circularity distribution can be controlled by selecting the type and amount of the dispersion stabilizer, agitation power, pH of the aqueous phase and polymerization temperature.

In the present invention, the circularity distribution of circle-corresponding diameters of toner particles is measured in the following way, using a flow type particle image analyzer FPIA-1000, manufactured by Toa Iyoudenshi K. K.

To make measurement, 0.1 to 0.5% by weight of a surface-active agent (preferably CONTAMINON, trade name; available from Wako Pure Chemical Industries, Ltd.) is added to ion-exchanged water from which fine dust has been removed through a filter and which consequently contains 20 or less particles within the measurement range (e.g., with circle-corresponding diameters of from 0.60 $\mu$m to less than 159.21 $\mu$m) in water of $10^{-3}$ $cm^3$ to prepare a solution. To about 10 ml of this solution (20° C.), about 0.02 g of a measuring sample is added and uniformly dispersed to prepare a sample dispersion. It is dispersed by means of an ultrasonic dispersion machine UH-50, manufactured by K. K. SMT, (vibrator: a titanium alloy chip of 5 mm diameter) for a dispersion time of at least 5 minutes while appropriately cooling the dispersion medium so that its temperature does not become higher than 40° C. Using the above flow type particle image analyzer, the particle size distribution and circularity distribution of particles having circle-corresponding diameters of from 0.60 $\mu$m to less than 159.21 $\mu$m are measured.

The summary of measurement is described in a catalog of FPIA-1000, published by Toa Iyoudenshi K. K., an operation manual of the measuring apparatus and Japanese Patent Application Laid-open No. 8-136439, and is as follows:

The sample dispersion is passed through channels (extending along the flow direction) of a flat transparent flow cell (thickness: about 200 $\mu$m). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circumferential length of the circle having the same area as the two-dimensional image of each particle is divided by the circumferential length of the two-dimensional image of each particle to calculate the circularity of each particle.

Results (relative frequency % and cumulative frequency %) can be obtained by dividing the range of from 0.06 μm to 400 μm into 226 channels (divided into 30 channels for one octave) as shown in Table 1 below. In actual measurement, particles are measured within the range of circle-corresponding diameters of from 0.60 μm to less than 159.21 μm.

In the following Table 1, the upper-limit numeral in each particle diameter range does not include that numeral itself to mean that it is indicated as "less than".

TABLE 1

| Particle diameter ranges (μm) |
|---|
| 0.60–0.61 |
| 0.61–0.63 |
| 0.63–0.65 |
| 0.65–0.67 |
| 0.67–0.69 |
| 0.69–0.71 |
| 0.71–0.73 |
| 0.73–0.75 |
| 0.75–0.77 |
| 0.77–0.80 |
| 0.80–0.82 |
| 0.82–0.84 |
| 0.84–0.87 |
| 0.87–0.89 |
| 0.89–0.92 |
| 0.92–0.95 |
| 0.95–0.97 |
| 0.97–1.00 |
| 1.00–1.03 |
| 1.03–1.06 |
| 1.06–1.09 |
| 1.09–1.12 |
| 1.12–1.16 |
| 1.16–1.19 |
| 1.19–1.23 |
| 1.23–1.26 |
| 1.26–1.30 |
| 1.30–1.34 |
| 1.34–1.38 |
| 1.38–1.42 |
| 1.42–1.46 |
| 1.46–1.50 |
| 1.50–1.55 |
| 1.55–1.59 |
| 1.59–1.64 |
| 1.64–1.69 |
| 1.69–1.73 |
| 1.73–1.79 |
| 1.79–1.84 |
| 1.84–1.89 |
| 1.89–1.95 |
| 1.95–2.00 |
| 2.00–2.06 |
| 2.06–2.12 |
| 2.12–2.18 |
| 2.18–2.25 |
| 2.25–2.31 |
| 2.31–2.38 |
| 2.38–2.45 |
| 2.45–2.52 |
| 2.52–2.60 |
| 2.60–2.67 |
| 2.67–2.75 |

TABLE 1-continued

| Particle diameter ranges (μm) |
|---|
| 2.75–2.83 |
| 2.83–2.91 |
| 2.91–3.00 |
| 3.00–3.09 |
| 3.09–3.18 |
| 3.18–3.27 |
| 3.27–3.37 |
| 3.37–3.46 |
| 3.46–3.57 |
| 3.57–3.67 |
| 3.67–3.78 |
| 3.78–3.89 |
| 3.89–4.00 |
| 4.00–4.12 |
| 4.12–4.24 |
| 4.24–4.36 |
| 4.36–4.49 |
| 4.49–4.62 |
| 4.62–4.76 |
| 4.76–4.90 |
| 4.90–5.04 |
| 5.04–5.19 |
| 5.19–5.34 |
| 5.34–5.49 |
| 5.49–5.65 |
| 5.65–5.82 |
| 5.82–5.99 |
| 5.99–6.16 |
| 6.16–6.34 |
| 6.34–6.53 |
| 6.53–6.72 |
| 6.72–6.92 |
| 6.92–7.12 |
| 7.12–7.33 |
| 7.33–7.54 |
| 7.54–7.76 |
| 7.76–7.99 |
| 7.99–8.22 |
| 8.22–8.46 |
| 8.46–8.71 |
| 8.71–8.96 |
| 8.96–9.22 |
| 9.22–9.49 |
| 9.49–9.77 |
| 9.77–10.05 |
| 10.05–10.35 |
| 10.35–10.65 |
| 10.65–10.96 |
| 10.96–11.28 |
| 11.28–11.61 |
| 11.61–11.95 |
| 11.95–12.30 |
| 12.30–12.66 |
| 12.66–13.03 |
| 13.03–13.41 |
| 13.41–13.80 |
| 13.80–14.20 |
| 14.20–14.62 |
| 14.62–15.04 |
| 15.04–15.48 |
| 15.48–15.93 |
| 15.93–16.40 |
| 16.40–16.88 |
| 16.88–17.37 |
| 17.37–17.88 |
| 17.88–18.40 |
| 18.40–18.94 |
| 18.94–19.49 |
| 19.49–20.06 |
| 20.06–20.65 |
| 20.65–21.25 |
| 21.25–21.87 |
| 21.87–22.51 |
| 22.51–23.16 |
| 23.16–23.84 |
| 23.84–24.54 |

TABLE 1-continued

| Particle diameter ranges (μm) |
|---|
| 24.54–25.25 |
| 25.25–25.99 |
| 25.99–26.75 |
| 26.75–27.53 |
| 27.53–28.33 |
| 28.33–29.16 |
| 29.16–30.01 |
| 30.01–30.89 |
| 30.89–31.79 |
| 31.79–32.72 |
| 32.72–33.67 |
| 33.67–34.65 |
| 34.65–35.67 |
| 35.67–36.71 |
| 36.71–37.78 |
| 37.78–38.88 |
| 38.88–40.02 |
| 40.02–41.18 |
| 41.18–42.39 |
| 42.39–43.62 |
| 43.62–44.90 |
| 44.90–46.21 |
| 46.21–47.56 |
| 47.56–48.94 |
| 48.94–50.37 |
| 50.37–51.84 |
| 51.84–53.36 |
| 53.36–54.91 |
| 54.91–56.52 |
| 56.52–58.17 |
| 58.17–59.86 |
| 59.86–61.61 |
| 61.61–63.41 |
| 63.41–65.26 |
| 65.26–67.16 |
| 67.16–69.12 |
| 69.12–71.14 |
| 71.14–73.22 |
| 73.22–75.36 |
| 75.36–77.56 |
| 77.56–79.82 |
| 79.82–82.15 |
| 82.15–84.55 |
| 84.55–87.01 |
| 87.01–89.55 |
| 89.55–92.17 |
| 92.17–94.86 |
| 94.86–97.63 |
| 97.63–100.48 |
| 100.48–103.41 |
| 103.41–106.43 |
| 106.43–109.53 |
| 109.53–112.73 |
| 112.73–116.02 |
| 116.02–119.41 |
| 119.41–122.89 |
| 122.89–126.48 |
| 126.48–130.17 |
| 130.17–133.97 |
| 133.97–137.88 |
| 137.88–141.90 |
| 141.90–146.05 |
| 146.05–150.31 |
| 150.31–154.70 |
| 154.70–159.21 |
| 159.21–163.86 |
| 163.86–168.64 |
| 168.64–173.56 |
| 173.56–178.63 |
| 178.63–183.84 |
| 183.84–189.21 |
| 189.21–194.73 |
| 194.73–200.41 |
| 200.41–206.26 |
| 206.26–212.28 |
| 212.28–218.48 |

TABLE 1-continued

| Particle diameter ranges (μm) |
|---|
| 218.48–224.86 |
| 224.86–231.42 |
| 231.42–238.17 |
| 238.17–245.12 |
| 245.12–252.28 |
| 252.28–259.64 |
| 259.64–267.22 |
| 267.22–275.02 |
| 275.02–283.05 |
| 283.05–291.31 |
| 291.31–299.81 |
| 299.81–308.56 |
| 308.56–317.56 |
| 317.56–326.83 |
| 326.83–336.37 |
| 336.37–346.19 |
| 346.19–356.29 |
| 356.29–366.69 |
| 366.69–377.40 |
| 377.40–388.41 |
| 388.41–400.00 |

The toner particles the toner of the present invention has may preferably have a shape factor SF-1 of from 100 to 150, and more preferably from 100 to 130, in order to improve filming resistance in practical use and transfer-developing performances.

The toner having the toner particles having the above shape factor not only is indispensable to the faithful reproduction of minuter latent image dots in order to make image quality higher, but also can withstand a high mechanical stress inside the developing assembly to make the deterioration of developer less occur. Moreover, it can well ensure the transfer-developing performances at the time of high-speed copying.

As the carrier particles come to have a shape factor SF-1 greater than 150, the particles gradually become less spherical to become amorphous. Hence, such toner particles may cause difficulties such that they make it difficult to attain uniform charging performance and may damage fluidity. In addition thereto, the friction between toner particles themselves or between toner particles and a charge-providing member such as carrier particles may be so great that the toner particles may break and may be formed into fine particles to tend to cause fog on images formed and also result in a low minuteness.

In the present invention, the SF-1 indicating the shape factor is a value obtained by sampling at random 100 particles of particle images by the use of FE-SEM (S-800; a field-emission scanning electron microscope manufactured by Hitachi Ltd.), introducing their image information in an image analyzer (LUZEX-III; manufactured by Nikore Co.) through an interface to make analysis, and calculating the data according to the following expression. The value obtained is defined as shape factor SF-1.

$$SF\text{-}1=(MXLNG)^2/AREA\times\pi/4\times100$$

wherein MXLNG represents an absolute maximum length of a toner particle on the image, and AREA represents a projected area of a toner particle.

The shape factor SF-1 of the toner particles is measured at magnification of 10,000 times on the FE-SEM.

The toner of the present invention has the toner particles and an external additive. The external additive has, on the toner particles, at least an inorganic fine powder (A) present in the state of primary particles or secondary particles and a non-spherical inorganic fine powder (B) formed by coalescence of a plurality of particles, whereby the toner can have a sharp triboelectric charge distribution and the toner can be improved in fluidity and can be prevented from deterioration due to running.

More specifically, the inorganic fine powder (A) appropriately moves on the toner particle surfaces and thereby so act as to make the charging of the toner particle surfaces uniform, make charge quantity distribution of the toner sharp and also improve the fluidity of the toner. The non-spherical inorganic fine powder (B) functions as a spacer of the toner particles and thereby so act as to restraining the toner particles from being buried in the inorganic fine powder (A).

In general, toner particles having less irregularities on their surfaces and approximate to spheres have less escapes through which the external additive externally added to the toner particle surfaces can slip away when the toner particles come into contact with a member for imparting triboelectric charges to the toner, e.g., the carrier particles, so that the external additive tends to be buried in the toner particle surfaces to tend to cause the deterioration of toner.

The toner of the present invention is an almost spherical toner having an average circularity of from 0.920 to 0.995 and containing particles with a circularity of less than 0.950 in an amount of from 2 to 40% by number as described above. However, since it has the inorganic fine powder (A) and non-spherical inorganic fine powder (B) as an external additive on the toner particles, the inorganic fine powder (A) can be effectively prevented from being buried in the toner particle surfaces.

The inorganic fine powder (A) may have an average particle length on toner particles, of from 10 mμm to 400 mμm, preferably from 15 mμm to 200 mμm, and more preferably from 15 mμm to 100 mμm, and a shape factor SF-1 on toner particles, of from 100 to 130, and preferably from 100 to 125.

If the inorganic fine powder (A) has an average particle length smaller than 10 mμm, it tends to be buried in the toner particle surfaces even when used in combination with the particles of the non-spherical inorganic fine powder (B) to cause the deterioration of toner to conversely tend to result in a low toner concentration control stability. If the powder (A) has an average particle length greater than 400 mμm, it may be difficult to well attain the fluidity of toner to tend to make the charging of toner non-uniform, consequently tending to cause toner scatter and fog.

If the inorganic fine powder (A) have a shape factor SF-1 greater than 130, the inorganic fine powder (A) may move on the toner particle surfaces with difficulty to tend to result in a low fluidity of the toner.

The shape factor SF-1 of the inorganic fine powder (A) on toner particles is measured at magnification of 100,000 times on the FE-SEM.

The inorganic fine powder (A) may preferably have particles having a length/breadth ratio of 1.5 or less, and more preferably 1.3 or less, in order for the inorganic fine powder (A) to be able to move on the toner particle surfaces with ease and the fluidity of toner can be improved.

The inorganic fine powder (A) may preferably have a specific surface area as measured by nitrogen adsorption according to the BET method (BET specific surface area), of from 60 to 230 $m^2/g$, and more preferably from 70 to 180 $m^2/g$, in order for the toner to have good charging properties and fluidity and to be able to achieve a high image quality and a high image density.

If the inorganic fine powder (A) has a BET specific surface area smaller than 60 $m^2/g$, the toner may have a low fluidity to tend to form images with a poor fine-line reproducibility. If it has a BET specific surface area larger than 230 $m^2/g$, the toner may have an unstable charging properties to cause the problem of toner scatter, especially when left in an environment of high humidity over a long period of time.

The non-spherical inorganic fine powder (B) used in the present invention may have a shape factor SF-1 on toner particles, of greater than 150, preferably greater than 190, and more preferably greater than 200, in order for the inorganic fine powder (A) to be restrained from being buried in the toner particle surfaces.

If the non-spherical inorganic fine powder (B) has a shape factor SF-1 of 150 or less, the non-spherical inorganic fine powder (B) itself tends to be buried in the toner particle surfaces, so that the inorganic fine powder (A) may be less effectively restrained from being buried in the toner particle surfaces.

The shape factor SF-1 of the non-spherical inorganic fine powder (B) on toner particles is measured at magnification of 100,000 times on the FE-SEM.

The non-spherical inorganic fine powder (B) may preferably have a length/breadth ratio on toner particles, of 1.7 or more, more preferably 2.0 or more, and still more preferably 3.0 or more, in order for the inorganic fine powder (A) to be highly effectively restrained from being buried in the toner particle surfaces.

The non-spherical inorganic fine powder (B) may preferably have particles having an average length larger than, preferably larger by at least 20 mμm and more preferably larger by at least 40 mμm than, the average length of the inorganic fine powder (A), in order for the inorganic fine powder (A) to be restrained from being buried in the toner particle surfaces.

The non-spherical inorganic fine powder (B) may preferably have an average particle length on the toner particles, of from 120 to 600 mμm, and more preferably from 130 to 500 mμm If the non-spherical inorganic fine powder (B) has an average particle length smaller than 120 mμm, it may have a small spacer effect of restraining the inorganic fine powder (A) from being buried in the toner particle surfaces, so that the toner may have low developing-transfer performances to tend to cause a lowering of image density. If it has an average particle length larger than 600, the above spacer effect can be expected but it tends to become liberated from the toner particle surfaces, consequently tending to cause scrape and scratches of the photosensitive drum.

In the present invention, the inorganic fine powder (A) may preferably be present on the toner particle surfaces in a number of at least 5 particles, more preferably at least 7 particles and still more preferably at least 10 particles, on the average per unit area of 0.5 μm×0.5 μm, and the non-spherical inorganic fine powder (B) may preferably be present on the toner particle surfaces in a number of from 1 to 30 particles, more preferably 1 to 25 particles and still more preferably from 5 to 25 particles, on the average per unit area of 1.0 μm×1.0 μm, as viewed on an electron microscope magnified photograph of the toner. The number of particles of the inorganic fine powder (A) present on the toner particle surfaces is meant to be the total number of the primary particles and secondary particles.

If the particles of the inorganic fine powder (A) present on the toner particle surfaces are less than 5 particles on the average in the above number, the toner may have an insufficient fluidity to consequently tend to cause a decrease in image density.

If the particles of the non-spherical inorganic fine powder (B) present on the toner particle surfaces are less than 1 particle on the average in the above number, the function as a spacer can not be maintained. If they are more than 30 particles, the powder (B) tends to become liberated from the toner particle surfaces to tend to cause the problem of scrape and scratches of the photosensitive drum.

The average length of particles (average particle length) of the external additive, the length/breadth ratio of its particles and the number of particles of the external additive on the toner particle surfaces are measured in the following way.

The respective numerical values of the inorganic fine powder (A) are measured using a magnified photograph taken by photographing toner particle surfaces magnified 100,000 times by the use of FE-SEM (S-800, manufactured by Hitachi Ltd.).

First, the average length of the inorganic fine powder (A) on toner particles is determined by measuring over 10 visual fields the length of each particle of the inorganic fine powder (A) that can be seen on the magnified photograph to be present on the toner particles, and regarding its average value as the average length. Similarly, the average value of the breadth of each particle of the inorganic fine powder (A) and the length/breadth ratio of each particle of the inorganic fine powder (A) are also determined. Here, the length of the particle corresponds to the distance between parallel lines which are maximum among sets of parallel lines drawn tangentially to the contour of each particle of the inorganic fine powder (A), and the breadth of the particle corresponds to the distance between parallel lines which are minimum among such sets of parallel lines.

The number of particles of the inorganic fine powder (A) on the toner particle surfaces is determined by counting in 10 visual fields on the magnified photograph the number of particles of the inorganic fine powder (A) per unit area of 0.5 $\mu$m×0.5 $\mu$m (50 mm×50 mm in the 100,000-time magnified photograph) on the toner particle surfaces, and calculating its average value. When the number of particles of the inorganic fine powder (A) is counted, the number of particles is counted in respect of the inorganic fine powder (A) present in the state of primary particles or secondary particles in the area corresponding to 0.5 $\mu$m×0.5 $\mu$m at the center of the magnified photograph.

The respective numerical values of the non-spherical inorganic fine powder (B) are measured using a magnified photograph taken by photographing toner particle surfaces magnified 30,000 times by the use of FE-SEM (S-800, manufactured by Hitachi Ltd.).

First, the average length of particles of the non-spherical inorganic fine powder (B) is determined by measuring the length of each particle of the non-spherical inorganic fine powder (B) over 10 visual fields on the magnified photograph, and regarding its average value as the average length diameter. Similarly, the average value of the breadth of each particle and the length/breadth ratio of each particle of the non-spherical inorganic fine powder (B) are also determined. Here, the length of the particle corresponds to the distance between parallel lines which are maximum among sets of parallel lines drawn tangentially to the contour of each coalesced particle of the non-spherical inorganic fine powder (B), and the breadth of the particle corresponds to the distance between parallel lines which are minimum among such sets of parallel lines.

The number of particles of the non-spherical inorganic fine powder (B) on the toner particle surfaces is determined by counting in 10 visual fields on the magnified photograph the number of particles of the non-spherical inorganic fine powder (B) per unit area of 1.0 $\mu$m×1.0 $\mu$m (30 mm×30 mm in the 30,000-time magnified photograph) on the toner particle surfaces, and calculating its average value. When the number of particles of the non-spherical inorganic fine powder (B) is counted, it is counted on the non-spherical inorganic fine powder (B) present in the area corresponding to the area of 1.0 $\mu$m×1.0 $\mu$m at the center of the magnified photograph.

To distinguish the inorganic fine powder (A) from the non-spherical inorganic fine powder (B) on the electron microscope magnified photograph, the inorganic fine powder (A) and the non-spherical inorganic fine powder (B) may be separately detected by using a method in which the positions where the inorganic finer powder particles are present are confirmed on the FE-SEM to detect only specific designated elements by an X-ray microanalyzer, when there is a compositional difference between the inorganic fine powders. Alternatively, when there is a clear difference in particle shape between the inorganic fine powders, the judgement may be made in accordance with the difference in particle shape on the electron microscope magnified photograph. Either method may be employed.

The non-spherical inorganic fine powder (B) may preferably have a specific surface area as measured by nitrogen adsorption according to the BET method (BET specific surface area), of from 20 to 90 $m^2/g$, and more preferably from 25 to 80 $m^2/g$, in order for powder (B) to be uniformly dispersed on the toner particle surfaces with ease and also to be able to maintain the function as a spacer over a long period of time.

If the non-spherical inorganic fine powder (B) has a BET specific surface area smaller than 20 $m^2/g$, the powder (B) tends to become liberated from the toner on the photosensitive drum to tend to scrape or scratch the photosensitive drum. If it has a BET specific surface area larger than 90 $m^2/g$, the powder (B) may have a low function as a spacer on the photosensitive drum to tend to cause a lowering of transfer performance especially in an environment of low humidity.

The BET specific surface areas of the inorganic fine powder (A) and non-spherical inorganic fine powder (B) are measured in the following way, using Autosorb I, a specific surface area meter manufactured by Quantach Rome Co.

About 0.1 g of a measuring sample is weight out in a cell, and is deaerated at a temperature of 40° C., under a degree of vacuum of $1.0\times10^{-3}$ mmHg or less for at least 12 hours. Thereafter, nitrogen gas is adsorbed in the state where the sample is cooled with liquid nitrogen, and then the value is determined by the multiple point method.

The toner's external additive usable in the present invention may be any materials so long as the state of its dispersion on the toner particle surfaces can be satisfied, and may include, e.g., oxides such as alumina, titanium oxide, silica, zirconium oxide and magnesium oxide, as well as silicon carbide, silicon nitride, boron nitride, aluminum nitride, magnesium carbonate and organosilicon compounds.

Of these, alumina, titanium oxide, zirconium oxide, magnesium oxide, or their fine particles treated with silica, and silicon nitride are preferred as the inorganic fine powder (A), because they are not influenced by temperature and humidity and the charging of toner can be made stable. Fine alumina particles or fine titanium oxide particles, or these fine particles treated with silica, are more preferred in order to improve the fluidity of the toner.

There are no particular limitations on how to make such fine particles, and may be used a method in which a halide or an alkoxide is oxidized in a gaseous phase or a method in which they are formed while hydrolyzing it in the presence of water. Firing may preferably be carried out at a temperature low enough not to cause aggregation of primary particles.

In the present invention, amorphous or anatase type titanium oxide and amorphous or gamma alumina which have been fired at a low temperature are preferred in view of their readiness for making them monodisperse in the form of spherical and primary particles.

The inorganic fine powder (A) may preferably be further subjected to hydrophobic treatment, in order to make the toner's charge quantity less dependent on environment such as temperature and humidity and to prevent the powder (A) from becoming liberated from toner particle surfaces. Agents for such hydrophobic treatment may include coupling agents such as a silane coupling agent, a titanium coupling agent and an aluminum coupling agent, and oils such as a silicone oil, a fluorine oil and various modified oils.

Of the above hydrophobic-treating agents, coupling agents are particularly preferred in view of the feature that they react with residual groups or adsorbed water on the inorganic fine powder to achieve uniform treatment to make the charging of toner stable and impart fluidity to the toner.

Accordingly, as the inorganic fine powder (A) used in the present invention, fine alumina particles or fine titanium oxide particles having been surface-treated while hydrolyzing a silane coupling agent are very effective in view of making charge stable and imparting fluidity.

The inorganic fine powder (A) having been subjected to hydrophobic treatment may preferably be made to have a hydrophobicity of from 20 to 80%, and more preferably from 40 to 80%.

If the inorganic fine powder (A) has a hydrophobicity less than 20%, charges may greatly decrease when the toner is left for a long period of time in an environment of high humidity, so that a mechanism for charge acceleration becomes necessary on the side of hardware, resulting in a complicated apparatus. If it has a hydrophobicity more than 80%, it may be difficult to control the charging of the inorganic fine powder itself, tending to result in charge-up of the toner in an environment of low humidity.

The inorganic fine powder (A) having been subjected to hydrophobic treatment may preferably have a light transmittance of 40% or more at a light wavelength of 400 nm.

More specifically, even though the inorganic fine powder (A) used in the present invention have a small primary particle diameter, the inorganic fine powder (A) does not necessarily stand dispersed in the form of primary particles when actually incorporated into the toner, and may sometimes be present in the form of secondary particles. Hence, whatever the primary particle diameter is small, the present invention may be less effective if the particles behaving as secondary particles have a large effective diameter. Nevertheless, the inorganic fine powder (A) having a higher light transmittance at 400 nm which is the minimum wavelength in the visible region has a correspondingly smaller secondary particle diameter. Thus, good results can be expected for the fluidity-providing performance and the sharpness of projected images in OHP (overhead projection).

The reason why 400 nm is selected is that it is a wavelength at a boundary region between ultraviolet and visible, and also it is said that light passes through particles with a diameter not larger than ½ of light wavelength. In view of these, any transmittance at wavelengths beyond 400 nm becomes higher as a matter of course and is not so meaningful.

In the present invention, as a method for subjecting the inorganic fine powder (A) to hydrophobic treatment, a method is preferred in which the inorganic fine powder (A) is surface-treated in the presence of water while mechanically dispersing them so as to be formed into primary particles and while hydrolyzing a coupling agent. Such treatment makes it hard for the particles themselves to coalesce and also the treatment makes the particles mutually undergo static repulsion, so that the inorganic fine powder (A) can be surface-treated substantially in the state of primary particles.

Since a mechanical force is applied so that the inorganic fine powder (A) can be dispersed to be formed into primary particles when its particle surfaces are treated in the presence of water while hydrolyzing a coupling agent, it is unnecessary to use coupling agents such as chlorosilanes or silazanes that may generate gas. Also, it becomes possible to use a highly viscous coupling agent that has not been usable because of coalescence of particles in a gaseous phase, so that the particles can be greatly effectively made hydrophobic.

The above coupling agent may include any of silane coupling agents and titanium coupling agents. Those particularly preferably usable are silane coupling agents which are represented by the formula:

$$R_mSiY_n$$

wherein R is an alkoxyl group; m is an integer of 1 to 3; Y is an alkyl group, or a hydrocarbon group containing a vinyl group, a glycidoxyl group or a methacrylic group; and n is an integer of 1 to 3; and may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

The coupling agent may more preferably be those represented by $C_aH_{2a+1}$-$Si(OC_bH_{2b+1})_3$, wherein a is 4 to 12 and b is 1 to 3.

Here, if a in the formula is smaller than 4, the treatment becomes easier but no satisfactory hydrophobicity can be achieved. If a is larger than 12, a satisfactory hydrophobicity can be achieved but the coalescence of particles may more occur, resulting in a lowering of fluidity-providing performance.

If b is larger than 3, the reactivity may become lower to make the particles insufficiently hydrophobic. Hence, a in the above formula should be 4 to 12, and preferably 4 to 8, and b should be 1 to 3, and preferably 1 to 2.

The inorganic fine powder (A) may be treated with the treating agent used in an amount of from 1 to 50 parts by weight based on 100 parts by weight of the powder (A), and preferably from 3 to 40 parts by weight in order to make uniform treatment without causing any coalescence, and may be made to have a hydrophobicity of from 20 to 98%, preferably from 30 to 90%, and more preferably from 40 to 80%.

In the present invention, the non-spherical inorganic fine powder (B) may preferably be selected from fine powders of silica, and alumina, titania or double oxides thereof, in order to improve charging stability, developing performance, fluidity and storage stability. In particular, fine silica powder is preferred because the coalescence of primary particles can be controlled arbitrarily to a certain extent by the starting material and the oxidizing condition such as oxidation temperature. For example, the fine silica powder includes what is called dry-process silica or fumed silica produced by vapor phase oxidation of silicon halides or alkoxides and what is called wet-process silica produced from alkoxides or water glass, either of which may be used. The dry-process silica is preferred, as having less silanol groups on the surface and inside and leaving no production residues such as $Na_2O$ and $SO_3^{2-}$. In the dry-process silica, it is also possible to use, in its production step, other metal halide such as aluminum chloride or titanium chloride together with the silicon halide to obtain a composite fine powder of silica with other metal oxide. The fine silica powder includes these, too.

Figure 10:
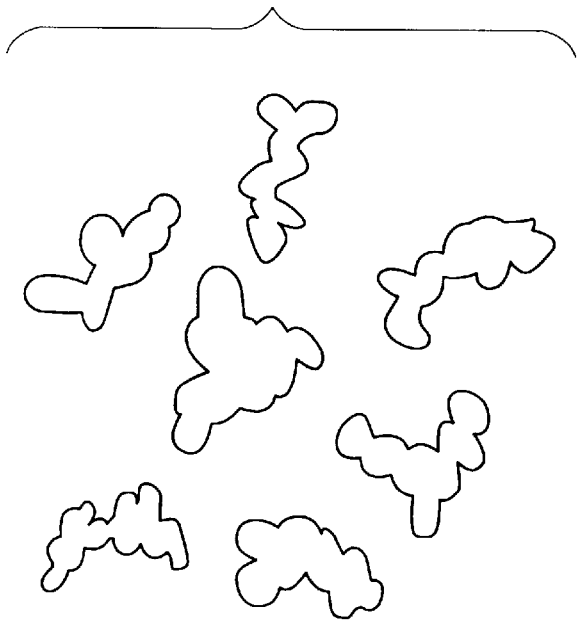
FIG. 10 diagrammatically illustrates the particle shape of the non-spherical inorganic fine powder (B).

As the shape of its particles, the particles may be not non-spherical particles such as merely rod-like particles or mass-like particles, but non-spherical particles having rugged portions or indents as shown in FIG. 10. This is preferable because the inorganic fine powder (A) can be prevented from being buried in the toner particle surfaces and simultaneously the developer can be prevented from closest packing, so that the developer may cause a small change in bulk density.

Such non-spherical fine inorganic oxide particles may preferably be produced especially in the following way.

When the fine silica powder is given as an example, a silicon halide is subjected to gaseous phase oxidation to form fine silica powder, and the fine silica powder is subjected to hydrophobic treatment to produce non-spherical fine silica powder. Especially in the case of the gaseous phase oxidation, firing may preferably be carried out at a temperature high enough for the primary particles of silica to coalesce.

Such non-spherical inorganic fine powder (B) may particularly preferably be those obtained by classifying coalesced particles comprised of primary particles having mutually coalesced, to collect relatively coarse particles, and adjusting their particle size distribution so as to fulfill the condition of the average length in the state they are present on the toner particle surfaces.

In the present invention, the toner may have, based on 100 parts by weight of the toner, the inorganic fine powder (A) in an amount of from 0.1 to 2.0 parts by weight in order to make the toner's charge quantity stable, preferably from 0.2 to 2.0 parts by weight in view of providing fluidity, and more preferably from 0.2 to 1.5 parts by weight in view of the improvement of fixing performance, and also the non-spherical inorganic fine powder (B) in an mount of from 0.3 to 3.0 parts by weight in order to make the developer's bulk density stable, preferably from 0.3 to 2.5 parts by weight in view of the prevention of scrape of the photosensitive drum, more preferably from 0.3 to 2.0 parts by weight in view of the storage stability in a high humidity, and still more preferably from 0.3 to 1.5 parts by weight for the sake of OHP transparency.

If the toner has the inorganic fine powder (A) in an amount less than 0.1 part by weight, the toner may have an insufficient fluidity to tend to cause a decrease in image density. If it is in an amount more than 20 parts by weight, the toner tends to be unstably charged especially when left for a long term in an environment of high humidity, consequently tending to cause toner scatter.

If the toner has the non-spherical inorganic fine powder (B) in an amount less than 0.3 part by weight, the inorganic fine powder (A) may be less effectively prevented from being buried in toner particles. If it is in an amount more than 3.0 parts by weight, it tends to cause scratches on the photosensitive drum, consequently tending to cause faulty images.

In the present invention, as to the external additive externally added to polymerization toner particles produced by polymerization, it is one of the preferred embodiments to use at least fine alumina particles as the inorganic fine powder (A) and fine silica particles as the non-spherical inorganic fine powder (B).

The fine alumina particles externally added may preferably have, in their particle size distribution, particles with particle diameter at least twice the average particle diameter in an amount of from 0 to 5% by number, and the fine silica particles externally added may preferably have, in the particle size distribution of the particles constituting the coalesced particles, particles with particle diameter twice to three times the average primary particle diameter in an amount of from 5 to 15% by number.

The external additive according to the present invention is characterized in that the fine alumina particles have a very sharp particle size distribution and the particles constituting the coalesced particles of the fine silica particles have a relatively broad particle size distribution. The fine alumina particles have a high fluidity-providing power and also the function to greatly influence the charging performance of the toner to greatly lessen the difference in charging between environments greatly concerned with humidity dependence.

The present inventors have discovered that, in addition to the shape factor of the polymerization toner particles and the particle diameter ratio (length/breadth ratio) of the external additive, making the fine alumina particles have a sharp particle size distribution makes the charging highly stable and also ensures uniformity of the charges produced on the toner particle surfaces as a result of the friction between the toner particles. The present inventors have also discovered that, as the most remarkable effect in the present invention, a high transfer performance can be achieved by making the fine alumina particles have a sharp particle size distribution. These effects, which are concerned with the particle size distribution of the particles constituting the coalesced particles of the fine silica particles as will be described layer, are presumed to be attributable to their role as spacer particles effectively acting between toner particles because the fine alumina particles are formed of uniform particles and have a fine particle diameter. Thus, it is presumed that the particles do not apt to form coalesced particles also after they have been externally added to the toner particle surfaces. If the fine alumina particles have number distribution outside the above range, they tend to form coalesced particles or aggregates to make it difficult to obtain the desired effect attributable to the present invention.

In addition, the particles constituting the coalesced particles of the fine silica particles are made to have a relatively broad particle size distribution. Thus, they are considered to be endowed with a wide charge-providing performance irrespective of the particle size distribution of the toner. With regard to the ability to provide charges to toner, the fine silica particles have a higher ability than the fine alumina particles. Accordingly, the former can dispersively provide charges equally to all particles irrespective of the toner particles having not only fine particles but also even relatively large particles, and simultaneously the spacer effect can be obtained which is obtained also in the fine alumina particles. As to the range of their particle size distribution, if it is outside the lower limit of the above range, the fine silica particles tend to adhere to the photosensitive drum surface and the areas to which they have adhered may act as nuclei to tend to cause toner filming. If it is outside the upper limit, the fluidity of the toner may be greatly damaged as a result, and repeated operations to take copies for a long time tend to cause the deterioration of developer. From these facts, too, the present inventors have discovered that the fine silica particles enable the toner to be uniformly charged and to maintain its fluidity because the toner has the presence of particles in a broad particle size distribution.

The fine alumina particles and fine silica particles used in the present invention may preferably have a BET specific surface area of from 60 to 150 $m^2/g$ in respect of the fine alumina particles, and from 20 to 70 $M^2/g$ in respect of the fine silica particles. If the both particles have values outside the above range, the above desired particle diameters can not be attained to result in damage of image quality.

The fine alumina particles may preferably be fine alumina particles obtained using as a parent material a fine alumina powder obtained by thermal decomposition of aluminum ammonium carbonate hydroxide at temperature within the range of from 1,000 to 1,200° C., which is thereafter subjected to hydrophobic treatment in a solution.

The fine alumina powder parent material may preferably be gamma alumina disclosed in Japanese Patent Application Laid-Open No. 61-146794, or amorphous alumina fired at a lower temperature.

It is preferable to obtain the fine alumina powder by firing aluminum ammonium carbonate hydroxide represented by the formula $NH_4AlO(OH)HCO_3$ or $NH_4AlCO_3(OH)_2$ in an atmosphere of, e.g., oxygen and at temperature within the range of from 1,000 to 1,200° C. More specifically, fine alumina powder obtained after the chemical reaction shown below is preferred.

$$2NH_4AlCO_3(OH)_2 \rightarrow Al_2O_3+2NH_3+3H_2O+2CO_2$$

Here, the temperature within the range of from 1,000 to 1,200° C. is selected as firing temperature because the particle diameters intended in the present invention can be obtained.

If the firing temperature is higher than 1,200° C., the proportion of alpha alumina in the fine alumina powder formed may abruptly increase. Of course, the powder structurally grows to have a large primary particle diameter and have a low BET specific surface area. In addition, particles of the powder mutually aggregate in a higher strength to make it necessary to apply a great energy for dispersing the parent material in the step of treatment. The powder brought into such a state is no longer expected to be a fine powder having less aggregated particles, whatever the step of treatment is optimized.

If the firing temperature is lower than 1,000° C., the powder may have a particle diameter smaller than the intended size, and may have no sufficient role as the spacer, also making it difficult to attain a high transfer performance.

The surface hydrophobic-treating agent for the fine alumina particles used in the present invention may be selected in accordance with the purpose of surface modification, e.g., the control of charging performance and also the stabilization of charging in an environment of high humidity and the reactivity. For example, silane type organic compounds such as alkoxysilanes, siloxanes, silanes and silicone oils may be used, which do not undergo thermal decomposition in itself at reaction and treatment temperatures.

As those particularly preferred, coupling agent alkylalkoxysilanes may be used, having a volatility and having both hydrophobic groups and bonding groups rich in reactivity.

To calculate the average primary particle diameter of the fine alumina particles and that of the particles constituting the coalesced particles of the fine silica particles, a photographic image of particles so dispersed in epoxy resin as to be enclosed and embedded therein and thereafter cut in thin slices is obtained using a transmission electron microscope (TEM) (10,000 to 100,000 magnifications). On this photographic image, 20 to 50 particles are sampled at random. Thereafter, with regard to spherical particles, their diameter is regarded as diameter of the particles, and, with regard to flat particles, their length. Their arithmetic mean is found to calculate the average primary particle diameter.

In the present invention, it is one of the preferred embodiments to further add, in addition to the inorganic fine powder (A) and non-spherical inorganic fine powder (B) which are constituted as described above, inorganic or organic nearly spherical particles having primary particle diameters of 50 mμm or larger (and preferably having a specific surface area smaller than 50 $m^2/g$), in order to improve transfer performance and/or cleaning performance. For example, spherical silica particles, spherical polymethylsilsesquioxane particles or spherical resin particles may preferably be used.

In the toner of the present invention, other additive particles may also be used in a small quantity so long as they substantially do not adversely affect the toner. Such other additive particles may include lubricant powders as exemplified by Teflon powder, stearic acid zinc powder and polyvinylidene fluoride powder; abrasives as exemplified by cerium oxide powder, silicon carbide powder and strontium titanate powder; anti-caking agents as exemplified by titanium oxide powder and aluminum oxide powder; conductivity-providing agents as exemplified by carbon black powder, zinc oxide powder and tin oxide powder; and developability improvers as exemplified by reverse-polarity organic fine particles and reverse-polarity inorganic fine particles.

In the present invention, in order to faithfully develop minuter latent image dots for the purpose of making image quality higher, the toner may preferably have a fine particle diameter. Stated specifically, the toner has a weight-average particle diameter of from 2.0 μm to 9.0 μm, and preferably from 4.0 μm to 8.0 μm, as measured with a Coulter counter. The toner may also preferably have a coefficient of variation of number distribution, of 35% or less, and more preferably from 5% to 30%.

A toner having a weight-average particle diameter smaller than 2 μm may have so poor a transfer efficiency that the transfer residual toner may occur on the photosensitive drum in a large quantity to tend to not only cause uneven images but also cause its melt-adhesion to drum. A toner having a weight-average particle diameter larger than 9 μm tends to cause a lowering of image quality, e.g., black spots around character line images, and also tends to cause melt-adhesion of toner to various members.

A toner having more than 35% of coefficient of variation of number distribution tends to be non-uniformly charged, consequently tending to cause fog.

The particle size distribution of the toner of the present invention is measured with a Coulter counter Model TA-II. Coulter Multisizer (manufactured by Coulter Electronics, Inc.) may be used. As an electrolytic solution, an aqueous 1% NaCl solution is prepared using first-grade sodium chloride. For example, ISOTON R-II (trade name, manufactured by Coulter Scientific Japan Co.) may be used. Measurement is carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. An interface (manufactured by Nikkaki K. K.) that outputs number distribution and volume distribution and a personal computer PC9801 (manufactured by NEC.) are connected. The volume distribution and number distribution of toner particles with diameters of 2.00 μm or larger are calculated by measuring the volume and number of toner particles by means of the above measuring device, using an aperture of 100 μm as its aperture.

Then, as the values according to the-present invention, the weight-based, weight average particle diameter (D4) (the middle value of each channel is used as the representative value for each channel) determined from the volume distribution and the coefficient of variation of number distribution are determined.

The coefficient of variation of number distribution is calculated according to the following expression.

Coefficient of variation (%)=(standard deviation of number distribution/number-average particle diameter)×100

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The toner particles the toner of the present invention has contains at least a binder resin and a colorant.

As the binder resin used in the present invention, it may include homopolymers of styrene and derivatives thereof such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; polyacrylic or -methacrylic resins such as polymethacrylate, polymethyl methacrylate, polybutyl methacrylate, polyacrylate and polymethyl acrylate; polyvinyl acetate; polyethylene; polypropylene; polyvinyl butyral; polyester resins; rosins; modified rosins; terpene resins; phenol resins; aliphatic or alicyclic hydrocarbon resins; aromatic petroleum resins; paraffin wax; and carnauba wax. Any of these may be used alone or in the form of a mixture.

In the toner particles according to the present invention, a low-softening substance, what is called wax, may optionally be used.

The low-softening substance used in the present invention may include polymethylene waxes such as paraffin wax, polyolefin wax, microcrystalline wax and Fischer-Tropsch wax, amide waxes, higher fatty acids, long-chain alcohols, ester waxes, petrolatums, carnauba wax, ketones, hardened caster oil, vegetable waxes, animal waxes, mineral waxes, and derivatives thereof such as graft compounds and block compounds. These may preferably be those from which low-molecular-weight components have been removed and having a sharp maximum endothermic peak in the DSC endothermic curve.

Waxes preferably usable are straight-chain alkyl alcohols having 15 to 100 carbon atoms, straight-chain fatty acids, straight-chain acid amides, straight-chain esters or montan type derivatives. Any of these waxes form which impurities such as liquid fatty acids have been removed are also preferred.

Waxes more preferably usable may include low-molecular-weight alkylene polymers obtained by radical polymerization of alkylenes under a high pressure or polymerization thereof in the presence of a Ziegler catalyst or any other catalyst under a low pressure; alkylene polymers obtained by thermal decomposition of high-molecular-weight alkylene polymers; those obtained by separation and purification of low-molecular-weight alkylene polymers formed as by-products when alkylenes are polymerized; and polymethylene waxes obtained by extraction fractionation of specific components from distillation residues of hydrocarbon polymers obtained by the Arge process from a synthetic gas comprised of carbon monoxide and hydrogen, or synthetic hydrocarbons obtained by hydrogenation of distillation residues. Antioxidants may be added to these waxes.

In the present invention, the wax may be an ester wax composed chiefly of an esterified compound of a long-chain alkyl alcohol having 15 to 45 carbon atoms with a long-chain alkyl carboxylic acid having 15 to 45 carbon atoms. This is particularly preferred in view of a high transparency of projected images formed using an overhead projector and good full-color projected images formed.

The low-softening substance that functions as a release agent component in the present invention may preferably have a weight-average molecular weight (Mw) of from 300 to 3,000, and more preferably from 500 to 2,500, and a weight-average molecular weight/number-average molecular weight (Mw/Mn) of not more than 3.0, and more preferably from 1.0 to 2.0.

If the low-softening substance has an Mw less than 300, the toner may have a low blocking resistance. If the low-softening substance has an Mw more than 3,000, its crystallizability may come out to cause a low transparency. If the low-softening substance has an Mw/Mn more than 3.0, the toner may have a low fluidity to tend to cause uneven image density and also tend to cause contamination of the charging member.

The release agent used in the present invention may preferably have an endothermic main peak in a temperature range of from 40 to 120° C., more preferably from 40 to 90° C., and still more preferably from 45 to 85° C., in the the endothermic curve measured by DSC (differential scanning calorimetry) according to ASTM D3418-8. If it has an endothermic main peak of below 40° C., the low-softening substance may have a weak self-cohesive force, resulting in poor high-temperature anti-offset properties, undesirably. If it has an endothermic main peak of above 120° C., the toner may undesirably have a higher fixing temperature and, especially when the toner particles are produced by polymerization, the low-softening substance may precipitate in the course of granulation to disorder the suspension system, undesirably, if the temperature of the endothermic main peak is high.

In the present invention, the DSC measurement is made using, e.g., DSC-7, manufactured by Perkin Elmer Co. The temperature at the detecting portion of the device is corrected on the basis of melting points of indium and zinc, and the calorie is corrected using indium fusion heat. The sample is put in a pan made of aluminum, and an empty pan is set as a control, to make measurement at a rate of temperature rise of 10° C./min at temperatures of from 20° C. to 200° C.

In the present invention, the toner particles may preferably contain the low-softening substance in an amount of from 1 to 30% by weight, and more preferably from 5 to 30% by weight, based on the weight of the toner particles. If the toner particles contains the low-softening substance in an amount less than 1% by weight, the toner may have a low anti-offset effect. If it is in an amount more than 30% by weight, the toner particles may mutually coalesce at the time of granulation also when the toner particles are produced by polymerization, to tend to produce particles having a broad particle size distribution.

As charge control agents used in the present invention, known agents may be used. In the case of color toners, it is particularly preferable to use charge control agents that are colorless, make toner charging speed higher and are capable of stably maintaining a constant charge quantity. In the case when the toner particles produced by polymerization are used, charge control agents having neither polymerization inhibitory action nor solubilizates in the aqueous dispersion medium are particularly preferred.

The charge control agents may include, as negative charge control agents, salicylic acid metal compounds, naphthoic acid metal compounds, dicarboxylic acid metal compounds, polymer type compounds having sulfonic acid or carboxylic acid in the side chain, boron compounds, urea compounds, silicon compounds, and carixarene, any of which may be used. As positive charge control agents, they may include quaternary ammonium salts, polymer type compounds having such a quaternary ammonium salt in the side chain, guanidine compounds, and imidazole compounds, any of which may be used.

The charge control agent may preferably be used in an amount of from 0.5 to 10 parts by weight based on 100 parts by weight of the binder resin. In the present invention, however, the addition of the charge control agent is not essential. In the case when two-component development is employed, the triboelectric charging with a carrier may be utilized. Also in the case when one-component development (non-magnetic one-component blade-coating development) is employed, the triboelectric charging with a blade member serving as a toner layer thickness regulation member or a sleeve member serving as a toner carrying member may be intentionally utilized. Accordingly, the charge control agent need not necessarily be contained in the toner particles.

As the binder resin used in the present invention, it may include homopolymers of styrene and derivatives thereof such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl a-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride; phenol resins; natural resin modified phenol resins; natural resin modified maleic acid resins; acrylic resins; methacrylic resins; polyvinyl acetate; silicone resins; polyester resins; polyurethanes; polyamide resins; furan resins; epoxy resins; xylene resins; polyvinyl butyral; terpene resins; cumarone indene resins; and petroleum resins. Also, a cross-linked styrene resin is a preferred binder resin.

As comonomers copolymerizable with styrene monomers in the styrene copolymers, vinyl monomers may be used alone or in combination of two or more. The vinyl monomers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether.

In the present invention, as cross-linking agents, compounds having at least two polymerizable double bonds may be used. For example, they include aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

It is particularly preferable to further add a polar resin such as a styrene-acrylic or -methacrylic copolymer, a styrene-maleic acid copolymer or a saturated polyester resin in addition to the above styrene copolymers.

Binder resins for toners used in pressure fixing may include low-molecular-weight polyethylene, low-molecular-weight polypropylene, an ethylene-vinyl acetate copolymer, an ethylene-acrylate copolymer, higher fatty acids, polyamide resins and polyester resins. Any of these may be used alone or in the form of a mixture. In particular, when the toner particles are produced by polymerization, those having neither polymerization inhibitory action nor solubilizates in the aqueous dispersion medium are preferred.

As colorants used in the present invention, carbon black, magnetic materials, and colorants toned in black by the use of yellow, magenta and cyan colorants shown below are used as black colorants.

As the yellow colorant, compounds typified by condensation azo compounds, isoindolinone compounds, anthraquinone compounds, azo metal complexes, methine compounds and allylamide compounds are used. Stated specifically, C. I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

As the magenta colorant, condensation azo compounds, diketopyropyyrole compounds, anthraquinone compounds, quinacridone compounds, basic dye lake compounds, naphthol compounds, benzimidazolone compounds, thioindigo compounds and perylene compounds are used. Stated specifically, C. I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

As the cyan colorant, copper phthalocyanine compounds and derivatives thereof, anthraquinone compounds and basic dye lake compounds may be used. Stated specifically, C. I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution.

The colorants used in the present invention are selected taking account of hue angle, chroma, brightness, weatherability, transparency on OHP films and dispersibility in toner particles. The colorant may be used in an an amount of from 1 to 20 parts by weight based on 100 parts by weight of the binder resin.

When the magnetic material is used as the black colorant, it is added unlike the other colorants in an amount of 40 to 150 parts by weight based on 100 parts by weight of the binder resin.

In the present invention, the invention can be made more effective by using polymerization toner particles a part or the whole of which is formed by polymerization. In particular, as to a toner whose toner particles are formed by polymerization at the part of their surfaces, the toner particles are made present as pretoner (monomer composition) particles in the dispersion medium and their necessary portions are formed by polymerization. Hence, particles having fairly smooth surface properties can be obtained.

In the present invention, the toner particles may have a core/shell structure wherein shells are formed of a polymer synthesized by polymerization and cores are formed of a low-softening substance. This is preferable because the fixing performance of the toner can be improved without damaging its blocking resistance and also residual monomers can be removed from toner particles with ease.

More specifically, compared with a polymerization toner particles of bulk form having no cores, polymerizing only the part of shells makes it more easy to remove residual monomers in the step of post treatment after the step of polymerization.

In the present invention, suspension polymerization carried out under normal pressure or reduced pressure, which can relatively readily obtain fine toner particles having a sharp particle size distribution and a weight-average particle diameter of from 2.0 to 9.0 $\mu$m, or from 3.0 to 8.0 $\mu$m for the purpose of higher image quality, is particularly preferred because the core/shell structure wherein a wax which is the low-softening substance is encapsulated in toner particles can be formed with ease. As a specific method for encapsulating the low-softening substance, the polarity of main monomers in a polymerizable monomer composition in an aqueous medium may be set smaller than the polarity of the low-softening substance, and also a resin or monomer having a great polarity may be added in the polymerizable monomer composition preferably in a small quantity, whereby toner particles can be obtained which have a core/shell structure wherein the surfaces of cores formed of the low-softening substance are covered with shells formed of shell resin. The particle size distribution and particle diameter of the toner particles may be controlled by a method in which the type or amount of a sparingly water-soluble inorganic salt or a dispersant having the action of protective colloids is changed; or a method in which mechanical device conditions, e.g., agitation conditions such as the peripheral speed of a rotor, pass times and the shape of agitating blades and the shape of a reaction vessel, or the concentration of solid matter in the aqueous medium.

As a specific method of confirming the core/shell structure of the toner particles, the toner particles are well dispersed in a room temperature curing epoxy resin, followed by curing in an environment of temperature 40° C. for 2 days, and the cured product obtained is dyed with triruthenium tetraoxide optionally in combination with triosmium tetraoxide, thereafter samples are cut out in slices by means of a microtome having a diamond cutter to observe the cross-sectional form of toner particles using a transmission electron microscope (TEM). In the present invention, it is preferable to use the triruthenium tetraoxide dyeing method in order to form a contrast between the materials by utilizing some difference in crystallinity between the low-softening substance constituting the core and the resin constituting the shell.

In the present invention, when the toner particles are prepared by polymerization, the polymerizable monomer used for synthesizing the binder resin may include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and ene monomers such as butadiene, isoprene, cyclohexene, acrylo- or methacrylonitrile and acrylic acid amide, any of which may preferably be used.

Any of these polymerizable monomers may be used alone, or usually used in the form of an appropriate mixture of monomers so mixed that the theoretical glass transition temperature (Tg) as described in a publication POLYMER HANDBOOK, 2nd Edition, pp.139–192 (John Wiley & Sons, Inc.) ranges from 40° to 80° C. If the theoretical glass transition temperature is lower than 40° C., problems may arise in respect of storage stability of toner or running stability of developer. If on the other hand the theoretical glass transition temperature is higher than 80° C., the fixing point of the toner may become higher. Especially in the case of color toners used to form full-color images, the color mixing performance of the respective color toners at the time of fixing may be insufficient, resulting in a poor color reproducibility, and also the transparency of OHP images may seriously lower. Thus, such temperatures are not preferable from the viewpoint of high image quality.

In the present invention, the resin component of the shell resin constituting the shell may preferably have a number-average molecular weight (Mn) of from 5,000 to 1,000,000, and more preferably from 6,000 to 500,000, and may preferably have a ratio of weight-average molecular weight (Mw) to number-average molecular weight (Mn), Mw/Mn, of from 2 to 100, and more preferably from 3 to 70.

If it has a number-average molecular weight (Mn) less than 5,000, the low-softening substance tends to come out to particle surfaces to tend to cause a lowering of blocking resistance of the toner.

If it has a weight-average molecular weight (Mw) more than 1,000,000, the low-temperature fixing performance may become damaged.

If its weight-average molecular weight (Mw)/number-average molecular weight (Mn), Mw/Mn, is less than 2, it may be difficult to achieve both the low-temperature fixing performance and the blocking resistance. If it is more than 100, the toner may have a low transparency to make color OHP images have a low quality.

Molecular weight of the resin component of the shell resin is measured by GPC (gel permeation chromatography). As a specific method for measurement by GPC, the toner is beforehand extracted with a toluene solvent for 20 hours by means of a Soxhlet extractor, and thereafter the toluene is evaporated by means of a rotary evaporator, followed by addition of an organic solvent (e.g., chloroform) capable of dissolving the low-softening substance but not dissolving the shell resin, to thoroughly carry out washing. Thereafter, the solution is dissolved in THF (tetrahydrofuran), and then filtered with a solvent-resistant membrane filter of 0.3 $\mu$m in pore diameter to obtain a sample. Molecular weight of the sample is measured using a detector 150C, manufactured by Waters Co. As column constitution, A-801, A-802, A-803, A-804, A-805, A-806 and A-807, available from Showa Denko K. K., are connected, and the molecular weight distribution is measured using a calibration curve of a standard polystyrene resin.

When the toner particles having the core/shell structure are produced, it is preferable to add to the shell, in addition to the shell resin, a polar resin in order for the core low-softening substance to be better encapsulated by the shell. As the polar resin used in the present invention, copolymers of styrene with acrylic or methacrylic acid, maleic acid copolymers, saturated polyester resins and epoxy resins may preferably be used. The polar resin may particularly preferably be those not containing in the molecule any unsaturated groups that may react with polymerizable monomers. When a polar resin not containing such unsaturated groups is used, cross-linking reaction with the monomers that form the shell resin does not take place. This is preferable because, especially when used as full-color toners, the shell resin does not come to have a too high molecular weight and the color mixing of four color toners does not lower.

In the present invention, the surfaces of the toner particles having the core/shell structure may be further provided with outermost shell resin layers.

Such outermost shell resin layers may preferably have a glass transition temperature so set as to be higher than the glass transition temperature of the shell-forming shell resin in order to more improve blocking resistance, and may also preferably be cross-linked to such an extent that the fixing performance is not damaged. The outermost shell resin layers may preferably be further incorporated with a polar resin or a charge control agent in order to improve charging performance.

There are no particular limitations on how to provide the outermost shell resin layers. For example, the layers may be provided by a method including the following 1) to 3).

1) A method in which, at the latter half or after the completion of polymerization reaction, a monomer composition prepared by dissolving or dispersing the polymerizable monomer, the polar resin, the charge control agent and a cross-linking agent as occasion calls is added in the reaction system, and is adsorbed on polymerization particles, followed by addition of a polymerization initiator to carry out polymerization.

2) A method in which emulsion polymerization particles or soap-free polymerization particles synthesized by polymerizing a polymerizable monomer composition containing the polymerizable monomer, the polar resin, the charge control agent and a cross-linking agent as occasion calls are added in the reaction system and are caused to cohere to the surfaces of polymerization particles, optionally followed by heating to fix them.

3) A method in which emulsion polymerization particles or soap-free polymerization particles synthesized by polymerizing a polymerizable monomer composition containing the polymerizable monomer, the polar resin, the charge control agent and a cross-linking agent as occasion calls are mechanically caused to fix to the surfaces of toner particles by a dry process.

When in the present invention the toner particles are produced by polymerization, the polymerization initiator may include, e.g., azo type polymerization initiators such as 2,21-azobis-(2,4-dimethylvaleronitrile),
2,2'-azobisisobutyronitrile,
1,11-azobis-(cyclohexane-l-carbonitrile),
2,21-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be added in an amount of from 0.5 to 20% by weight based on the weight of the polymerizable monomers, which varies depending on the degree of polymerization intended in the present invention. The polymerization initiator may a little vary in type depending on the methods for polymerization, and may be used alone or in the form of a mixture, making reference to its 10-hour half-life period temperature.

In order to maintain high-polymer growth reaction for a long time by using the initiator in a smaller quantity so that the initiator acting as a chain transfer agent can be in a smaller quantity, the toner of the present invention may be obtained by, e.g., adding a polymer having a top peak in the region of molecular weight of from 2,000 to 5,000, to a reaction system which has been made sure that a polymer with a molecular weight of from 2,000 to 5,000 is little formed. Such a polymer be added to the monomer composition in an appropriate quantity before the granulation is carried out.

In the present invention, in order to control the degree of polymerization, it is also possible to further add any known cross-linking agent, chain transfer agent and polymerization inhibitor.

In the present invention, when the toner particles are produced by suspension polymerization, any of inorganic compounds and organic compounds may be used as a dispersant. The inorganic compounds may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. The organic compounds may include, e.g., polyvinyl alcohol, gelatin, methyl cellulose, methyl hydroxypropyl cellulose, ethyl cellulose, carboxymethyl cellulose sodium salt, and starch. These dispersants are dipersed in an aqueous phase. Any of these dispersants may preferably be used in an amount of from 0.2 to 10.0 parts by weight based on 100 parts by weight of the polymerizable monomer.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation to obtain a fine-particle dispersant preferable for the suspension polymerization. In these dispersants, 0.001 to 0.1 part by weight of a surface active agent may be used in combination. Stated specifically, commercially available nonionic, anionic or cationic surface active agents may be used. For example, those preferably used are sodium dodecyl sulfate, sodium tetradecyl sulfate, sodium pentadecyl sulfate, sodium octyl sulfate, sodium oleate, sodium laurate, potassium stearate and calcium oleate.

When the toner particles are produced by polymerization, they can be produced concretely by the following process. A monomer composition comprising polymerizable monomers and added therein the low-softening substance release agent, the colorant, the charge control agent, the polymerization initiator and other additives, having been uniformly dissolved or dispersed by means of mixing machine such as a homogenizer or an ultrasonic dispersion machine, is dispersed in an aqueous phase containing a dispersion stabilizer, by means of a known agitator, homomixer or homogenizer. Granulation is carried out while controlling agitation speed and agitation time so that droplets formed of the monomer composition can have the desired toner particle size. After the granulation, agitation may be carried out to such an extent that the state of particles is maintained by the acton of the dispersion stabilizer and the particles can be prevented from settling. The polymerization may be carried out at a polymerization temperature set at 40° C. or above, preferably from 50° to 90° C. At the latter half of the polymerization, the temperature may be raised, and also the aqueous medium may be removed in part from the reaction system at the latter half of the reaction or after the reaction has been completed, in order to remove unreacted polymerizable monomers and by-products. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

The toner of the present invention may be used in the form of either of a one-component developer and a two-component developer. In the case of the two-component developer, the toner is blended with development magnetic particles (hereinafter also "carrier particles"), called a carrier.

The carrier may have a weight-average particle diameter of from 15 to 60 $\mu$m, and preferably from 20 to 45 $\mu$m, and may have carrier particles smaller than 22 $\mu$m in an amount not more than 20%, preferably from 0.05 to 15%, and more preferably from 0.1 to 12%, and carrier particles smaller than 16 $\mu$m in an amount not more than 3%, preferably not more than 2%, and more preferably not more than 1%.

Coarse powder of carrier particles larger than 62 $\mu$m, which closely correlates with the sharpness of images, needs to be in an amount of 0.2 to 10%.

If the carrier has a weight-average particle diameter smaller than 15 $\mu$m, the carrier may have so low a fluidity as not to be well blended with the toner, to tend to cause fog. If it has a weight-average particle diameter larger than 60 $\mu$m, the carrier may have a low ability to hold the toner, to tend to cause toner scatter. A carrier having more fine powder tends to cause carrier adhesion, and a carrier having more coarse powder tends to cause a decrease in image density.

The carrier particles used in the present invention may include, e.g., particles of magnetic metals such as surface-oxidized or unoxidized iron, nickel, copper, zinc, cobalt, manganese, chromium and rare earth elements, and alloys or oxides thereof; ferrite; and resin carriers with magnetic powder dispersed therein.

In order to make carrier particle surfaces smooth and more improve sphericity, it is preferable to use (i) a ferrite carrier represented by the following Formula (I) or (ii) a magnetite-containing polymerization resin carrier produced by suspension polymerization. In order to make the carrier particles have a high resistance and not to disorder latent-image electric potential, the magnetite-containing polymerization resin carrier is particularly preferred. Formula (I)

$$(Fe_2O_3)_x(A)_y(B)_z$$

wherein A represents MgO, $Ag_2O$ or a mixture thereof; B represents $Li_2O$, MnO, CaO, SrO, $Al_2O_3$, $SiO_2$ or a mixture of any of these; and x, y and z each represent a weight ratio and fulfill the following conditions:

$0.2 \leqq x \leqq 0.95$;

$0.005 \leqq y \leqq 0.3$;

$0 < z \leqq 0.795$; and $x+y+z \leqq 1$.

The polymerization resin carrier may preferably contain $Fe_3O_4$ magnetite and besides $Fe_2O_3$, $Al_2O_3$, $SiO_2$, CaO, SrO, MgO, MnO or a mixture of any of these. The quantity of $Fe_3O_4$ may preferably be from 0.2 to 0.8 based on the weight of the all oxides.

If x is less than 0.2 in the ferrite carrier of Formula (I) and the quantity of $Fe_3O_4$ is less than 0.2 in the polymerization resin carrier, the carrier may have low magnetic properties to tend to cause scatter of carrier or scratches on the photosensitive drum surface. If x is more than 0.95 or the quantity of $Fe_3O_4$ is more than 0.8, the carrier tends to have so low a resistance that the carrier particle surfaces must be coated with resin in a large quantity, to tend to cause coalescence of carrier particles undesirably.

In the ferrite carrier, if y is less than 0.005, proper magnetic properties can be attained with difficulty, and, if y is more than 0.3, the carrier particle surfaces can not be made homogeneous and spherical in some cases, resulting in a great change in bulk density and a poor inductance detection and precision. Also, if z is 0, i.e., the component B is not contained, particles with a sharp particle size distribution can be obtained with difficulty, and ultrafine powder of carrier may seriously cause scratches on the photosensitive drum surface, or seriously cause coalescence of particles at the time of firing to make it difficult to produce carriers. If z is more than 0.795, the magnetic properties may lower to seriously cause scatter of carrier.

As to the B in the formula (I), among $LiO_2$, MnO, CaO, SrO, $Al_2O_3$ and $SiO_2$, MnO, CaO, $SiO_2$ and $Al_2O_3$ are preferred in view of a small change in resistance also at the time of high-voltage application, and MnO and CaO are more preferred in view of a better adaptability to the toner supplied.

As for the polymerization resin carrier, its particle shape can be readily made spherical and a sharp particle size distribution can be achieved on account of its production process, and hence is more advantageous against the adhesion of carrier to the photosensitive drum than the ferrite carrier even when made to have a smaller particle diameter. Also, the former is more preferred to the latter because of a small change in bulk density.

The carrier preferably used in the present invention is a magnetic powder disperse type resin carrier comprised of a magnetic powder such as iron powder, ferrite powder or iron oxide powder has been dispersed in a resin. It may more preferably be the magnetite-containing polymerization resin carrier produced by polymerization in view of its less change in the degree of compaction, and may particularly preferably be a polymerization resin carrier containing a non-magnetic metal oxide and magnetite.

The non-magnetic metal oxide may preferably be $Fe_2O_3$, $Al_2O_3$, $SiO_2$, CaO, SrO, MnO or a mixture of any of these. The quantity of the magnetite may preferably be from 20 to 80% by weight based on the weight of the all oxides.

The above magnetite may optionally be treated to make lipophilic. When treated, in order to improve its hydrophobicity, it may previously be surface-treated with silica, alumina or titania, followed by lipophilic treatment.

Similarly, the non-magnetic metal oxide may also preferably be treated to make lipophilic.

The resin in which the magnetic powder is to be dispersed may include styrene-acrylate or -methacrylate copolymers, polyester resins, epoxy resins, styrene-butadiene copolymer, amide resins and melamine resins.

In particular, it may preferably contain a phenol resin. When it contains the phenol resin, it can have superior heat resistance and solvent resistance and the particles can be well coated when their surfaces are coated with resin.

The carrier used in the present invention may preferably be the carrier produced by polymerization, also in order to achieve a uniform developer transport performance.

The carrier particles may preferably be those in which fine magnetic material particles are bound with a cured phenolic resin matrix. Such carrier particles may be produced by a process as described below.

A phenol and an aldehyde are allowed to react in an aqueous medium in the presence of a basic catalyst together with a magnetic powder and a suspension stabilizer.

The phenol used here may include phenol, and compounds having a phenolic hydroxyl group, e.g., alkyl phenols such as m-cresol, p-tert-butylphenol, o-propylphenol, resorcinol and bisphenol-A, and halogenated phenols part or the whole of the benzene ring or alkyl group of which has been substituted with a chlorine or bromine atom or atoms. In particular, phenol is most preferred. When the compounds other than the phenol are used as phenols, the particles may be formed with difficulty, or may be amorphous even if the particles are formed. Thus, the phenol is most preferred taking account of particle shape.

The aldehyde used may include formaldehyde which is in the form of either formalin or paraformaldehyde, and furfural. Formaldehyde is particularly preferable. The aldehyde may preferably be in a molar ratio to the phenol, of from 1 to 2, and particularly preferably from 1.1 to 1.6.

As the basic catalyst used, basic catalysts used in the manufacture of conventional resol resins may be used. For example, it may include ammonia water and alkylamines such as hexamethylenetetramine, dimethylamine, diethyltriamine and polyethyleneimine. Any of these basic catalysts may preferably be in a molar ratio to the phenol, of from 0.02 to 0.3.

The magnetic powder made present together when the phenol and the aldehyde are allowed to react in the presence of the basic catalyst may include the magnetic powder previously described. It may preferably be used in an amount from 0.5 to 200 times the weight of the phenol. Also, it may more preferably be used in an amount from 4 to 100 times the same, taking account of the value of saturation magnetization and the strength of particles.

The magnetic powder may preferably have particle diameter of from 0.01 to 10 $\mu$m, and more preferably from 0.05 to 5 $\mu$m taking account of the dispersion of fine particles in the aqueous medium and the strength of carrier particles to be formed.

The suspension stabilizer may include hydrophilic organic compounds such as carboxymethyl cellulose and polyvinyl alcohol, fluorine compounds such as calcium fluoride and substantially water-insoluble inorganic salts such as calcium sulfate.

When the suspension stabilizer is used, it may preferably be added in an amount of from 0.2 to 10% by weight, and more preferably from 0.5 to 3.5% by weight, based on the weight of the phenol.

The reaction in this production process is carried out in an aqueous medium. Here, water may preferably be added in such an amount that, e.g., the solid content of the carrier comes to be in a concentration of from 30 to 95% by weight, and more preferably from 60 to 90% by weight.

The reaction may be carried out while gradually raising temperature at a rate of temperature rise of from 0.5 to 1.5° C./min, and preferably from 0.8 to 1.2° C./min, with stirring, at a reaction temperature of from 70 to 90° C., and preferably from 83 to 87° C., for a time of from 60 to 150 minutes, and preferably from 80 to 110 minutes. In such reaction, curing reaction proceeds simultaneously with the reaction, so that the cured phenol resin matrix is formed.

After the reaction and curing are thus completed, the reaction product obtained is cooled to 40° C. or below, so that an aqueous dispersion of spherical particles is obtained which are formed of magnetic powder particles uniformly dispersed in the cured phenol resin matrix.

Next, this aqueous dispersion is solid-liquid separated according to a conventional method such as filtration or centrifugation, followed by washing and then drying. Thus, carrier particles in which the magnetic powder is dispersed in the phenol resin matrix are obtained.

The above process may be carried out by either of a continuous process and a batch process. In usual instances, the batch process may be employed.

For the purpose of charge control, resistance control and so forth, it is preferable to coat the surfaces of the carrier particles with a coating material. The coating material to be coated on the carrier particle surfaces may differ depending on the materials for toners. It may include, e.g., aminoacrylate or -methacrylate resins, acrylic or methacrylic resins, copolymers of any of these resins with styrene resins, copolymers of acrylic or methacrylic resins with fluorine resins, silicone resins, polyester resins, fluorine resins, polytetrafluoroethylene, monochlorotrifluoroethylene polymers and polyvinylidene fluoride. In particular, silicone resins, fluorine resins and copolymers or mixtures of acrylic or methacrylic resins with fluorine resins are preferred because a high charging performance can be maintained over a long period of time. The coating weight of any of these coating materials may appropriately be determined so as to satisfy charge-providing performance of the carrier, and may usually be in the range of from 0.1 to 30% by weight, and preferably from 0.3 to 20% by weight, in total based on the weight of the carrier particles.

As methods for forming resin coat layers on the magnetic carrier core particle surfaces, any of the following may be used: A method in which a resin composition is dissolved in a suitable solvent and magnetic carrier core particles are immersed in the resultant solution, followed by desolvation, drying and high-temperature baking; a method in which magnetic carrier core particle are suspended in a fluidized system and a solution prepared by dissolving the above resin composition is spray-coated, followed by drying and high-temperature baking; and a method in which magnetic carrier core particle are mixed with a powder or aqueous emulsion of the resin composition.

A method preferably used in the present invention is a method making use of a mixed solvent prepared by incorporating 0.1 to 5 parts by weight, and preferably 0.3 to 3 parts by weight, of water in 100 parts by weight of a solvent containing at least 5% by weight, and preferably at least 20% by weight, of a polar solvent such as a ketone or an alcohol. This method is preferred because reactive silicone resin can be firmly made to adhere to the magnetic carrier core particles. If the water is less than 0.1 part by weight, the hydrolysis reaction of the reactive silicone resin can not be well take place to make it difficult to achieve thin-layer and uniform coating on the magnetic carrier core particles. If it is more than 5 parts by weight, the reaction can be controlled with difficulty to conversely result in a low coat strength.

In the present invention, when the carrier is blended with the toner to prepare the two-component developer, good results can usually be obtained when they are blended in such a proportion that the toner in the two component type developer is in a concentration of from 1 to 15% by weight, preferably from 3 to 12% by weight, and more preferably from 5 to 10% by weight. If the toner concentration is less than 1% by weight, the image density tends to lower. If the toner concentration is more than 15% by weight, fog and in-machine scatter may often occur to shorten the running lifetime of the two-component developer.

The image forming method of the present invention will be described below.

The image forming method of the present invention comprises (I) a charging step of electrostatically charging a latent image bearing member on which an electrostatic latent image is to be held, (II) a latent image forming step of forming the electrostatic latent image on the latent image bearing member thus charged, (III) a developing step of developing the electrostatic latent image on the latent image bearing member by the use of a toner to form a toner image and (IV) a transfer step of transferring to a transfer medium the toner image formed on the latent image bearing member. As this toner, the toner described above is used.

In the charging step, either of a non-contact charging member such as a corona charging assembly and a contact charging member such as a blade, a roller or a brush may be used as a charging member; the former being a member that charges the latent image bearing member in non-contact with its surface, and the latter being a member that charges the latent image bearing member in contact with its surface. The contact charging member may preferably be used because ozone can be made less occur at the time of charging.

Among contact charging members, a conductive brush such as a fiber brush or a magnetic brush is preferred because it can have so many points of contact with the surface of the latent image bearing member as to enable uniform charging, compared with the member such as a blade and a roller whose smooth surface is brought into contact with the surface of the latent image bearing member.

What is preferably used as a fiber aggregate that forms the fiber brush may include an aggregate comprised of extra-fine fiber-generation conjugate fibers; an aggregate comprised of fibers chemically treated with an acid, alkali or organic solvent; a raised fiber-entangled material; and an electrostatic flock material.

The charging mechanism that is fundamental in the charging with the brush is considered that a conductive charging layer of the charging member comes into contact with a charge injection layer at the photosensitive drum surface to cause injection of charges from the conductive charging layer into the charge injection layer. Accordingly, the performance required for the contact charging member is to provide the surface of the charge injection layer with a sufficient density and a proper resistance pertaining to the transfer of charges.

Accordingly, the effect of making the contact with the charge injection layer more frequent can be obtained and uniform and sufficient charging can be carried out by a method in which the extra-fine fiber-generation conjugate fibers are used to make fiber density higher, a method in which the number of fibers is made larger by treating fibers by chemical etching, or a method in which a flexible fiber end is provided for the surface by using a member prepared by raising a fiber-entangled material or using the electrostatic flock material. Namely, the brush so constituted as to have a higher fiber density, to have contact points in a larger number and to make the fiber end come into contact with the charge injection layer may preferably be used in the present invention.

The aggregate comprised of extra-fine fiber-generation conjugate fibers may preferably be those in which extra-fine fibers have been generated by a physical or chemical means. The raised fiber-entangled material may preferably be those in which the fiber-entangled material is formed of extra-fine fiber-generation conjugate fibers. The extra-fine fiber-generation conjugate fibers may more preferably be generated by a physical or chemical means and be raised.

The electrostatic flock material may preferably be those in which its constituent fibers have been chemically treated with an acid, alkali or organic solvent. As another preferable form of the electrostatic flock material, it may have a form in which its constituent fibers are extra-fine fiber-generation conjugate fibers whose extra-fine fibers have been generated by a physical or chemical means.

The magnetic brush may be constituted of a magnet roll as a magnetic particle holding member, or a conductive sleeve internally provided with a magnet roll, to the surface of which magnetic particles are magnetically bound.

The magnetic particles may preferably have an average particle diameter of from 5 to 100 $\mu$m. Those having an average particle diameter smaller than 5 $\mu$m tend to cause adhesion of the magnetic brush to the photosensitive drum. Those having an average particle diameter larger than 100 $\mu$m can not make ears of the magnetic brush rise densely on the sleeve to tend to make poor the performance of charge injection into the charge injection layer. The magnetic particles may more preferably have an average particle diameter of from 10 to 80 $\mu$m. When those having particle diameters within this range are used, the transfer residual toner on the photosensitive drum can be more efficiently scraped off, can be more efficiently electrostatically incorporated into the magnetic brush and can be temporarily held in the magnetic brush in order to more surely control the charging of the toner. The magnetic particles may still more preferably have an average particle diameter of from 10 to 50 $\mu$m.

The average particle diameter of the magnetic particles may be measured using a laser diffraction particle size distribution measuring device HEROS (trade name; manufactured by Nippon Denshi K. K.), where particles of from 0.05 $\mu$m to 200 $\mu$m may be 32-logarithmically divided to measure diameter, and their 50% average particle diameter may be used as the average particle diameter.

Use of the magnetic particles having such particle diameters for the contact charging member brings about a greatly large number of points of contact with the photosensitive drum, and is advantageous for imparting a more uniform charged electric potential to the photosensitive drum. Moreover, magnetic particles directly coming into contact with the photosensitive drum are replaced one after another as the magnetic brush is rotated, thus there is an additional advantage that any lowering of charge injection performance that may be caused by contamination of magnetic particle surfaces can be greatly lessened.

The magnetic particles may preferably have a volume resistivity of $1\times10^4$ to $1\times10^9$ Ωcm, and more preferably of $1\times10^7$ to $1\times10^9$ Ωcm. When the volume resistivity is less than $1\times10^4$ Ωcm, the magnetic particles may tend to attach to the latent image bearing member. When the volume resistivity is more than $1\times10^9$ Ωcm, the magnetic particles may tend to have a lowered ability of imparting triboelectric charges to the latent image bearing member, particularly in a low humidity, causing a poor charging.

The holding member that holds the magnetic particles and the photosensitive drum may preferably be set to leave a gap between them in the range of from 0.2 to 2 mm, more preferably from 0.3 to 2.0 mm, still more preferably from 0.3 to 1.0 mm, and most preferably from 0.3 to 0.7 mm. If they are set at a gap smaller than 0.2 mm, the magnetic particles can not pass the gaps with ease, so that the magnetic particles may not be smoothly transported over the holding member to tend to cause faulty charging, or the magnetic particles may excessively stagnate at the nip to tend to cause their adhesion to the photosensitive drum, and also some applied voltage may cause a leak between the conductive part of the holding member and the photosensitive drum to damage the photosensitive drum. A gap larger than 2 mm is not preferable because it makes it difficult to form wide nips between the photosensitive drum and the magnetic particles.

The transfer residual toner electrostatically taken into the magnetic brush is sent forth to the photosensitive drum surface at a given timing as a result of applying an AC voltage. The transfer residual toner sent forth and held on the photosensitive drum surface moves in the direction of the rotation of the photosensitive drum as it is, to come to face the developing sleeve (developer carrying member), at the point of which it is scraped off by the developing sleeve, which rotates in the counter direction and to which a bias electric field is applied, is collected into the developing assembly, and is again used as the toner for development.

In that instance, the external additive particles held on the toner particles so behave as to come apart from the toner particles in the contact charging member and remain there after the toner has been sent forth. As a result of extensive studies made by the present inventors, they have discovered that the external additive particles present in the magnetic brush come into contact and friction with the photosensitive drum surface at the time of charging after the transfer residual toner taken into the contact charging member is sent forth and this is greatly effective for removing deposits such as ozone products and paper dust and any other deposition products. They have also discovered an advantage that, when the magnetic brush comes into contact and friction with the photosensitive drum surface, the external additive particles play a role of a spacer and this makes the photosensitive drum surface less scratched and the lifetime of the photosensitive drum longer.

The magnetic brush for charging may move in either direction which is regular or reverse with respect to the movement direction of the photosensitive drum surface at their contact portion. From the viewpoint of the transfer residual toner to be well taken into it, the magnetic brush may preferably move in the reverse direction.

The charging magnetic particles may preferably be held on the charging magnetic particle holding member of the magnetic brush in an amount of from 50 to 500 mg/cm$^2$, and more preferably from 100 to 300 mg/cm$^2$, where a stable charging performance can be attained.

As charging bias applied to the contact charging member, only a DC component may be applied, but an AC component may also be a little applied to expect an improvement in image quality. As the AC component, which may vary depending on the process speed, it may preferably have a frequency of from about 100 Hz to 10 kHz, and the applied AC component may preferably have a peak-to-peak voltage of about 1,000 V or below. If it is higher than 1,000 V, since the photosensitive drum electric potential is obtained with respect to the applied voltage, the latent image surface may wave according to electric potential to cause fog or density decrease in some cases. In the method that utilizes discharging, the AC component, which may vary depending on the process speed, may preferably have a frequency of from about 100 Hz to 10 kHz, and the applied AC component may preferably have a peak-to-peak voltage of about 1,000 V or above, which may preferably be at least twice the discharge starting voltage. This is so set in order to obtain a sufficient leveling effect on the magnetic brush and photosensitive drum surface. As the waveform of the AC component, sine waves, rectangular waves and sawtooth waves may be used.

Excess charging magnetic particles may be held and circulated in the charging assembly.

As the magnetic particles, in order to cause ears to rise by magnetism and to bring the resulting magnetic brush into contact with the photosensitive member to effect charging, materials therefor may include alloy or compounds containing elements exhibiting ferromagnetism, as exemplified by iron, cobalt and nickel, and ferrites whose resistivity has been adjusted by oxidation or reduction, as exemplified by a ferrite compositionally adjusted and a Zn-Cu ferrite, Mn-Mg ferrite and Li-Mg ferrite treated by hydrogen reduction. In order to set the resistivity of the ferrite within the above range below the applied electric field as previously described, the resistivity can be achieved also by adjusting the composition of metals. An increase in metals other than divalent iron commonly results in a decrease in resistivity, and tends to cause an abrupt decrease in resistivity.

The triboelectricity of the magnetic particles used in the present invention is preferably have a polarity of the same polarity as the charge polarity of the photosensitive drum. As previously stated, the decrease of the electric potential of the photosensitive drum due to the triboelectricity will promote the migration of the magnetic particles to the photosensitive drum, which makes the conditions for holding the magnetic particles on the contact charging member severer. The polarity of triboelectricity of the magnetic particles can be controlled with ease by coating the surfaces of the magnetic particles to provide surface layers.

The magnetic particles having surface layers, used in the present invention, are particles of which surfaces are coated with a coat material such as a deposited film, conductive resin film or conductive pigment-dispersed resin film, or particles surface-treated with a reactive compound. Each magnetic particle is not necessarily completely covered up with a surface layer, the magnetic particle may be partly exposed so long as the effect of the present invention can be obtained. Namely, the surface layer may be formed discontinuously.

From the viewpoint of productivity and cost, the magnetic particles may preferably be coated with a conductive pigment-dispersed resin film.

From the viewpoint of controlling electric-field dependence of resistivity, the magnetic particles may also preferably be coated with a resin film composed of a high-resistivity binder resin and an electron-conducting conductive pigment dispersed therein.

As a matter of course, the magnetic particles having been thus coated must have a resistivity within the range previously described. Also, from the viewpoint of widening the tolerance range for the abrupt decrease in resistivity on the side of the high electric field and for leak images that may occur depending on the size and depth of scratches on the photosensitive drum, the parent magnetic particles may preferably have a resistivity within the above range.

As a binder resin used to coat the magnetic particles, it may include homopolymers or copolymers of styrenes such as styrene and chlorostyrene; monoolefins such as ethylene, propylene, butylene and isobutylene; vinyl esters such as vinyl acetate, vinyl propionate, vinyl benzoate and vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; and vinyl ketones such as methyl vinyl ketone, hexyl vinyl ketone and isopropenyl vinyl ketone. As a particularly typical binder resin, there are polystyrene, styrene-alkyl acrylate copolymers, a styrene-acrylonitrile copolymer, a styrene-butadiene copolymer, a styrene-maleic anhydride copolymer, polyethylene and polypropylene, in view of dispersibility of conductive fine particles, film forming properties as coat layers and productivity. It may further include polycarbonate, phenol resins, polyesters, polyurethanes, epoxy resins, polyolefins, fluorine resins, silicone resins and polyamides. Especially from the viewpoint of the prevention of toner contamination, it is more preferable to contain a resin having a small critical surface tension, as exemplified by polyolefin resins, fluorine resins and silicone resins.

In addition, from the viewpoint of keeping a wide tolerance for the abrupt decrease in resistivity on the side of the high electric field and preventing the leak images caused by scratches on the photosensitive drum, the resin coated on the magnetic particles may preferably be a fluorine resin or a silicone resin having a high-voltage resistance.

The fluorine resin may include, e.g., solvent-soluble copolymers obtained by copolymerizing vinyl fluoride, vinylidene fluoride, trifluoroethylene, chlorotrifluoroethylene, dichlorodifluoroethylene, tetrafluoroethylene or hexafluoropropylene with other monomers.

The silicone resin may include, e.g., KR 271, KR 282, KR 311, KR 255, KR 255 and KR 155 (straight silicone varnish), KR 211, KR 212, KR 216, KR 213, KR 217 and KR 9218 (modifying silicone varnish), SA-4, KR 206 and KR 5206 (silicone alkyd varnish), ES 1001, ES 1001N, ES 1002T and ES 1004 (silicone epoxy varnish), KR 9706 (silicone acrylic varnish), and KR 5203 and KR 5221 (silicone polyester varnish), all available from Shin-Etsu Silicone Co., Ltd.; and SR 2100, SR 2101, SR 2107, SR 2110, SR 2108, SR 2109, SR 2400, SR 2410, SR 2411, SH 805, SH 806A and SH 840, available from Toray Silicone Co., Ltd.

When the magnetic particles are surface-treated with a reactive compound, a coupling reaction product is preferred, but the compound is not necessarily limited to it.

An example of preferred embodiments of the latent image bearing member (photosensitive drum) used in the present invention will be described below.

It basically comprises a conductive substrate, and a photosensitive layer functionally separated into a charge generation layer and a charge transport layer.

As the conductive substrate, a cylindrical member or a belt may be used, made of a metal such as aluminum or stainless steel, an alloy such as an aluminum alloy or an indium oxide-tin oxide alloy, a plastic having a coat layer formed of any of these metals and alloys, a paper or plastic impregnated with conductive particles or a plastic containing a conductive polymer.

On the conductive substrate, a subbing layer may be provided for the purposes of improving adhesion of the photosensitive layer, improving coating properties, protecting the substrate, covering defects on the substrate, improving performance of charge injection from the substrate and protecting the photosensitive layer from electrical breakdown. Materials used to form the subbing layer may include polyvinyl alcohol, poly-N-vinyl imidazole, polyethylene oxide, ethyl cellulose, methyl cellulose, nitrocellulose, an ethylene-acrylic acid copolymer, polyvinyl butyral, phenol resin, casein, polyamide, copolymer nylon, glue, gelatin, polyurethane or aluminum oxide. The subbing layer may usually be in a thickness approximately of from 0.1 to 10 $\mu$m, and preferably from 0.1 to 3 $\mu$m.

The charge generation layer is formed by coating with a fluid prepared by dispersing a charge-generating material in a suitable binder, or by vacuum deposition of the charge-generating material. The charge-generating material includes azo pigments, phthalocyanine pigments, indigo pigments, perylene pigments, polycyclic quinone pigments, squarilium dyes, pyrylium salts, thiopyrylium salts, triphenylmethane dyes, and inorganic substances such as selenium and amorphous silicon. The binder resin can be selected from a vast range of binder resins, including, e.g., polycarbonate resins, polyester resins, polyvinyl butyral resins, polystyrene resins, acrylic resins, methacrylic resins, phenol resins, silicone resins, epoxy resins and vinyl acetate resins. The binder resin contained in the charge generation layer may be in an amount not more than 80% by weight, and preferably from 0 to 40% by weight. The charge generation layer may preferably have a thickness of 5 $\mu$m or smaller, and particularly from 0.05 to 2 $\mu$m.

The charge transport layer has the function to receive charge carriers from the charge generation layer in the presence of an electric field, and transport them. The charge transport layer is formed by applying a solution prepared by dissolving a charge-transporting material in a solvent optionally together with a binder resin, and usually may preferably have a layer thickness of from 5 to 40 $\mu$m. The charge-transporting material may include polycyclic aromatic compounds having in the main chain or side chain a structure such as biphenylene, anthracene, pyrene or phenanthrene; nitrogen-containing cyclic compounds such as indole, carbazole, oxadiazole and pyrazoline; hydrazone compounds; styryl compounds; and inorganic compounds such as selenium, selenium-tellurium, amorphous silicone and cadmium sulfide.

The binder resin used to disperse such a charge-transporting material therein may include insulating resins such as polycarbonate resins, polyester resins, polymethacrylates, polystyrene resins, acrylic resins and polyamide resins, and organic photoconductive polymers such as poly-N-vinyl carbazole and polyvinyl anthracene.

The photosensitive drum (latent image bearing member) used in the present invention may preferably have a charge injection layer as a layer most distant from the support, i,e, as a surface layer. This charge injection layer may have a volume resistivity of from $1\times10^{8}$ Ω.cm to $1\times10^{15}$ Ω.cm in order to obtain a satisfactory charging performance and less smeared images. Especially in view of the smeared images, it may preferably be from $1\times10^{10}$ Ω.cm to $1\times10^{15}$ Ω.cm. Further taking account of environmental variations and so forth, it may preferably be from $1\times10^{10}$ Ω.cm to $1\times10^{13}$ Ω.cm. If it is lower than $1\times10^{8}$ Ω.cm, the charges produced can not be retained on the surface in an environment of high humidity to tend to cause smeared images. If it is higher than $1\times10^{15}$ Ω.cm, the charge injection from the charging member is not sufficient and the charges can not be well retained to tend to cause faulty charging. Such a functional layer provided on the photosensitive drum surface has the function to retain the charges injected from the charging member at light exposure, and also has the function to let charges off to the photosensitive drum support to make the residual potential lower.

The constitution of the present invention using the above charging member and the above photosensitive drum enables small charge starting voltage Vth and the charge potential of the photosensitive drum of almost 90% or more of the voltage applied to the charging member.

For example, when a DC voltage of 100 to 2,000 V as an absolute value is applied to the charging member at a process speed of 1,000 mm/minute or below, the charge potential of the electrophotographic photosensitive drum having the charge injection layer of the present invention can be controlled to be 80% or more or further 90% or more of the applied voltage. On the other hand, the photosensitive drum charge potential attained by conventional discharging is about 200 V when a DC voltage of 700 V is applied, which is only about 30% of the applied voltage.

This charge injection layer is an inorganic layer made of a metal-deposited film, or a conductive fine particle-dispersed resin layer formed by dispersing conductive fine particles in a charge injection layer binder resin. The deposited film can be formed by vacuum deposition, and the conductive fine particle-dispersed resin layer can be formed by coating using a suitable coating process such as dip coating, spray coating, roll coating or beam coating. This layer may also be formed by mixing or copolymerizing an insulating binder resin with a resin having light-transmission properties and a high ion conductivity, or may be formed solely from a resin having a medium resistance and a photoconductivity.

In the case of the conductive fine particle-dispersed resin layer, the conductive fine particles may preferably be added in an amount of from 2 to 250% by weight, and more preferably from 2 to 190% by weight, based on the weight of the charge injection layer binder resin. If the conductive fine particles are added in an amount less than 2% by weight, the desired volume resistivity can be attained with difficulty. If they are added in an amount more than 250% by weight, the layer has a low film strength and the charge injection layer tends to be scraped off, resulting in a short lifetime of the photosensitive drum, and also they may have a low resistivity to tend to cause faulty images due to the latent-image electric potential flow.

The binder resin of the charge injection layer may include polyester, polycarbonate, acrylic resins, epoxy resins and phenol resins, as well as a curing agent for these resins, any of which may be used alone or in combination of two or more. When the conductive fine particles are dispersed in a large quantity, it is preferable to disperse the conductive fine particles in a reactive monomer or a reactive oligomer, and apply the resultant dispersion on the photosensitive drum surface, followed by curing with light or heat. When the photosensitive layer 92 is formed of amorphous silicon, the charge injection layer may preferably be formed of SiC.

As examples of the conductive fine particles dispersed in the charge injection layer binder resin of the charge injection layer 93, there are fine particles of metals or metal oxides. Preferably, they are ultrafine particles of a metal oxide such as zinc oxide, titanium oxide, tin oxide, antimony oxide, indium oxide, bismuth oxide, tin oxide-coated titanium oxide, tin-coated indium oxide, antimony-coated tin oxide and zirconium oxide. Any of these may be used alone or may be used in combination of two or more.

In general, when particles are dispersed in the charge injection layer, it is necessary for the particles to have a diameter smaller than the wavelength of incident light in order to prevent the incident light from being scattered by dispersed particles. As the conductive fine particles dispersed in the surface layer (charge injection layer) in the present invention, the particles may preferably have particle diameters of 0.5 $\mu$m or smaller.

In the present invention, the charge injection layer may preferably contain lubricant particles. The reason therefor is that the friction between the photosensitive drum and the charging member can be lessened at the time of charging and hence the charging nip can be expanded to bring about an improvement in charging performance. In particular, as the lubricant particles, it is preferable to use fluorine resins, silicone resins or polyolefin resins of a low critical surface tension. More preferably, tetrafluoroethylene resin (PTFE) may be used. In this instance, the lubricant particles may be added in an amount of from 2 to 50% by weight, and preferably from 5 to 40% by weight, based on the weight of the binder resin. If they are less than 2% by weight, the lubricant particles are not in a sufficient quantity and hence the charging performance can not be sufficiently improved, and, if they are more than 50% by weight, the resolution of images and the sensitivity of the photosensitive drum may greatly lower.

The charge injection layer in the present invention may preferably have a layer thickness of from 0.1 to 10 $\mu$m, and particularly preferably from 1 to 7 $\mu$m. If it has a layer thickness smaller than 0.1 $\mu$m, the layer may lose its durability to fine scratches, and consequently faulty images due to faulty injection tend to occur. If it has a layer thickness larger than 10 $\mu$m, the injected charges may diffuse to tend to cause disorder of images.

In the present invention, fluorine-containing fine resin particles may be used in the latent image bearing member. The fluorine-containing fine resin particles are comprised of one or more materials selected from polytetrafluoroethylene, polychlorotrifluoroethylene, polyvinylidene fluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer and a tetrafluoroethylene-hexafluoropropylene-perfluoroalkyl vinyl ether copolymer. Commercially available fluorine-containing fine resin particles may be used as they are. Those having a molecular weight of from 3,000 to 5,000,000 may be used, and these may have a particle diameter of from 0.01 to 10 $\mu$m, and preferably from 0.05 to 2.0 $\mu$m.

In many instances, the above fluorine-containing fine resin particles, charge-generating material and charge-transporting material are respectively dispersed and incorporated into a binder resin having film forming properties to separately form the protective layer and the photosensitive layer. Such a binder resin may include polyester, polyurethane, polyacrylate, polyethylene, polystyrene, polyacrylate, polyethylene, polystyrene, polycarbonates, polyamides, polypropylene, polyimides, phenol resins, acrylic resins, silicone resins, epoxy resins, urea resins, allyl resins, alkyd resins, polyamide-imide, nylons, polysulfone, polyallyl ethers, polyacetals and butyral resins.

The conductive support of the latent image bearing member may be made of a metal such as iron, copper, gold, silver, aluminum, zinc, titanium, lead, nickel, tin, antimony or indium or an alloy thereof, an oxide of any of these metals, carbon, or a conductive polymer. It may have the shape of a drum such as a cylinder or a column, a belt, or a sheet. The above conductive materials may be molded as they are, may be used in the form of coating materials, may be vacuum-deposited, or may be processed by etching or plasma treatment.

In the present invention, the contact charging member having a medium resistance is used to inject electric charges into the surface portion of the photosensitive drum having a medium-resistance surface resistance. Preferably, the charges are not injected into trap levels possessed by the photosensitive member surface material, but the charges are supplied to the conductive fine particles of the charge injection layer formed of a light-transmitting insulating binder having conductive fine particles dispersed therein.

Stated specifically, the present invention is based on the theory that, charges are supplied from the contact charging member to minute capacitors each using the charge transport layer as the dielectric and the metal substrate and a conductive fine particle in the charge injection layer as both electrodes. In this instance, the conductive fine particles are electrically independent from one another and form a kind of minute float electrodes. Hence, in a macroscopic view, the photosensitive member surface appears as if it is charged to a uniform electric potential, but actually is in such a condition that minute and numberless charged conductive fine particles cover the photosensitive member surface. Therefore, electrostatic latent images can be retained even when imagewise exposure is carried out using a laser, because the individual conductive fine particles are electrically independent from one another.

Thus, the conductive fine particles used instead of the trap levels which are present at the surfaces of conventional photosensitive members even in a small quantity can improve the charge injection performance and charge retentivity.

Herein, the volume resistivity of the charge injection layer is measured in the following way: A charge injection layer is formed on a polyethylene terephthalate (PET) film on the surface of which a conductive film has been vacuum-deposited. Its resistivity is measured using a volume resistivity measuring apparatus (4140B pAMATER, manufactured by Hullet Packard Co.) in an environment of 23° C./65%RH under application of a voltage of 100 V.

In the latent image forming step, as a means for the imagewise exposure, known means such as lasers and LEDs may be used.

In the developing step, as a means for developing the electrostatic latent image, one-component development or two-component development may be employed; the former being a method in which the one-component developer comprised only of the toner is used and the latter being a method in which the two-component developer comprised of the toner and the carrier is used.

When a magnetic toner containing a magnetic material is used as the one-component developer, a method is available in which the magnetic toner is transported and charged by utilizing a magnet built in the developing sleeve. When a non-magnetic toner containing no magnetic material is used as the one-component developer, a method is available in which the non-magnetic toner is forcedly triboelectrically charged on the developing sleeve by means of a blade and a fur brush to make the toner attracted onto the developing sleeve so as to be transported.

The two-component developing method making use of the two-component developer described above will be described below.

The two-component developing method comprises circulatively transporting the two-component developer composed of the toner and the carrier on the developer carrying member, and developing a latent image held on the latent image bearing member with the toner of the two-component developer carried on the developer carrying member, in a developing zone defined by the latent image bearing member and the developer carrying member provided opposingly thereto.

Magnetic properties of the carrier are affected by a magnet roller built in the developing sleeve, and greatly affect the developing performance and transport performance of the developer.

In the image forming method of the present invention, for example, a magnet roller built in the developing sleeve (developer carrying member) is set stationary and the developing sleeve alone is rotated, where the two-component developer is circulatively transported on the developing sleeve and an electrostatic latent image held on the surface of the latent image bearing member is developed using the two-component developer.

In the image forming method of the present invention, copying can enjoy good image uniformity and good gradation reproduction when (1) the magnet roller is comprised of repulsive poles, (2) the magnetic flux density in the developing zone is 500 to 1,200 gausses and (3) the development carrier has a saturation magnetization of 20 to 50 $Am^2/g$.

In the image forming method of the present invention, the electrostatic latent image may preferably be developed by the toner of the two-component developer under application of a developing bias in the developing zone.

A particularly preferred developing bias will be described below in detail.

Figure 7:
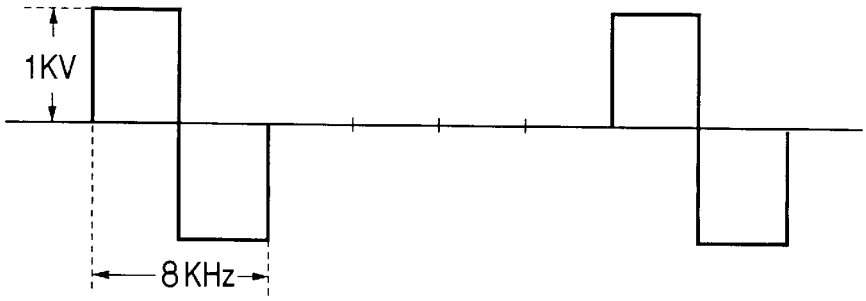
FIG. 7 illustrates an alternating electric field used in Example 1.

In the image forming method of the present invention, in order to form a developing electric field in the developing zone defined between the latent image bearing member and the developer carrying member, it is preferred that a development voltage having a discontinuous AC component as shown in FIG. 7 is applied to the developer carrying member, thereby developing the latent image held on the latent image bearing member, by the use of the toner of the two-component developer carried on the developer carrying member. This development voltage is, specifically, constituted of a first voltage for directing the toner from the latent image bearing member toward the developer carrying member in the developing zone, a second voltage for directing the latent image bearing member and a third voltage intermediate between the first voltage and the second voltage. Thus, the developing electric field is formed between the latent image bearing member and the developer carrying member.

In addition, the time ($T_2$) for which the third voltage intermediate between the first voltage and the second voltage is applied to the developer carrying member, i.e., the time for which the AC component stops, may be made longer than the total time ($T_1$) for which the first voltage for directing the toner from the latent image bearing member toward the developer carrying member and the second voltage for directing the toner from the developer carrying member toward the latent image bearing member are applied to the developer carrying member, i.e., the time for which the AC component operates. This is particularly preferred because the toner can be rearranged on the latent image bearing member so that images can be reproduced faithfully to latent images.

To be concrete, between the latent image bearing member and the developer carrying member in the developing zone, an electric field in which the toner is directed from the latent image bearing member toward the developer carrying member and an electric field in which the toner is directed from the developer carrying member toward the latent image bearing member may be formed at least once, and thereafter an electric field in which the toner is directed from the developer carrying member toward the latent image bearing member in an image area of the latent image bearing member and an electric field in which the toner is directed from the latent image bearing member toward the developer carrying member in a non-image area of the latent image bearing member may be formed for a given time, developing a latent image held on the latent image bearing member, by the use of the toner of the two-component developer carried on the developer carrying member, where the time ($T_2$) for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member may preferably be made longer than the total time ($T_1$) for forming the electric field in which the toner is directed from the latent image bearing member toward the developer carrying member and the electric field in which the toner is directed from the developer carrying member toward the latent image bearing member.

Carrier adhesion may more hardly occur when the latent image is developed in the presence of a developing electric field where alternation is periodically made off in the developing method in which development is carried out while forming the above specific developing electric field, i.e., an alternating electric field. The reason therefor is still unclear, and is presumed as follows:

In conventional continuous sinusoidal or rectangular waves, when an electric field intensity is made higher in an attempt to achieve a higher image density, the toner and the carrier join to reciprocate between the latent image bearing member and the developer carrying member, so that the carrier strongly rubs against the latent image bearing member to cause the carrier adhesion. This more tends to remarkably occur with an increase in the fine powder carrier.

However, when the specific developing electric field as in the present invention is applied, with one pulse, the toner or the carrier goes back and forth between the developer carrying member and the latent image bearing member in an insufficient span. Hence, when a potential difference $V_{cont}$ between the surface potential of the latent image bearing member and the potential of a direct current component of a developing bias is below zero, i.e., $V_{cont}<0$, the $V_{cont}$ acts in such a manner that it causes the carrier to fly from the developer carrying member. However, the carrier adhesion can be prevented by controlling magnetic properties of the carrier and magnetic flux density in the developing zone of the magnet roller. In the case of $V_{cont}>0$, the force of a magnetic field and the $V_{cont}$ act in such a manner that they attract the carrier to the side of the developer carrying member, so that no carrier adhesion occurs.

As previously stated, magnetic properties of carriers are affected by the magnet roller built in the developing sleeve, and greatly affect the developing performance and transport performance of the developer.

In the present invention, on the developing sleeve having the magnet roller built therein, a two-component developer comprised of a carrier comprising magnetic particles and an insulating color toner may be circulated and transported while the magnet roller is set stationary and the developing sleeve alone is rotated, and an electrostatic latent image held on the surface of a latent image bearing member may be developed using the two-component developer. In this instance, color copying can enjoy good image uniformity and gradation reproduction when (1) the magnet roller is comprised of poles having a repulsion pole, (2) the magnetic flux density in the developing zone is set at 500 to 1,200 gauss and (3) the carrier has a saturation magnetization of 20 to 70 $Am^2/g$.

If the carrier has a saturation magnetization of more than 70 $Am^2/g$ (with respect to an applied magnetic field of 3,000 oersteds), brush-like ears formed out of the carrier and toner on the developing sleeve facing to the electrostatic latent image formed on the photosensitive drum (latent image bearing member) at the time of development may rise in a tight state to cause a lowering of gradation or half-tone reproduction. If it has a saturation magnetization of less than 20 $Am^2/g$, it may become difficult for the toner and carrier to be well carried on the developing sleeve, tending to cause the problem of carrier adhesion or toner scatter.

In the transfer step, a corona charging assembly, a transfer roller or a transfer belt may be used as the transfer means. Also, when the transfer residual toner present on the photosensitive drum after the transfer step is transported to the developing part through the photosensitive drum surface so as to be collected and reused, it can be done without changing the photosensitive drum charging bias. In practical use, however, it can be considered that excess toner is mixed into the toner charging assembly when transfer paper jams or when images with a high image-area percentage are continuously copied.

In such an instance, during the operation of the electrophotographic apparatus, it is possible to move the toner from the charging assembly to the developing assembly by utilizing the areas on the photosensitive drum where no images are formed (i.e., non-image areas). Such non-image areas refer to areas standing at the time of forward rotation, at the time of backward rotation and at a zone between transfer sheets. In this instance, it is also preferable to change the charging bias to the one that enables the toner to readily move from the charging assembly to the photosensitive drum. The bias that enables the toner to readily come out of the charging assembly may be applied by a method in which the peak-to-peak voltage of the AC component is made a little smaller or replaced with a DC component, or a method in which the peak-to-peak voltage is set equal and the waveform is changed to make AC effective value lower.

In the transfer step, as the transfer medium, (i) recording paper (a recording medium) may be used so that the toner image formed on the latent image bearing member is directly transferred onto this recording medium, and also (ii) an intermediate transfer member may be used so that the toner image formed on the latent image bearing member is primarily transferred onto the intermediate transfer member and the toner image transferred onto the intermediate transfer member is secondarily transferred to the recording medium.

The toner of the present invention has good release properties and a superior transfer performance, and hence it may preferably be used in the above image forming method in which the toner image formed on the latent image bearing member is transferred to the recording medium through the intermediate transfer member.

In the image forming method in which the toner image formed on the latent image bearing member or on the intermediate transfer member is transferred to the recording medium, a method may preferably be used in which a multiple toner image formed using a plurality of toners on the latent image bearing member or on the intermediate transfer member is transferred in a lump to the recording medium.

The toner of the present invention has superior agglomeration-free properties and uniform charging performance. Hence, it can faithfully reproduce minute latent images and can develop digital latent images beautifully. Especially in full-color images, it can realize superior reproduction of high-light areas and reproduction of fine color differences, and can form full-color images which are full of the feel of a material and are smooth, fresh and pictorial. Hence, graphic images and line character images can also be obtained beautifully, and the present toner may preferably be used in digital full-color copying machines or printers.

Figure 2:
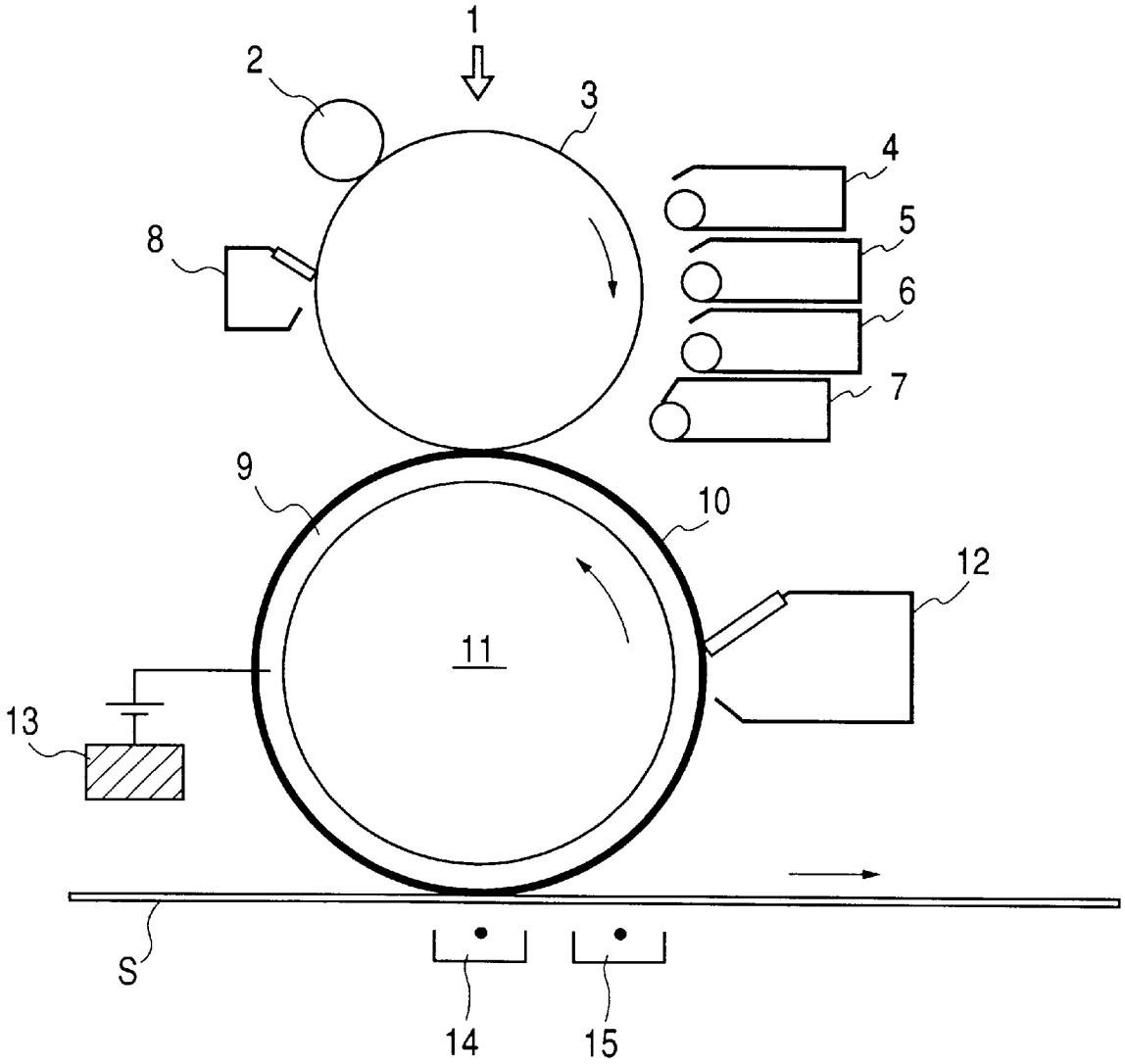
FIG. 2 schematically illustrates another example of an image forming apparatus that can carry out the image forming method of the present invention.

The above image forming method in which a multiple toner is transferred at a time to the recording medium through the the intermediate transfer member will be described below with reference to FIG. 2.

The surface of a photosensitive drum 3 as the latent image bearing member is made to have surface potential by a charging roller 2 rotating in contact with the photosensitive drum 3, and electrostatic latent images are formed by an exposure means 1. The electrostatic latent images are successively developed by a first developing assembly 4, a second developing assembly 5, a third developing assembly 6 and a fourth developing assembly 7 to form corresponding toner images. The toner images thus formed are multiply transferred to an intermediate transfer member 11 for each color to form a multiple toner image.

As the intermediate transfer member 11, a drum member is used, where a member on the periphery of which a holding member has been stuck, or a member comprising a substrate and a conductivity-providing member provided thereon such as an elastic layer (e.g., nitrile-butadiene rubber) in which carbon black, zinc oxide, tin oxide, silicon carbide or titanium oxide has been well dispersed may be used. A belt-like intermediate transfer member may also be used. The intermediate transfer member may preferably be constituted of an elastic layer having a hardness of from 10 to 50 degrees (JIS K-6301), or, in the case of a transfer belt, constituted of a support member having an elastic layer having this hardness at the transfer area where toner images are transferred to the transfer medium (recording medium).

To transfer toner images from the photosensitive drum 3 to the intermediate transfer member 11, a bias is applied from a power source 13 to a core metal 9 of the intermediate transfer member 11, so that transfer currents are formed and the toner images are transferred. Corona discharge from the back of the holding member or belt, or roller charging may be utilized.

The multiple toner image on the intermediate transfer member 11 is transferred in a lump to the recording medium S by a transfer charging assembly 114. As the transfer charging assembly, a corona charging assembly or a contact electrostatic transfer means making use of a transfer roller or a transfer belt may be used.

The toner image transferred onto the recording medium by any of the above methods is fixed to the recording medium in a fixing step with aid of heat and/or pressure.

In the present invention, the transfer residual toner present on the latent image bearing member without being transferred in the transfer step may be collected by any of (i) a cleaning-before-development system in which a cleaning member is brought into touch with the surface of the latent image bearing member to remove and collect the transfer residual toner and (ii) a cleaning-at-development system in which the developing assembly collects the transfer residual toner simultaneously at the time of development. In order to make the whole image forming apparatus compact and make the latent image bearing member have a longer lifetime, the cleaning-at-development system is preferred.

In the cleaning-at-development system, the developing zone, the transfer zone and the charging zone are positioned in this order with respect to the movement direction of the surface of the latent image bearing member, and the system does not have any cleaning member for removing the transfer residual toner present on the surface of the latent image bearing member, which is otherwise provided between the transfer zone and the charging zone and between the charging zone and the developing zone in contact with the surface of the latent image bearing member.

An image forming method employing the cleaning-at-development system will be described by giving an example of reverse development in which the charge polarity of the toner is set identical with the charge polarity of the electrostatic latent image of the latent image bearing member to carry out development. When a negatively chargeable photosensitive drum and a negatively chargeable toner are used, an image rendered visible is transferred to a transfer medium in the transfer step by means of a positive-polarity transfer member, where the charge polarity of the transfer residual toner varies from positive to negative depending upon a type of transfer medium (differences in thickness, resistance and dielectric constant) and an image area. However, the negative-polarity charging member, used to charge the negatively chargeable photosensitive member, can uniformly adjust the charge polarity to the negative side even if the polarity of the transfer residual toner has been shifted to the positive side in the transfer step together with that of the photosensitive drum surface. Hence, when the reverse development is employed as the developing method, even though toner particles charged uniformly to the negative polarity at the time of development are present on the photosensitive drum surface, the transfer residual toner, which stands negatively charged, remains at toner's light-portion potential areas to be developed. At toner's dark-portion potential areas that should not be developed by the toner, the toner is attracted toward the developer carrying member in relation to the development electric field and does not remain on the negative-polarity photosensitive drum.

FIG. 1 schematically illustrates an image forming apparatus that can carry out the image forming method of the present invention.

The main body of the image forming apparatus is provided side by side with a first image forming unit Pa, a second image forming unit Pb, a third image forming unit Pc and a fourth image forming unit Pd, and images with respectively different colors are formed on a transfer medium through the process of latent image formation, development and transfer.

The respective image forming unit provided side by side in the image forming apparatus are each constituted as described below taking the first image forming unit Pa as an example.

The first image forming unit Pa has an electrophotographic photosensitive drum 61*a* of 30 mm diameter as the latent image bearing member. This photosensitive drum 61*a* is rotated in the direction of an arrow a. Reference numeral 62*a* denotes a primary charging assembly as a charging means, and a magnetic brush charging assembly is used which comprises a 16 mm diameter sleeve on which magnetic particles are carried in contact with the photosensitive drum 61*a*. Reference numeral 67*a* denotes an exposure device as a latent image forming means for forming an electrostatic latent image on the photosensitive drum 61*a* whose surface has been uniformly charged by means of the primary charging assembly 62*a*. Reference numeral 63*a* denotes a developing assembly as a developing means for developing the electrostatic latent image held on the photosensitive drum 61*a*, to form a color toner image, which holds a color toner. Reference numeral 64*a* denotes a transfer blade as a transfer means for transferring the color toner image formed on the surface of the photosensitive drum 61*a*, to the surface of a transfer medium transported by a belt-like transfer medium carrying member 68. This transfer blade 64*a* comes into touch with the back of the transfer medium carrying member 68 and can apply a transfer bias.

In this first image forming unit Pa, a photosensitive member of the photosensitive drum 61*a* is uniformly primarily charged by the primary charging assembly 62*a,* and thereafter the electrostatic latent image is formed on the photosensitive member by the exposure means 67*a.* The electrostatic latent image is developed by the developing assembly 63*a* using a color toner. The toner image thus formed by development is transferred to the surface of the transfer medium by applying transfer bias from the transfer blade 64*a* coming into touch with the back of the belt-like transfer medium carrying member 68 carrying and transporting the transfer medium, at a first transfer zone (the position where the photosensitive member and the transfer medium come into contact with each other).

This first image forming unit Pa does not have any cleaning member for removing the transfer residual toner from the surface of the photosensitive drum, which is otherwise provided between the transfer zone and the charging zone and between the charging zone and the developing zone in contact with the surface of the photosensitive drum. It instead employs the cleaning-at-development system in which the developing assembly collects the transfer residual toner present on the photosensitive drum, simultaneously at the time of development to clean its surface.

In the present image forming apparatus, the second image forming unit Pb, third image forming unit Pc and fourth image forming unit Pd which are constituted in the same way as the first image forming unit Pa but having different color toners held in the developing assemblies are provided side by side. For example, a yellow toner is used in the first image forming unit Pa, a magenta toner in the second image forming unit Pb, a cyan toner in the third image forming unit Pc and a black toner in the fourth image forming unit Pd, and the respective color toners are successively transferred to the transfer medium at the transfer zones of the respective image forming units. In this course, the respective color toners are superimposed while making registration, on the same transfer medium during one-time movement of the transfer medium. After the transfer is completed, the transfer medium is separated from the surface of the transfer medium carrying member 68 by a separation charging assembly 69, and then sent to a fixing assembly 70 by a transport means such as a transport belt, where a final full-color image is formed by only-one-time fixing.

The fixing assembly 70 has a 40 mm diameter fixing roller 71 and a 30 mm diameter pressure roller 72 which are paired. The fixing roller 71 has heating means 75 and 76. Reference numeral 73 denotes a web for removing any stains on the fixing roller.

The unfixed color toner images transferred onto the transfer medium are passed through the pressure contact area between the fixing roller 71 and the pressure roller 72, whereupon they are fixed onto the transfer medium by the action of heat and pressure.

In the apparatus shown in FIG. 1, the transfer medium carrying member 68 is an endless belt-like member. This belt-like member is moved in the direction of an arrow e by a drive roller 80. Reference numeral 79 denotes a transfer belt cleaning device; 81, a belt follower roller; and 82, a belt charge eliminator. Reference numeral 83 denotes a pair of resist rollers for transporting to the transfer medium carrying member 68 the transfer medium kept in a transfer medium holder.

As the transfer means, the transfer blade coming into touch with the back of the transfer medium carrying member may be replaced with a contact transfer means that comes into contact with the back of the transfer medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the transfer medium carrying member, as commonly used.

However, in view of such an advantage that the quantity of ozone generated when the transfer bias is applied can be controlled, it is more preferable to use the contact transfer means.

An image forming method will be described with reference to FIG. 3, in which toner images of different colors are respectively formed in a plurality of image forming sections and they are transferred to the same transfer medium while successively superimposing them.

In this method, first, second, third and fourth image forming sections 29*a,* 29*b,* 29*c* and 29*d* are arranged, and the image forming sections have latent image bearing members exclusively used therein, i.e., photosensitive drums 19*a,* 19*b,* 19*c* and 19*d,* respectively.

The photosensitive drums 19*a* to 19*d* are respectively provided around their peripheries with latent image forming means 23*a,* 23*b,* 23*c* and 23*d,* developing means 17*a,* 17*b,* 17*c* and 17*d,* transfer discharging means 24*a,* 24*b,* 24*c* and 24*d,* and cleaning means 18*a,* 18*b,* 18*c* and 18*d.*

Under such constitution, first, on the photosensitive drum 19*a* of the first image forming section 29*a,* for example, a yellow component color latent image is formed by the latent image forming means 23*a.* This latent image is converted into a visible image (toner image) by the use of a developer having a yellow toner in the developing means 17*a,* and the toner image is transferred to a transfer medium S (a recording medium) by means of the transfer means 24*a.*

While the yellow toner image is transferred to the transfer medium S as described above, in the second image forming section 29*b* a magenta component color latent image is formed on the photosensitive drum 19*b,* and is subsequently converted into a visible image (a toner image) by the use of a developer having a magenta toner in the developing means 17*b.* This visible image (magenta toner image) is superimposed and transferred onto a preset position of the transfer medium S when the transfer medium S onto which the transfer in the first image forming section 29*a* has been completed is transported to the transfer means 24*b.*

Subsequently, in the same manner as described above, cyan and black color toner images are formed in the third and fourth image forming sections 29*c* and 29*d,* respectively, and the cyan and black color toner images are superimposed and transferred onto the same transfer medium S. Upon completion of such an image forming process, the transfer medium S is transported to a fixing section 22, where the toner images on the transfer medium S are fixed. Thus, a multi-color image is obtained on the transfer medium S. The respective photosensitive drums 19*a,* 19*b,* 19*c* and 19*d* onto which the transfer has been completed are cleaned by the cleaning means 18*a,* 18*b,* 18*c* and 18*d,* respectively, to remove the remaining toner, and are served for the next latent image formation subsequently carried out.

In the above image forming apparatus, a transport belt 25 is used to transport the recording medium, the transfer medium S. As viewed in FIG. 3, the transfer medium S is transported from the right side to the left side, and, in the course of this transport, passes through the respective transfer means 24*a,* 24*b,* 24*c* and 24*d* of the image forming sections 29*a,* 29*b,* 29*c* and 29*d,* respectively.

In this image forming method, as a transport means for transporting the transfer medium, a transport belt comprised of a mesh made of Tetoron fiber and a transport belt comprised of a thin dielectric sheet made of a polyethylene terephthalate resin, a polyimide resin or a urethane resin are used from the viewpoint of readiness in working and durability.

After the transfer medium S has passed through the fourth image forming section 29*d,* an AC voltage is applied to a charge eliminator 20, whereupon the transfer medium S is decharged, separated from the belt 68, thereafter sent into a fixing assembly 22 where the toner images are fixed, and finally sent out through a paper outlet 26.

In this image forming method, the image forming sections are provided with respectively independent latent image bearing members, and the transfer medium may be so made as to be successively sent to the transfer zones of the respective latent image bearing members by a belt type transport means.

Alternatively, in this image forming method, a latent image bearing member common to the respective image forming sections may be provided, and the transfer medium may be so made as to be repeatedly sent to the transfer zone of the latent image bearing member by a drum type transport means so that the toner images of the respective colors are received there.

Since, however, the transfer belt has a high volume resistivity, the transport belt continues to increase charge quantity while the transfer is repeated several times, as in the case of color image forming apparatus. Hence, uniform transfer can not be maintained unless the transfer electric currents are successively made greater at every transfer.

The toner of the present invention is so excellent in transfer performance that the transfer performance of the toner at every transfer can be made uniform under the like transfer electric currents even if the charging of the charging means has increased at every repetition of transfer, so that images with a good quality at a high level can be obtained.

An image forming method for forming full-color images according to another embodiment will further be described with reference to FIG. 4.

An electrostatic latent image formed on a photosensitive drum 33 through a suitable means is rendered visible by a two-component developer having a first color toner and a carrier, held in a developing assembly 36 serving as a developing means, attached to a rotary developing unit 39 which is rotated in the direction of an arrow. The color toner image (the first color) thus formed on the photosensitive drum 33 is transferred by means of a transfer charging assembly 44 to a transfer medium, a recording medium S, held on a transfer drum 48 by a gripper 47.

In the transfer charging assembly 44, a corona charging assembly or a contact transfer charging assembly is used. In the case where the corona charging assembly is used in the transfer charging assembly 44, a voltage of −10 kV to +10 kV is applied, and transfer electric currents are set at −500 $\mu$A to +500 $\mu$A. On the periphery of the transfer drum 48, a holding member is provided. This holding member is formed out of a film-like dielectric sheet such as polyvinylidene fluoride resin film or polyethylene terephthalate film. For example, a sheet with a thickness of from 100 $\mu$m to 200 $\mu$m and a volume resistivity of from $10^{12}$ to $10^{14}$ Ω•cm is used.

Next, for the second color, the rotary developing unit is rotated until a developing assembly 35 faces the photosensitive drum 33. Then, a second-color latent image is developed by a two-component developer having a second color toner and a carrier, held in the developing assembly 35, and the color toner image thus formed is also superimposed and transferred onto the same transfer medium, the recording medium S, as in the above.

Similar operation is also repeated for the third and fourth colors. Thus, the transfer drum 48 is rotated given times while the transfer medium, the recording medium S, is kept being gripped thereon, so that the toner images corresponding to the number of given colors are multi-transferred to the recording medium. Transfer electric currents for electrostatic transfer may preferably be made greater in the order of first color, second color, third color and fourth color so that the toners remaining on the photosensitive drum after transfer may be less.

Meanwhile, high transfer electric currents are not preferable because the images being transferred may be blurred. Since, however, the toner of the present invention has a superior transfer performance, the second, third and fourth color images to be multi-transferred can be surely transferred. Hence, every color image is neatly formed, and a multi-color image with sharp tones can be obtained. Also, in full-color images, beautiful images with a superior color reproduction can be obtained. Moreover, since it is no longer necessary to make the transfer electric currents great so much, the image blur in the transfer step can be made less occur. When the recording medium S is separated from the transfer drum 48, charges are eliminated by means of a separation charging assembly 45, where the recording medium S may greatly be electrostatically attracted to the transfer drum if the transfer electric currents are great, and the transfer medium can not be separated unless the electric currents at the time of separation are made greater. If made greater, since such electric currents have a polarity reverse to that of the transfer electric currents, the toner images may be blurred, or the toners may scatter from the transfer medium to soil the inside of the image forming apparatus. Since the toner of the present invention can be transferred with ease, the transfer medium can be readily separated without making the separation electric currents greater, so that the image blur and toner scatter at the time of separation can be prevented. Hence, the toner of the present invention can be preferably used especially in the image forming method of forming multi-color images or full-color images, having the step of multiple transfer.

The recording medium S onto which the multiple transfer has been completed is separated from the transfer drum 48 by means of the separation charging assembly 45. Then the toner images held thereon are fixed by means of a heat-pressure roller fixing assembly 3 having a web impregnated with silicone oil, and additive-color-mixed at the time of fixing, whereupon a full-color copied image is formed.

Supply toners to be fed to the developing assemblies 34 to 37 are transported in quantities predetermined in accordance with supply signals, from supply hoppers provided for the respective color toners, through toner transport cables and to toner supply cylinders provided at the center of the rotary developing unit, and fed therefrom to the respective developing assemblies.

A multiple development one-time transfer method will be described with reference to FIG. 5, taking an example of a full-color image forming apparatus.

Electrostatic latent images formed on a photosensitive drum 103 by a charging assembly 102 and an exposure means 101 making use of laser light is rendered visible by development successively carried out using toners by means of developing assemblies 104, 105, 106 and 107. In the developing process, non-contact development is preferably used. In the non-contact development, the developer layer formed in the developing assembly does not rub on the surface of the photosensitive drum 103, and hence the developing can be carried out without blurring the image formed in the preceding developing step in the second and subsequent developing steps. As to the order of developing, in the case of multi-colors, the latent images may preferably be developed first with a color other than black and having higher brightness and chroma. In the case of full-colors, the latent images may preferably be developed in the order of yellow, then either magenta or cyan, thereafter the remainder of either magenta or cyan, and finally black.

The toner images for a multi-color image or full-color image which have been formed in superimposion on the photosensitive drum 103 are transferred to a transfer medium, a recording medium S, by means of a transfer charging assembly 109. In the transfer step, electrostatic transfer is preferably used, where corona discharging transfer or contract transfer is utilized. The former corona discharging transfer is a method in which a transfer charging assembly 109 that generates corona discharge is provided opposite to the toner images, interposing the transfer medium recording medium S between them, and corona discharge is allowed to act on the back of the recording medium to electrostatically transfer the toner images. The latter contact transfer is a method in which a transfer roller or transfer belt is brought into contact with the photosensitive drum 103 and then the toner images are transferred while applying a bias to the roller, or by electrostatic charging from the back of the belt, interposing the transfer medium recording medium S between them. By such an electrostatic transfer, the multi-color toner images held on the photosensitive drum 103 are transferred at one time to the transfer medium, the recording medium S. Since in such a one-time transfer system the toners transferred are in a large quantity, the toners may remain in a large quantity after transfer to tend to cause non-uniform transfer and, in the full-color image, tend to cause color non-uniformity.

However, the toner of the present invention is so excellent in transfer performance that any color images of the multi-color image can be neatly formed. In full-color images, beautiful images with a superior color reproduction can be obtained. Moreover, since the toner can be transferred in a good efficiency even under a low electric current, the image blur can be inhibited from occurring. Moreover, since the recording medium can be separated with ease, any toner scatter at the time of separation also can be inhibited from occurring. In addition, because of a superior releasability, a good transfer performance can be realized in the contact transfer means. Hence, the toner of the present invention can be preferably used also in the image forming method having the step of multiple image one-time transfer.

The recording medium S onto which the multi-color toner images have been transferred at one time is separated from the photosensitive drum 103, and then fixed by means of a heat roller fixing assembly 112, whereupon a multi-color image is formed.

Figure 4:
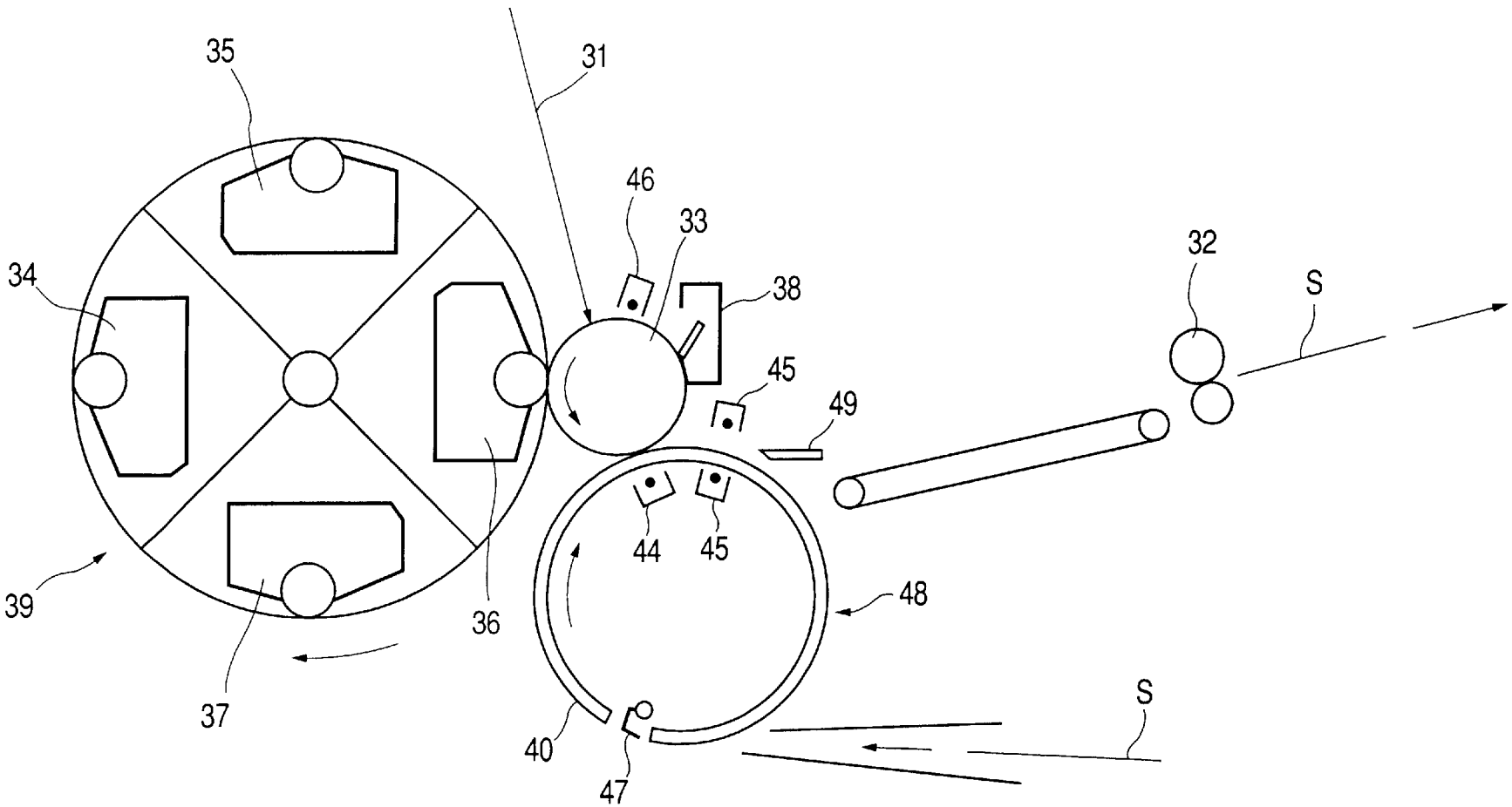
FIG. 4 schematically illustrates a further example of an image forming apparatus that can carry out the image forming method of the present invention.
Figure 5:
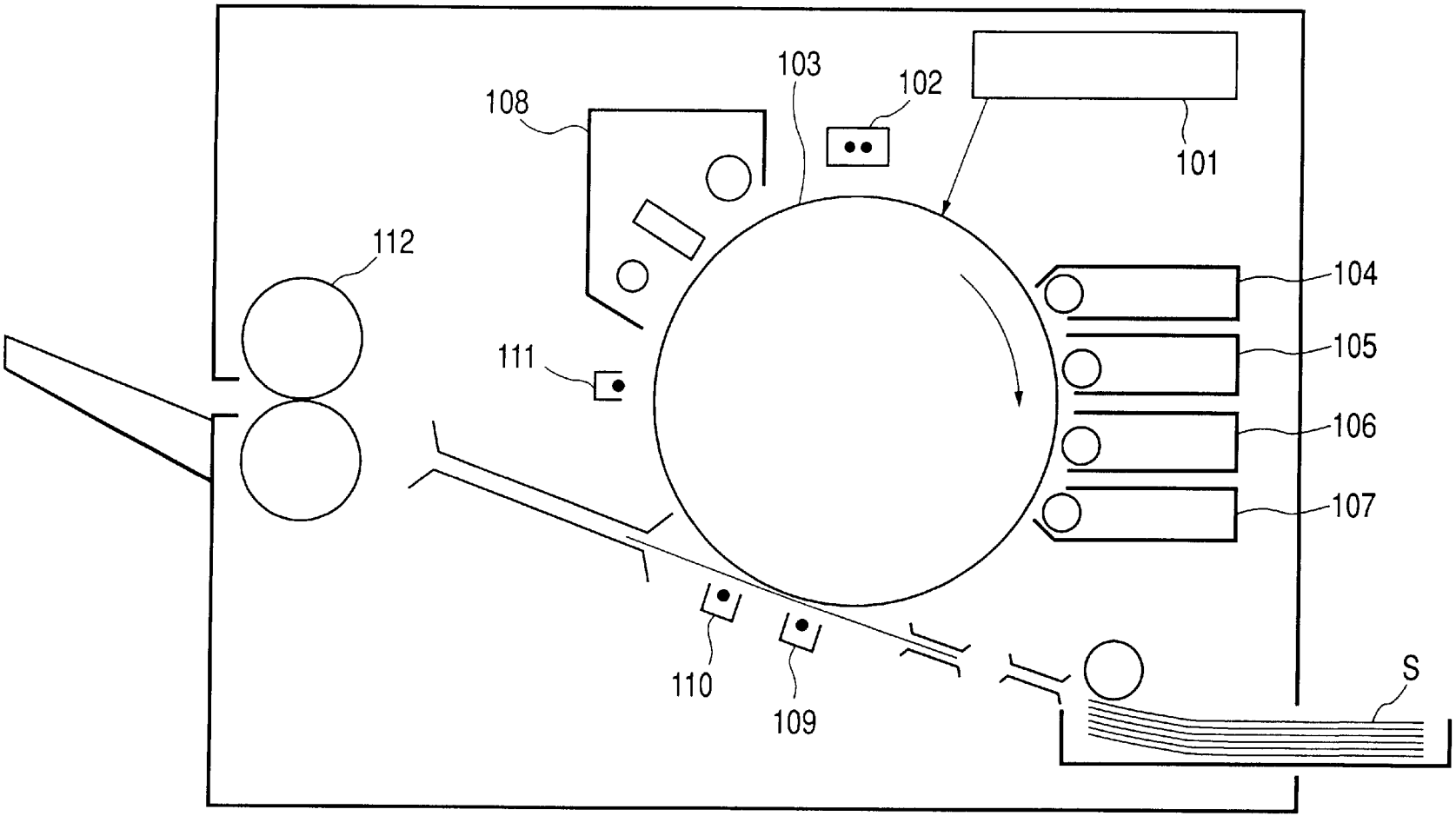
FIG. 5 schematically illustrates a still further example of an image forming apparatus that can carry out the image forming method of the present invention.
Figure 6:
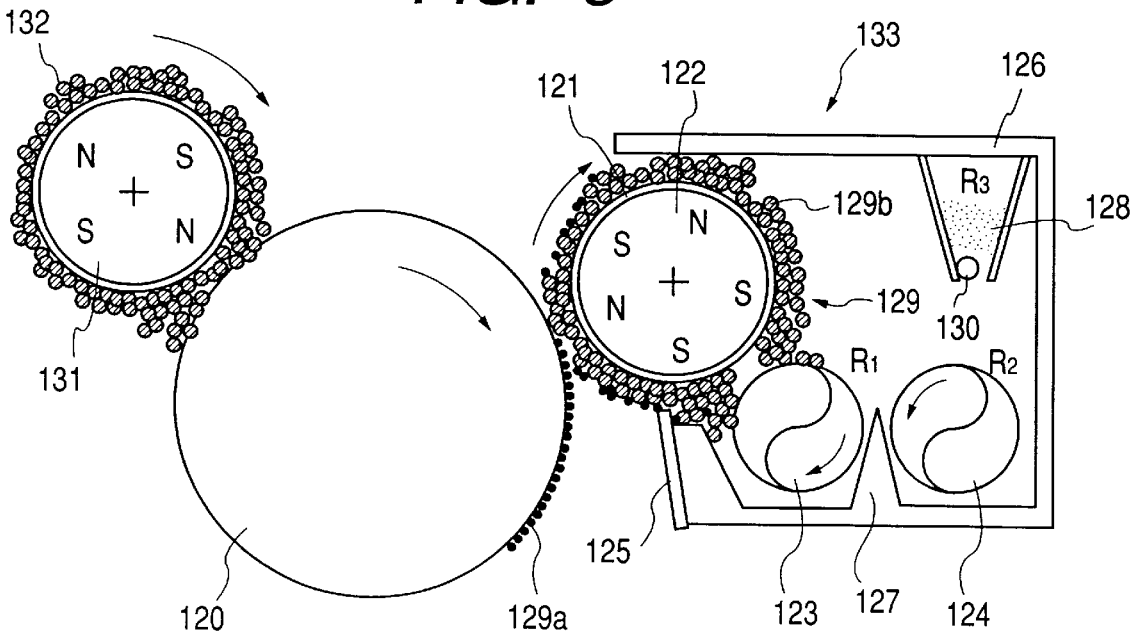
FIG. 6 schematically illustrates a preferred image forming apparatus used to describe the image forming method of the present invention.

As the developing assemblies of the image forming apparatus shown in FIGS. 1 to 5, the two-component developing assembly shown in FIG. 6 may be used, which carries out development by the use of the two-component developer of the present invention.

As shown in FIG. 6, a developing assembly 133 used to develop an electrostatic latent image formed on a photosensitive drum 1 serving as the latent image bearing member has a developing container 126 the inside of which is partitioned into a developing chamber (first chamber) R1 and an agitator chamber (second chamber) R2 by a partition wall 127. At the upper part of the agitator chamber R2, a toner storage chamber R3 is formed on the other side of the partition wall 127. A developer 129 is held in the developing chamber R1 and agitator chamber R2, and a replenishing toner (non-magnetic toner) 128 is held in the toner storage chamber R3. The toner storage chamber R3 is provided with a supply opening 130 so that the replenishing toner 128 is dropped and supplied through the supply opening 130 into the agitator chamber R2 in the quantity corresponding to the toner consumed.

A transport screw 123 is provided inside the developing chamber R1. As the transport screw 123 is rotated, the developer 129 held in the developing chamber R1 is transported in the longitudinal direction of a developing sleeve 121. Similarly, a transport screw 124 is provided in the agitator chamber R2 and, as a transport screw 124 is rotated, the toner having dropped from the supply opening 130 into the agitator chamber R2 is transported in the longitudinal direction of the developing sleeve 121.

The developer 129 is a two-component developer comprising a non-magnetic toner 129*a* and a magnetic carrier 129*b*.

The developing container 126 is provided with an opening at a part adjacent to the photosensitive drum 120, and the developing sleeve 121 protrudes outward from the opening, where a gap is formed between the developing sleeve 121 and the photosensitive drum 120. The developing sleeve 121, formed out of a non-magnetic material, is provided with a bias applying means (not shown in the drawing) for applying a bias voltage at the time of development.

The magnet roller serving as a magnetic field generating means fixed inside the developing sleeve 121, that is, a magnet 122 has a developing magnetic pole N, a magnetic pole S positioned on its downstream side, and magnetic poles N, S and S for transporting the developer 129. The magnet 122 is provided in the developing sleeve 121 in such a way that the developing magnetic pole S faces the photosensitive drum 120. The developing magnetic pole S generates a magnetic field in the vicinity of a developing zone defined between the developing sleeve 121 and the photosensitive drum 120, where a magnetic brush is formed by the magnetic field.

Beneath the developing sleeve 121, a non-magnetic blade 125 made of a non-magnetic material such as aluminum or SUS316 stainless steel is provided to regulate the layer thickness of the developer 129 on the developing sleeve 121. The distance between an end of the non-magnetic blade 125 serving as a regulation member and the face of the developing sleeve 121 is 300 to 1,000 $\mu$m, and preferably 400 to 900 $\mu$m. If this distance is smaller than 300 $\mu$m, the magnetic carrier may be caught between them to tend to make the developer layer uneven, and also the developer necessary for carrying out good development can not be applied on the sleeve, bringing about such a problem that only images with a low density and much unevenness can be obtained. In order to prevent uneven coating (what is called the blade clog) due to unauthorized particles included in the developer, the distance may preferably be 400 $\mu$m or larger. If it is more than 1,000 $\mu$m, the quantity of the developer coated on the developing sleeve 121 increases to realize no desired regulation of the developer layer thickness, bringing about such a problem that the magnetic carrier particles adhere to the photosensitive drum 120 in a large quantity and also the circulation of the developer and the control of the developer by the non-magnetic blade 125 may become ineffective for developer regulation to tend to cause fog because of a shortage of triboelectricity of the toner.

This layer of magnetic carrier particles, even when the developing sleeve 121 is rotated in the direction of an arrow, moves slower as it separates further from the sleeve surface in accordance with the balance between the binding force exerted by magnetic force and gravity and the transport force acting toward the transport of the sleeve 121. Some particles drop, of course, by the effect of gravity.

Accordingly, the position to arrange the magnetic poles N and N and the fluidity and magnetic properties of the magnetic carrier particles may be appropriately selected, so that the magnetic carrier particle layer is transported toward the magnetic pole N as it stands nearer to the sleeve, forming a moving layer. Along this movement of the magnetic carrier particles, the developer is transported to the developing zone with the developing sleeve 121 being rotated, and is served for development.

In the apparatus shown in FIG. 6, the charging means for primarily charging the photosensitive drum 120 is a magnetic-brush charging assembly in which magnetic particles 132 are magnetically bound by a non-magnetic conductive sleeve 131 having a magnet roll in its inside.

As described above, the toner of the present invention has a specific circularity distribution and a specific weight-average particle diameter. Also, the external additive of the toner has, on the toner particles, the inorganic fine powder (A) having a specific average particle length and a specific shape factor and the non-spherical inorganic fine powder (B) formed by coalescence of particles and having a specific shape factor. The toner of the present invention enables finer latent image dots to be faithfully reproduced in a high image quality and withstands any mechanical stress inside the developing assembly so that the deterioration of the toner is inhibited.

EXAMPLES

Examples of the present invention are shown below. The present invention is by no means limited to these. In the following, "part(s)" indicates "part(s) by weight".

Example 1

In 710 parts of ion-exchanged water, 450 parts of an aqueous 0.1M $Na_3PO_4$ solution was introduced, followed by heating to 60° C. and then stirring at 12,000 rpm using a Clear mixer (manufactured by M Technic K.K.). To the resultant mixture, 68 parts of an aqueous 1.0M $CaCl_2$ solution was added little by little to obtain an aqueous medium containing a calcium phosphate compound.

| | |
|---|---|
| (Monomers) | |
| Styrene | 165 parts |
| n-Butyl acrylate | 35 parts |
| (Colorant) | 15 parts |
| C.I. Pigment Blue 15:3 | |
| (Charge control agent) | 3 parts |
| Salicylic acid metal compound | |
| (Polar resin) | 10 parts |
| Saturated polyester resin | |
| (Release agent) | 50 parts |
| Ester wax (m.p.: 70° C.) | |

The above materials were finely dispersed by means of a ball mill, and thereafter the materials shown below were added. Using a TK-type homomixer (manufactured by Tokushu Kika Kogyo Co., Ltd.) heated to 60° C., the mixture obtained was uniformly dissolved and dispersed at 12,000 rpm. Subsequently, 10 parts of a polymerization initiator 2,2'-azobis(2,4-dimethylvaleronitrile) was dissolved to obtain a polymerizable monomer composition.

The above polymerizable monomer composition was introduced in the above aqueous medium, followed by stirring at 60° C. in an atmosphere of nitrogen, using the Clear mixer at 12,000 rpm for 10 minutes to granulate the polymerizable monomer composition. Thereafter, the granulated product obtained was moved to a reaction vessel and stirred with a paddle agitating blade during which the temperature was raised to 80° C. and polymerization was carried out for 10 hours. After the polymerization was completed, residual monomers were evaporated off under reduced pressure, the reaction system was cooled, and thereafter hydrochloric acid was added thereto to dissolve the calcium phosphate, followed by filtration, washing with water and then drying to obtain colored suspension particles (toner particles) with a weight-average particle diameter of 6.1 μm in a sharp particle size distribution.

To 100 parts of the toner particles thus obtained, 1.0 part of anatase type hydrophobic fine titanium oxide powder (1) (volume resistivity: $7\times10^9$ Ω•cm) having been treated with 10 parts of isobutyltrimethoxysilane in an aqueous medium and having a BET specific surface area of 100 $m^2/g$ and 1.0 part of non-spherical fine silica powder (1) having a BET specific surface area of 43 $m^2/g$ were externally added to obtain suspension polymerization cyan toner 1.

The above fine silica powder (1) was a product obtained by surface-treating 100 parts of commercially available fine silica particles AEROSIL #50 (available from Nippon Aerosil Co., Ltd.) with 10 parts of hexamethyldisilazane, followed by classification to collect relatively coarse particles using an air classifier to control their particle size distribution. On a photograph of 100,000 magnifications taken with a transmission electron microscope (TEM) and a photograph of 30,000 magnifications taken with a scanning electron microscope (SEM), the fine silica powder (1) was confirmed to be particles formed by coalescence of a plurality of primary particles having an average particle diameter of 40 mm.

The fine titanium oxide powder (1) present on the toner particles of the suspension polymerization cyan toner 1 had a shape factor SF-1 of 120, and the fine silica powder (1) also present thereon had a shape factor SF-1 of 195.

On a photograph of 100,000 magnifications of the suspension polymerization cyan toner 1, taken with a scanning electron microscope, the fine titanium oxide powder (1) was confirmed to have an average length of 50 mμm, a length/breadth ratio of 1.1 and to be present in the number of 25 particles per unit area of 0.5 μm×0.5 μm. On a photograph of 30,000 magnifications of the suspension polymerization cyan toner 1, taken with a scanning electron microscope, the fine silica powder (1) was confirmed to have an average length of 168 mμm, a length/breadth ratio of 2.8 and to be present in the number of 17 particles per unit area of 1.0 μm×1.0 μm. The particle shape of the fine silica powder (1), confirmed on this magnified photograph, is shown in FIG. 10.

The suspension polymerization cyan toner 1 had a weight-average particle diameter of 6.1 μm as measured by Coulter Counter, an average circularity of 0.983 in its circularity distribution as measured by a flow type particle image analyzer, and contained 11% by number of toner particles having circularity of less than 0.95.

The above suspension polymerization cyan toner 1 and the following development carrier I were blended in a toner concentration of 8% to produce a two-component cyan developer (1) (apparent density: 1.45; degree of compaction: 12%).

The apparent density and degree of compaction of the two-component cyan developer (1) are values determined according to the measuring methods described below.

Measurement of apparent density:

Using a powder tester, a sieve with 75 $\mu$m meshes was vibrated at a vibrational amplitude of 1 nm, and apparent density A was measured in the state the particles were passed.

Measurement of degree of compaction:

Using a powder tester, tap density P after 180 time up-and-down reciprocation was measured to calculate the degree of compaction of the two-component developer.

Degree of compaction=(P−A)/P×100 (%) wherein A represents an apparent density of the two-component developer, and P represents a tap density.

Production of Development Carrier I

In an aqueous medium, a phenol/formaldehyde (50:50) monomer was mixed and dispersed. Thereafter, based on the weight of the monomer, 600 parts of 0.25 $\mu$m magnetite particles surface-treated with isopropoxytriisostearoyl titanate and 400 parts of 0.6 $\mu$m hematite particles were uniformly dispersed, and the monomer was polymerized while adding ammonia in an appropriate quantity to obtain a magnetic particle inclusion spherical magnetic resin carrier core (average particle diameter: 33 $\mu$m; saturation magnetization: 38 $\mu m^2$/kg).

20 parts of toluene, 20 parts of butanol, 20 parts of water and 40 parts of ice were put into a four-necked flask, and 40 parts of a mixture of 15 mols of $CH_3SiCl_3$ and 10 mols of $(CH_3)_2SiCl_2$ and a catalyst were added thereto with stirring. After further stirring for 30 minutes, condensation reaction was carried out at 60° C. for 1 hour. Thereafter, the siloxanes were well washed with water, and then dissolved in a toluene/methyl ethyl ketone/butanol mixed solvent to obtain a silicone varnish with 10% of solid content.

To the silicone varnish thus obtained, based on 100 parts of the siloxane solid content, 2.0 parts of ion-exchanged water, 2.0 parts of a curing agent represented by the following formula (1), 1.0 part of aminosilane coupling agent represented by the following formula (2) and 5.0 parts of a silane coupling agent represented by the following formula (3) were simultaneously added to produce carrier coat solution I.

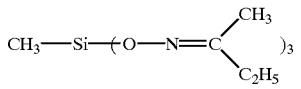

(1)

$$(CH_3)_2N—C_3H_6—Si—(OCH_3)_3 \quad (2)$$

$$n\text{-}C_3H_7—Si—(OCH_3)_3 \quad (3)$$

The carrier coat solution I thus obtained was coated on 100 parts of the above carrier core by means of a coating machine (SPIRACOATER, manufactured by Okada Seiko K.K.) so as to be in a resin coat weight of 1 part, to obtain coated carrier I (development carrier I).

This development carrier I had a volume resistivity of $4\times10^{13}$ Ω•cm and a coercive force of 55 oersteds, as measured by the following methods.

Figure 9:
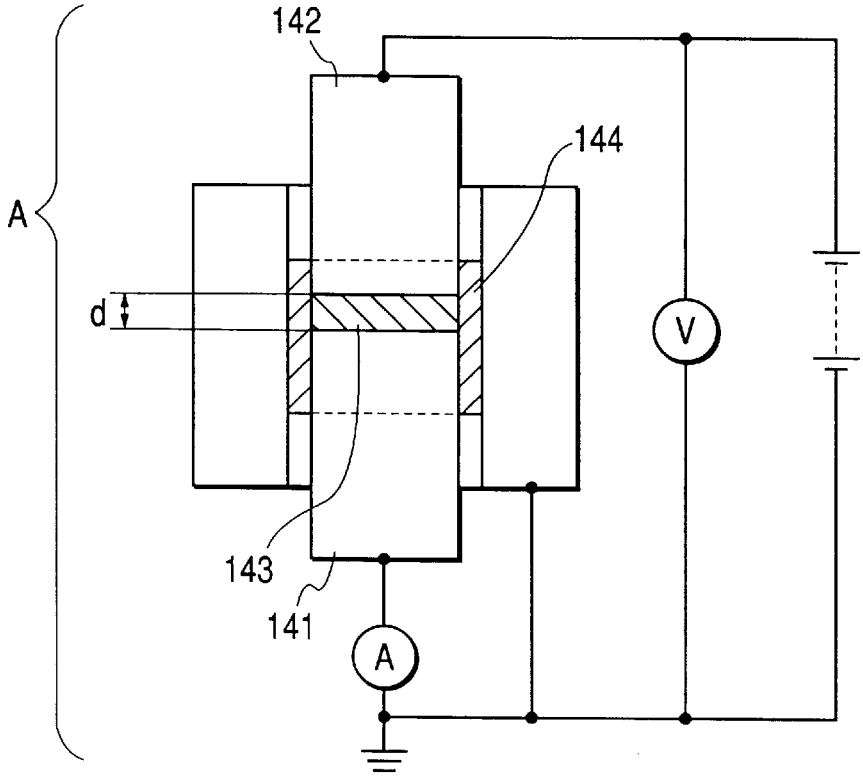
FIG. 9 illustrates a device used to measure volume resistivity.

Measurement of volume resistivity:

The volume resistivity was measured using a cell shown in FIG. 9. More specifically, a cell A was packed with a sample 143, and a lower electrode 141 and an upper electrode 142 were so provided as to come into contact with the packed sample 143, where a 1,000 V DC voltage was applied across the electrodes and the currents flowing at that time were measured with an ammeter to determine the volume resistivity. Reference numeral 144 denotes an insulating material. The measurement was made under conditions of contact area S between the packed sample and the cell of 2 $cm^2$, a thickness d of 3 mm and a load of the upper electrode of 15 kg.

Measurement of magnetic properties:

A BHU-60 type magnetization measuring device (manufactured by Riken Sokutei Co.) was used as a device. About 1.0 g of a sample for measurement was weighed and packed in a cell of 7 mm diameter and 10 mm high, which was then set in the above device. Measurement was made while gradually increasing an applied magnetic field so as to be changed to 1,000 oersted at maximum. Subsequently, the applied magnetic field was decreased, and finally a hysteresis curve of the sample was obtained on a recording paper. Saturation magnetization, residual magnetization and coercive force were determined therefrom.

The two-component developer (1) was put into the developing assembly 63*a* in the first image forming unit Pa of the image forming apparatus shown in FIG. 1, and the suspension polymerization cyan toner 1 was put into the toner hopper 65*a*. Using a patch concentration detecting means (not shown), the toner concentration of the two-component developer (1) in the developing assembly 63*a* was so controlled as to be maintained to from 7% to 9%. Copies were continuously taken on 30,000 sheets in cyan monochrome in environments of 23° C./65%RH, 30° C./80%RH and 20° C./10%RH while replenishing the suspension polymerization cyan toner 1 to the developing assembly 63*a* from the toner hopper 65*a* through the toner feed member 66*a*.

The first image forming unit Pa of the image forming apparatus was constituted of the following photosensitive member No. 1 used as the photosensitive drum 61*a*, and the following magnetic-brush charging assembly No. 1 used as the primary charging assembly 62*a*, where the magnetic-brush charging assembly was rotated at a speed of 120% in the counter direction with respect to the surface movement direction of the photosensitive drum 61*a*. The photosensitive drum 61*a* was primarily charged to −700 V while applying a charging bias voltage formed by superposing an AC voltage of 1 kHz and 1.2 kVpp on a DC current of −700 V. In addition, the first image forming unit Pa did not have any cleaning member for removing and collecting the transfer residual toner present on the surface of the photosensitive drum 61*a*, which was otherwise provided between the transfer zone and the charging zone and between the charging zone and the developing zone in contact with the surface of the photosensitive drum 61*a*, and was so constituted as to have a cleaning-at-development system in which the transfer residual toner present on the surface of the photosensitive drum 61*a* after the transfer step was removed and collected at the time of development by means of the magnetic brush of the two-component developer. At the time of development in the developing assembly 63*a,* the development contrast was set at 250 V, and fog-preventive reverse contrast at −150 V, to carry out development while applying to the developing sleeve the discontinuous AC voltage shown in FIG. 7.

Photosensitive Member No. 1

Photosensitive member No. 1 was an OPC photosensitive member making use of an organic photoconductive material for negative charging. On an aluminum cylinder of 30 mm diameter, the following five functional layers were formed as first to fifth layers.

The first layer is a conductive-particle dispersed resin layer of about 20 μm thick, provided in order to level any defects on the aluminum cylinder and also prevent moirés from being caused by the reflection of laser exposure light.

The second layer is a positive charge injection preventive layer (subbing layer), which is a medium resistance layer of about 1 μm thick, having the function to prevent the positive charges injected from the aluminum substrate, from cancelling the negative charges produced on the photosensitive member surface by charging, and having been adjusted to have a resistivity of about $10^6$ Ω•cm using 6-66-610-12 nylon and methoxymethylated nylon.

The third layer is a charge generation layer, which is a layer of about 0.3 μm thick, formed of a resin with a disazo pigment dispersed therein and generates positive and negative charge pairs upon exposure to laser light.

The fourth layer is a charge transport layer, which is formed of a polycarbonate resin with hydrazone particles dispersed therein and is a p-type semiconductor. Thus, the negative charges produced on the photosensitive member surface by charging can not move through this layer and only the positive charges generated in the charge generation layer can be transported to the photosensitive member surface.

The fifth layer is a charge injection layer, which is formed of a photocurable acrylic resin in which ultrafine $SnO_2$ particles and, in order to elongate the time of contact of the charging member with the photosensitive member to enable uniform charging, tetrafluoroethylene resin particles with a particle diameter of about 0.25 μm have been dispersed. Stated specifically, based on the weight of the resin, 160% by weight of oxygen-free type low-resistance $SnO_2$ particles with a particle diameter of about 0.03 μm and also 30% by weight of the tetrafluoroethylene resin particles and 1.2% by weight of a dispersant are dispersed.

The volume resistivity of the surface layer of the photosensitive member 1 thus obtained was as low as $6\times10^{11}$ Ω•cm, compared with that of the charge transport layer alone which was $5\times10^{15}$ Ω•cm.

Magnetic-brush Charging Assembly No. 1

5 parts of MgO, 8 parts of MnO, 4 parts of SrO and 83 parts of $Fe_2O^3$ were each made into fine particles, and thereafter water was added and mixed to effect granulation, followed by firing at 1,300° C. and then adjustment of particle size to obtain a ferrite carrier core with an average particle diameter of 28 μm (saturation magnetization: 63 $Am^2$/kg; coercive force: 55 oersteds).

The above carrier core was surface-treated with 10 parts of isopropoxytriisostearoyl titanate mixed in a mixed solvent of 99 parts of hexane and 1 part of water, so as to be 0.1 part in treatment quantity to obtain magnetic particles a.

Volume resistivity of the magnetic particles was measured in the same manner as the volume resistivity of the development carrier I to find that it was $3\times10^7$ Ω•cm. Weight loss on heating was 0.1 part.

The magnetic-brush charging assembly No. 1 was constituted of a conductive non-magnetic sleeve with a magnet roll built in its inside, and a magnetic brush formed by magnetically binding the above magnetic particles a on its surface, where the magnet roll was set stationary, and the conductive non-magnetic sleeve rotatable, at the time of charging.

In the above 30,000 sheet continuous copying test, evaluation was made on solid uniformity of initial-stage images, fog after 30,000 sheet running, running performance viewed from differences in image density between initial-stage images and images after 30,000 sheet running, and transfer performance at the initial stage and images after 30,000 sheet running. Environmental stability of the toner was also evaluated according to differences in quantity of triboelectricity of the toner between a low-humidity environment (20° C./10%RH) and a high-humidity environment (30° C./80%RH).

The results of evaluation were as shown in Table 3. Image density was stable, there were no problems on fog and transfer performance, and very good results were obtained.

Solid uniformity:

An original provided at five spots with circles of 20 mm in diameter, having an image density of 1.5 as measured with a reflection densitometer RD918 (manufactured by Macbeth Co.), was copied. Image density at image areas was measured with the reflection densitometer RD918 to determine differences between the maximum value and the minimum value in that measurement.

Image density:

An original provided with circles of 20 mm in diameter, having an image density of 1.5 as measured with a reflection densitometer RD918 (manufactured by Macbeth Co.), was copied. Image density at image areas was measured with the reflection densitometer RD918.

Fog quantity:

From the worst value (Ds) of reflection density measured at 10 points of non-image areas (white background) after image formation, an average value (Dr) of reflection density measured at 10 points on paper before image formation was subtracted. The value (Dr−Ds) obtained was regarded as fog quantity.

The reflection density was measured using REFLECTOMETER MODEL TC-6DS (manufactured by Tokyo Denshoku Co., Ltd.). Images with a fog quantity of 2% or less are good images substantially free of fog, and those with a fog quantity of more than 5% are unsharp images with conspicuous fog.

Transfer performance:

Solid images were developed on the photosensitive drum and the machine was stopped on the way of transfer. The toner on the photosensitive drum was collected with a Mylar tape, which was then fastened to a white-background area of transfer paper. The toner on the transfer paper was also fastened with the Mylar tape. Transfer performance (transfer efficiency) was calculated according to the following.

Transfer performance (%)=(Macbeth density on transfer paper/macbeth density on drum)×100

Figure 8:
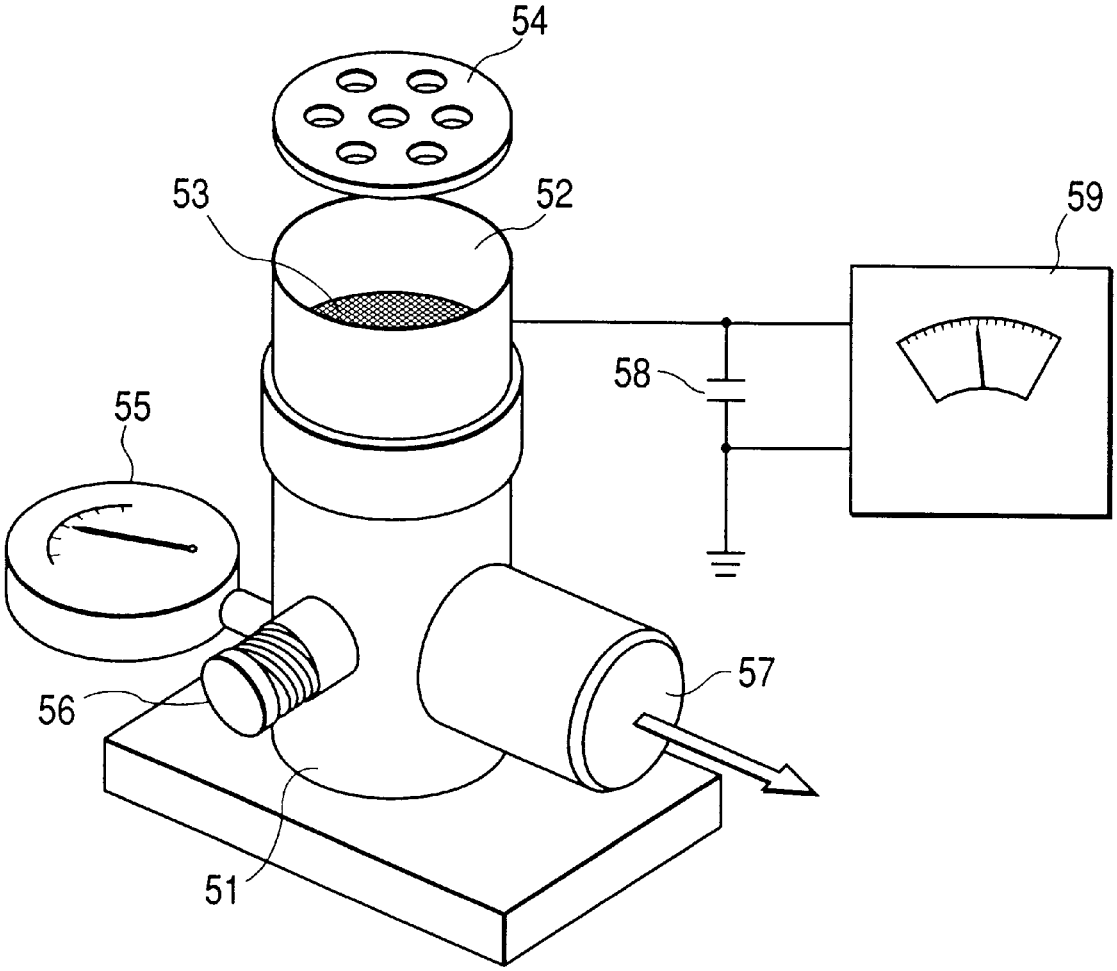
FIG. 8 illustrates a device used to measure quantity of triboelectricity.

Quantity of triboelectricity of toner:

Quantity of triboelectricity of the toner was measured in the following way, with a unit for measuring the quantity of triboelectricity, shown in FIG. 8.

First, about 0.5 to 1.5 g of a mixture prepared by mixing a toner for measurement and magnetic particles in a proportion of 1:19 (having been put in a polyethylene bottle of a 50 to 100 ml container and manually shaked for about 10 to 40 seconds) is put in a measuring container 52 made of a metal at the bottom of which is provided a screen 53 of 500 meshes, and the container is covered with a plate 54 made of a metal. The total weight of the measuring container 52 in this state is weighed and is expressed by $W_1$ (g). Next, in a suction device 51 (made of an insulating material at least at the part coming into contact with the measuring container 52), air is sucked from a suction opening 57 and an air-flow control valve 56 is operated to control the pressure indicated by a vacuum indicator 55 so as to be 250 mmAq. In this state, suction is sufficiently carried out preferably for about 2 minutes to remove the toner by suction. The electric potential indicated by a potentiometer 59 at this stage is expressed by V (volt). In FIG. 8, reference numeral 58 denotes a capacitor, whose capacitance is expressed by C (mF). The total weight of the measuring container after completion of the suction is also weighed and is expressed by $W_2$ (g). The quantity Q (mC/kg) of triboelectricity is calculated as shown by the following expression.

Quantity of triboelectricity of toner $$(mC/kg)=(C\times V)/(W_1-W_2)$$

(Measured under conditions of low humidity: 20° C./10%RH and high humidity: 30° C./80%RH.)

As the magnetic particles used in the measurement, the carrier constituting the two-component developer in combination with the toner was used.

Example 2

Suspension polymerization cyan toner 2 having physical properties as shown in Table 2 was produced in the same manner as in Example 1 except that the fine silica powder (1) used therein was replaced with fine silica powder (2) having a BET specific surface area of 40 $m^2/g$ and comprised of coalesced particles formed by coalescence of a plurality of primary particles having an average particle diameter of 60 m$\mu$m.

Using the above suspension polymerization cyan toner 2, two-component developer (2) (apparent density: 1.49; degree of compaction: 13%) was produced in the same manner as in Example 1. Evaluation was also made in the same manner as in Example 1.

The results of evaluation were as shown in Table 3. Although transfer performance became slightly low after 30,000 running, good results were obtained.

Comparative Example 1

| | |
|---|---|
| Polyester resin obtained by condensation of propoxylated bisphenol, fumaric acid and trimellitic acid | 100 parts |
| Phthalocyanine pigment | 4 parts |
| Aluminum compound of di-tert-butylsalicylic acid | 4 parts |
| Low-molecular-weight polypropylene | 4 parts |

The above materials were premixed using a Henschel mixer, and then melt-kneaded using a twin-screw extruder type kneading machine. After cooled, the kneaded product was crushed using a hammer mill to form coarse particles of about 1 to 2 mm in diameter, which were then finely pulverized using a fine grinding mill of an air-jet system. The finely pulverized product thus obtained was further classified to obtain a blue powder (toner particles) with a weight-average particle diameter of 6.0 $\mu$m, and fine titanium oxide powder (1) and fine silica powder (2) were externally added thereto in the same manner as in Example 2 to obtain pulverization cyan toner 3 having physical properties as shown in Table 2.

Using the above spherical-treated cyan toner 3, two-component developer (3) (apparent density: 1.37; degree of compaction: 21%) was produced in the same manner as in Example 1. Evaluation was also made in the same manner as in Example 1.

The results of evaluation were as shown in Table 3. No satisfactory results were obtained in respect of all of transfer performance, fog and image density.

Example 3

| | |
|---|---|
| Polyester resin obtained by condensation of propoxylated bisphenol, fumaric acid and trimellitic acid | 100 parts |
| Phthalocyanine pigment | 4 parts |
| Aluminum compound of di-tert-butylsalicylic acid | 4 parts |
| Low-molecular-weight polypropylene | 4 parts |

The above materials were premixed using a Henschel mixer, and then melt-kneaded using a twin-screw extruder type kneading machine. After cooled, the kneaded product was crushed using a hammer mill to form coarse particles of about 1 to 2 mm in diameter, which were then finely pulverized using a fine grinding mill of an air-jet system. The finely pulverized product thus obtained was further classified and thereafter treated by mechanical impact to make spherical. Thus, a blue powder (toner particles) with a weight-average particle diameter of 6.0 $\mu$m was obtained, and fine titanium oxide powder (1) and fine silica powder (2) were externally added thereto in the same manner as in Example 2 to obtain spherical-treated cyan toner 4 having physical properties as shown in Table 2.

Using the above spherical-treated cyan toner 4, two-component developer (4) (apparent density: 1.41; degree of compaction: 19%) was produced in the same manner as in Example 1. Evaluation was also made in the same manner as in Example 1.

The results of evaluation were as shown in Table 3. Although transfer performance became slightly low after 30,000 running, good results were obtained.

Example 4

| | |
|---|---|
| Polyester resin obtained by condensation of propoxylated bisphenol, fumaric acid and trimellitic acid | 100 parts |
| Phthalocyanine pigment | 4 parts |
| Aluminum compound of di-tert-butylsalicylic acid | 4 parts |
| Low-molecular-weight polypropylene | 4 parts |

The above materials were premixed using a Henschel mixer, and then melt-kneaded using a twin-screw extruder type kneading machine. After cooled, the kneaded product was crushed using a hammer mill to form coarse particles of about 1 to 2 mm in diameter, which were then finely pulverized using a fine grinding mill of an air-jet system. The finely pulverized product thus obtained was further classified and thereafter treated by hot air to make spherical. Thus, a blue powder (toner particles) with a weight-average particle diameter of 6.0 μm was obtained, and fine titanium oxide powder (1) and fine silica powder (2) were externally added thereto in the same manner as in Example 2 to obtain spherical-treated cyan toner 5 having physical properties as shown in Table 2.

Using the above spherical-treated cyan toner 5, two-component developer (5) (apparent density: 1.43; degree of compaction: 17%) was produced in the same manner as in Example 1. Evaluation was also made in the same manner as in Example 1.

The results of evaluation were as shown in Table 3. Although environmental stability was slightly low, good results were obtained.

Comparative Example 2

| | |
|---|---|
| Polyester resin obtained by condensation of propoxylated bisphenol, fumaric acid and trimellitic acid | 100 parts |
| Phthalocyanine pigment | 4 parts |
| Aluminum compound of di-tert-butylsalicylic acid | 4 parts |
| Low-molecular-weight polypropylene | 4 parts |

The above materials were premixed using a Henschel mixer, and then melt-kneaded using a twin-screw extruder type kneading machine. After cooled, the kneaded product was crushed using a hammer mill to form coarse particles of about 1 to 2 mm in diameter, which were then finely pulverized using a fine grinding mill of an air-jet system. The finely pulverized product thus obtained was further classified and thereafter treated in hot water bath to make spherical. Thus, a blue powder (toner particles) with a weight-average particle diameter of 6.0 μm was obtained, and fine titanium oxide powder (1) and fine silica powder (2) were externally added thereto in the same manner as in Example 2 to obtain spherical-treated cyan toner 6 having physical properties as shown in Table 2.

Using the above pulverization cyan toner 6, two-component developer (6) (apparent density: 1.89; degree of compaction: 9%) was produced in the same manner as in Example 1. Evaluation was also made in the same manner as in Example 1.

The results of evaluation were as shown in Table 3. Fog and image density were both unsatisfactory.

Comparative Example 3

Suspension polymerization cyan toner 7 having physical properties as shown in Table 2 was obtained in the same manner as in Example 1 except that the fine silica powder (1) used therein was not used and only the fine titanium oxide powder (1) was externally added in an amount of 2 parts based on 100 parts of the toner particles.

Using the above suspension polymerization cyan toner 7, two-component developer (7) (apparent density: 1.47; degree of compaction: 13%) was produced in the same manner as in Example 1. Evaluation was also made in the same manner as in Example 1.

The results of evaluation were as shown in Table 3. Transfer performance and image density were both unsatisfactory.

Comparative Example 4

Toner particles were obtained in the same manner as in Example 1 except that the calcium phosphate compound was formed by adding the aqueous 0.1M $Na_3PO_4$ solution and aqueous 1.0M $CaCl_2$ solution while maintaining the number of revolution of the Clear mixer at 6,000 rpm. As a result, colored suspension particles with a weight-average particle diameter of 7.1 μm in a broad particle size distribution were obtained. This particles were classified to obtain colored suspension particles (toner particles) with a weight-average particle diameter of 6.5 μm in a sharp particle size distribution, and fine titanium oxide powder (1) and fine silica powder (2) were externally added thereto in the same manner as in Example 2 to obtain suspension polymerization cyan toner 8 having physical properties as shown in Table 2.

Using the above suspension polymerization cyan toner 8, two-component developer (8) (apparent density: 1.40; degree of compaction: 21%) was produced in the same manner as in Example 1. Evaluation was also made in the same manner as in Example 1.

The results of evaluation were as shown in Table 3. The results similar to those in Comparative Example 1 were obtained. This is presumed to be due to substantially the same circularity distribution of the toner, though the toner production process is different.

Example 5

Suspension polymerization cyan toner 9 having physical properties as shown in Table 2 was produced in the same manner as in Example 2 except that the fine titanium oxide powder (1) used therein was replaced with anatase type fine titanium oxide powder (2) (volume resistivity: $2\times10^{10}$ Ω•cm; BET specific surface area: 92 $m^2/g$) having been treated with 10 parts of dimethylsilicone oil of 50 centipoises by dry treatment using a Henschel mixer.

Using the above suspension polymerization cyan toner 9, two-component developer (9) (apparent density: 1.43; degree of compaction: 14%) was produced in the same manner as in Example 1. Evaluation was also made in the same manner as in Example 1.

The results of evaluation were as shown in Table 3. Compared with those in Example 2, solid image density was slightly uneven presumably because of a smaller shape factor SF-1 of the fine titanium oxide powder, but good results were obtained.

Comparative Example 5

Suspension polymerization cyan toner 10 having physical properties as shown in Table 2 was produced in the same manner as in Example 1 except that the fine silica powder (1) used therein was replaced with fine silica powder (3) having a BET specific surface area of 26 $m^2/g$, having been treated with 10 parts of hexamethyldisilazane and 10 parts of dimethylsilicone oil of 50 centipoises, and comprised of coalesced particles formed by coalescence of a plurality of primary particles having an average particle diameter of 70 mμm.

Using the above suspension polymerization cyan toner 10, two-component developer (10) (apparent density: 1.40; degree of compaction: 21%) was produced in the same manner as in Example 1. Evaluation was also made in the same manner as in Example 1.

The results of evaluation were as shown in Table 3. Compared with those in Example 1, image density and fog were both unsatisfactory presumably because of a smaller shape factor SF-1 of the fine silica powder.

Example 6

Suspension polymerization cyan toner 11 having physical properties as shown in Table 2 was produced in the same manner as in Example 1 except that the quantity of the external additive used therein was so changed as to be 0.02 part in respect of the fine titanium oxide powder (1) and 1.0 part in respect of the fine silica powder (1).

Using the above suspension polymerization cyan toner 11, two-component developer (11) (apparent density: 1.40; degree of compaction: 22%) was produced in the same manner as in Example 1. Evaluation was also made in the same manner as in Example 1.

The results of evaluation were as shown in Table 3. Environmental stability, fog and image density were all at a low level, but on the level of no problem in practical use.

Example 7

Suspension polymerization cyan toner 12 having physical properties as shown in Table 2 was produced in the same manner as in Example 1 except that the quantity of the external additive used therein was so changed as to be 1.0 part in respect of the fine titanium oxide powder (1) and 2.0 parts in respect of the fine silica powder (1).

Using the above suspension polymerization cyan toner 12, two-component developer (12) (apparent density: 1.49; degree of compaction: 13%) was produced in the same manner as in Example 1. Evaluation was also made in the same manner as in Example 1.

The results of evaluation were as shown in Table 3. Environmental stability and fog were slightly low, but good results were obtained.

Example 8

Suspension polymerization cyan toner 13 having physical properties as shown in Table 2 was produced in the same manner as in Example 1 except that the fine silica powder (1) used therein was replaced with fine silica powder (4) the particle size distribution of which had been controlled by changing the conditions for the classification of the fine silica powder (1) to collect relatively fine particles.

Using the above suspension polymerization cyan toner 13, two-component developer (13) (apparent density: 1.52; degree of compaction: 17%) was produced in the same manner as in Example 1. Evaluation was also made in the same manner as in Example 1.

The results of evaluation were as shown in Table 3. Fog slightly occurred, but good results were obtained.

Example 9

Suspension polymerization cyan toner 14 having physical properties as shown in Table 2 was produced in the same manner as in Example 1 except that the fine silica powder (1) used therein was replaced with fine silica powder (5) the particle size distribution of which had been controlled by changing the conditions for the classification of the fine silica powder (1) so that the classification was repeated several times so as to be able to collect only coarser particles.

Using the above suspension polymerization cyan toner 14, two-component developer (14) (apparent density: 1.41; degree of compaction: 12%) was produced in the same manner as in Example 1. Evaluation was also made in the same manner as in Example 1.

The results of evaluation were as shown in Table 3. Solid image density was slightly low and transfer performance was also slightly low, but good results were obtained.

Comparative Example 6

Suspension polymerization cyan toner 15 having physical properties as shown in Table 2 was produced in the same manner as in Example 1 except that the fine titanium oxide powder (1) used therein was not used and only the fine silica powder (1) was externally added in an amount of 2 parts based on 100 parts of the toner particles.

Using the above suspension polymerization cyan toner 15, two-component developer (15) (apparent density: 1.41; degree of compaction: 12%) was produced in the same manner as in Example 1. Evaluation was also made in the same manner as in Example 1.

The results of evaluation were as shown in Table 3. Fog, image density and environmental stability were all unsatisfactory.

Example 10

Two-component developer (16) (apparent density: 1.88; degree of compaction: 11%) was produced in the same manner as in Example 1 except that the development carrier I used therein was replaced with the following development carrier II. Evaluation was also made in the same manner as in Example 1. As a result, fog slightly more occurred, but good results were obtained.

This is presumably because the carrier material was changed to ferrite and the mixing performance of the replenishing toner was slightly low because of its gravity.

Production of Development Carrier II 8 parts of MgO, 5 parts of MnO and 87 parts of $Fe_2O^3$ were each made into fine particles having particle diameter of not more than 0.1 $\mu$m, and thereafter water was added and mixed to uniformly mix them, and the mixture obtained was granulated by spray drying to have an average particle diameter of 35 $\mu$m, followed by firing at 1,200° C. and then removal of coarse powder and fine powder to obtain a ferrite carrier core. The ferrite carrier core thus obtained was used in place of the magnetic particle inclusion spherical magnetic resin carrier core used in Production of Development Carrier I and was surface-coated in the same manner as in Production of Development Carrier I. Thus, development carrier II was obtained, having a volume resistivity of $2\times10^{12}$ Ω•cm, a saturation magnetization of 37 $Am^2$/kg and a coercive force of 5 oersteds).

Example 11

Two-component developer (17) (apparent density: 1.51; degree of compaction: 14%) was produced in the same manner as in Example 1 except that the development carrier I used therein was replaced with the following development carrier III. Evaluation was also made in the same manner as in Example 1. As a result, solid image uniformity became a little lower at the stage of 30,000th sheet, but on the level of no problem in practical use. This is presumably because the development carrier had so high magnetic properties as to slightly damage the toner in the development zone to affect the developing performance.

Production of Development Carrier III

Development carrier III was produced in the same manner as in Production of Development Carrier I except that the quantity of the magnetite particles used was changed from 600 parts to 100 parts.

The development carrier III thus obtained had a volume resistivity of $8\times10^{11}$ Ω•cm, a saturation magnetization of 65 $Am^2$/kg and a coercive force of 78 oersteds.

Example 12

Example 2 was repeated except that the developing sleeve was rotated in the same direction as the photosensitive drum. As a result, solid image density was slightly uneven, but good results were obtained.

This is presumably because the change of the rotation of the developing sleeve made it difficult to balance the stripping of developer after development and the surface coating of fresh developer, resulting in a little unstable control of toner concentration.

Example 13

Suspension polymerization yellow toner 16, suspension polymerization magenta toner 17 and suspension polymerization black toner 18 were produced in the same manner as the suspension polymerization cyan toner 1 of Example 1 except that the C.I. Pigment Blue 15:3 used was replaced with C.I. Pigment Yellow 93, a quinacridone pigment and carbon black, respectively.

Using the above suspension polymerization yellow toner 16, suspension polymerization magenta toner 17 and suspension polymerization black toner 18, two-component yellow developer (18), two-component magenta developer (19) and two-component black developer (20), respectively, were produced in the same manner as in Example 2.

Four color two-component developers consisting of the above three color two-component developers and the two-component developer (1) used in Example 1 were used in the image forming apparatus shown in FIG. 1, to form toner images in the color order of yellow, magenta, cyan and black, without use of any cleaning unit. The toner images were successively multiple-transferred onto a transfer medium, a recording medium, to form full-color images continuously on 30,000 sheets. As a result, image density changed only a little and good results were obtained without any fog.

Synthesis Example 1

| | |
|---|---|
| Styrene | 125 parts |
| Methyl methacrylate | 35 parts |
| n-Butyl acrylate | 40 parts |
| Copper phthalocyanine pigment | 14 parts |
| Di-tert-butylsalicylic acid aluminum compound | 3 parts |
| Saturated polyester (acid value: 10; peak molecular weight: 9,100) | 10 parts |
| Ester wax (Mw: 450; Mn: 400; Mw/Mn: 1.13; melting point: 68° C.; viscosity: 6.1 mPa · s; Vickers hardness: 1.2; SP value: 8.3) | 40 parts |

Materials formulated as above were heated to 60° C., followed by uniform dissolution and dispersion at 10,000 rpm using a TK-type homomixer (manufactured by Tokushu Kika Kogyo Co., Ltd.). In the mixture obtained, 10 parts of a polymerization initiator 2,2'-azobis(2,4-dimethylvaleronitrile) was dissolved. Thus, a polymerizable monomer composition was prepared.

Separately, in 710 g of ion-exchanged water, 450 parts of an aqueous 0.1M $Na_3PO_4$ solution was introduced, followed by heating to 60° C. and then stirring at 1,300 rpm using a TK-type homomixer (manufactured by Tokushu Kika Kogyo Co., Ltd.). To the resultant mixture, 68 parts of an aqueous 1.0M $CaCl_2$ solution was added little by little to obtain an aqueous medium containing $Ca_3(PO_{4)2}$.

The above polymerizable monomer composition was introduced in the above aqueous medium, followed by further addition of 2 parts of polyethylene and then stirring at 60° C. in an atmosphere of nitrogen, using a Clear mixer at 12,000 rpm for 20 minutes to granulate the polymerizable monomer composition. Thereafter, its temperature was raised to 80° C. while stirring the aqueous medium with a paddle agitating blade, and the polymerization reaction was carried out for 8 hours.

After the polymerization was completed, the reaction system was cooled, and thereafter hydrochloric acid was added thereto to dissolve the calcium phosphate, followed by filtration, washing with water and then drying to obtain polymerization particles (polymerization toner particles) A. The polymerization toner particles A had a shape factor SF-1 of 115.

Synthesis Example 2

| | |
|---|---|
| Styrene | 170 parts |
| 2-Ethylhexyl acrylate | 30 parts |
| Quinacridone pigment | 15 parts |
| Di-tert-butylsalicylic acid chromium compound | 3 parts |
| Saturated polyester (acid value: 10; peak molecular weight: 9,100) | 10 parts |
| Ester wax (Mw: 450; Mn: 400; Mw/Mn: 1.25; melting point: 70° C.; viscosity: 6.5 mPa · s; Vickers hardness: 1.1; SP value: 8.6) | 40 parts |

Materials formulated as above were treated in the same manner as in Synthesis Example 1 to prepare a polymerizable monomer composition, which was then put into the aqueous medium prepared in Synthesis Example 1 and the subsequent procedure was repeated to obtain polymerization particles (polymerization toner particles) B.

Synthesis Example 3

| | |
|---|---|
| Styrene | 170 parts |
| 2-Ethylhexyl acrylate | 30 parts |
| Carbon black | 15 parts |
| Di-tert-butylsalicylic acid chromium compound | 3 parts |
| Saturated polyester (acid value: 10; peak molecular weight: 9,100) | 10 parts |
| Ester wax (Mw: 500; Mn: 400; Mw/Mn: 1.25; melting point: 70° C.; viscosity: 6.5 mPa · s; Vickers hardness: 1.1; SP value: 8.6) | 40 parts |

Materials formulated as above were treated in the same manner as in Synthesis Example 1 to prepare a polymerizable monomer composition, which was then put into the aqueous medium prepared in Synthesis Example 1 and the subsequent procedure was repeated to obtain polymerization particles (polymerization toner particles) C.

Synthesis Example 4

| | |
|---|---|
| Styrene | 170 parts |
| n-Butyl acrylate | 30 parts |
| C.I. Pigment Yellow 93 | 15 parts |
| Di-tert-butylsalicylic acid chromium compound | 3 parts |
| Saturated polyester (acid value: 10; peak molecular weight: 9,100) | 10 parts |
| Diester wax (Mw: 480; Mn: 410; Mw/Mn: 1.17; melting point: 73° C.; viscosity: 10.5 mPa · s; Vickers hardness: 1.0; SP value: 9.1) | 30 parts |

Materials formulated as above were treated in the same manner as in Synthesis Example 1 to prepare a polymerizable monomer composition, which was then put into the aqueous medium prepared in Synthesis Example 1, followed by stirring at 60° C. in an atmosphere of nitrogen, using the Clear mixer at 12,000 rpm for 20 minutes to granulate the polymerizable monomer composition. Thereafter, its temperature was raised to 80° C. while stirring the aqueous medium with a paddle agitating blade, and the polymerization reaction was carried out for 10 hours.

After the polymerization was completed, the reaction system was cooled, and thereafter hydrochloric acid was added thereto to dissolve the calcium phosphate, followed by filtration, washing with water and then drying to obtain polymerization particles (polymerization toner particles) D.

Synthesis Example 5

| | |
|---|---|
| Styrene | 170 parts |
| n-Butyl acrylate | 30 parts |
| Quinacridone pigment | 15 parts |
| Di-tert-butylsalicylic acid chromium compound | 3 parts |
| Saturated polyester (acid value: 10; peak molecular weight: 9,100) | 10 parts |
| Paraffin wax (Mw: 3,390; Mn: 2,254; Mw/Mn: 1.50; melting point: 72° C.; viscosity: 6.3 mPa · s; Vickers hardness: 6.8; SP value: 8.7) | 30 parts |

Materials formulated as above were treated in the same manner as in Synthesis Example 1 to prepare a polymerizable monomer composition, which was then put into the aqueous medium prepared in Synthesis Example 1 and the subsequent procedure was repeated to obtain polymerization particles (polymerization toner particles) E.

Synthesis Example 6

| | |
|---|---|
| Styrene | 170 parts |
| 2-Ethylhexyl acrylate | 30 parts |
| Carbon black | 15 parts |
| Monoazo iron complex | 3 parts |
| Saturated polyester (acid value: 10; peak molecular weight: 9,100) | 10 parts |
| Paraffin wax (Mw: 570; Mn: 380; Mw/Mn: 1.50; melting point: 69° C.; viscosity: 6.8 mPa · s; Vickers hardness: 0.7; SP value: 8.3) | 30 parts |

Materials formulated as above were treated in the same manner as in Synthesis Example 1 to prepare a polymerizable monomer composition, which was then put into the aqueous medium prepared in Synthesis Example 1 and the subsequent procedure was repeated without adding polyethylene to obtain polymerization particles (polymerization toner particles) F.

Synthesis Example 7

A polymerizable monomer composition was prepared and polymerization particles (polymerization toner particles) G was obtained, in the same manner as in Synthesis Example 1 except that the polar resin saturated polyester was not used.

Synthesis Example 8

| | |
|---|---|
| Polyester resin | 100 parts |
| Copper phthalocyanine pigment | 4 parts |
| Di-tert-butylsalicylic acid aluminum compound | 5 parts |
| Paraffin wax (Mw: 3,390; Mn: 2,254; Mw/Mn: 1.5; melting point: 72° C.; viscosity: 6.3 mPa · s; Vickers hardness: 6.8; SP value: 8.7) | 5 parts |

The above materials were premixed using a Henschel mixer, and then melt-kneaded using a twin-screw extruder type kneading machine. After cooled, the kneaded product was crushed using a hammer mill to form coarse particles of about 1 to 2 mm in diameter, which were then finely pulverized using a fine grinding mill of an air-jet system. The finely pulverized product thus obtained was further classified to obtain pulverization toner particles H.

The polymerization toner particles A to G and pulverization toner particles H in the foregoing Synthesis Examples 1 to 8 had the value of shape factor SF-1 as shown in Table 4.

Example 14

To 100 parts of the polymerization toner particles A obtained in Synthesis Example 1, 1.0 part of fine alumina powder (A) having a BET specific surface area of 145 $m^2/g$, having been treated with 15 parts of isobutyltrimethoxysilane, and 1.0 part of non-spherical fine silica powder (A) having a BET specific surface area of 68 $m^2/g$ were externally added to obtain suspension polymerization toner (A) with a weight-average particle diameter of 6.8 $\mu$m.

The above fine silica powder (A) was a product obtained by surface-treating 100 parts of commercially available finer silica particles AEROSIL #50 (available from Nippon Aerosil Co., Ltd.) with 10 parts of hexamethyldisilazane, followed by classification to collect relatively coarse particles using an air classifier to control their particle size distribution. On a photograph of 100,000 magnifications taken with a transmission electron microscope (TEM) and a photograph of 30,000 magnifications taken with a scanning electron microscope (SEM), the fine silica powder (A) was confirmed to be particles formed by coalescence of a plurality of primary particles having an average particle diameter of 38 m$\mu$m.

The fine alumina powder (A) present on the toner particles of the suspension polymerization toner (A) had a shape factor SF-1 of 118, the fine silica powder (A) also present thereon had a shape factor SF-1 of 155.

On a photograph of 100,000 magnifications of the suspension polymerization toner (A), taken with a scanning electron microscope, the fine alumina powder (A) was confirmed to have an average length of 10 m$\mu$m, a length/breadth ratio of 1.1 and to be present in the number of at least 90 particles per unit area of 0.5 $\mu$m ×0.5 $\mu$m. On a photograph of 30,000 magnifications of the suspension polymerization toner (A), taken with a scanning electron microscope, the fine silica powder (A) was confirmed to have an average length of 150 m$\mu$m, a length/breadth ratio of 1.9 and to be present in the number of 19 particles per unit area of 1.0 $\mu$m×1.0 $\mu$m.

The above suspension polymerization toner (A) and a ferrite coated carrier (a carrier obtained by coating the surfaces of Mg-Mn ferrite core particles with a silicone resin in a layer thickness of 0.5 μm, and having a weight-average particle diameter of 35 μm) were blended in a weight ratio of 7:100 to produce a two-component developer (A).

The above two-component developer (A) was applied in a developing assembly of a modified machine of a digital copying machine (GP-55, manufactured by Canon), as an electrophotographic apparatus, which was so modified as to be able to use the two-component developing assembly and magnetic-brush charging assembly shown in FIG. 6, and images were formed by developing binary electrostatic latent images of 300 dpi by the use of the two-component developer (A) while applying a development bias formed by superimposing the discontinuous alternating voltage shown in FIG. 7.

In this electrophotographic apparatus, the magnetic-brush charging assembly is an assembly in which magnetic particles comprised of Cu-Zn-ferrite, having an average particle diameter of 25 μm and composition represented by $(Fe_2O_3)_2$.3:(CuO)1:(ZnO)1 are magnetically bound by a non-magnetic sleeve internally having a magnet roll to form a magnetic brush and this magnetic brush is brought into contact with the photosensitive drum surface, where a charging bias of −700 V DC and 1 kHz/1.2 kvpp AC is applied to carry out primary charging.

In the magnetic-brush charging assembly, if the magnetic brush is kept fixed, the nip between the magnetic brush and the photosensitive drum tends to become not maintainable to cause faulty charging when the magnetic brush is pushed away upon deflection or eccentric motion of the photosensitive drum, because the magnetic brush itself has no physical power of restoration. Accordingly, it is preferable to apply an always fresh magnetic brush face. Hence, in the present Example, the magnetic brush was set rotatable in the direction opposite to the movement direction of the photosensitive drum surface at a speed twice the peripheral speed of the photosensitive drum.

Images were formed in an environment of 23° C./65%RH to make a continuous 50,000 sheet running test. Evaluation was made on solid uniformity of initial-stage images, fog after 50,000 sheet running, running performance viewed from differences in image density between initial-stage images and images after 50,000 sheet running, transfer performance at the initial stage and images after 50,000 sheet running, and environmental stability viewed from differences in quantity of triboelectricity of the toner between a low-humidity environment (20° C./10%RH) and a high-humidity environment (30° C./80%RH).

Physical properties of the suspension polymerization toner (A) are shown in Table 4, and the results of evaluation in Table 5.

Comparative Example 7

Two-component developer (B) was produced in the same manner as in Example 14 except that the suspension polymerization toner (A) used therein was replaced with pulverization toner (B) having a weight-average particle diameter of 6.5 μm, in which, as shown in Table 4, 1.0 part of siloxane-treated fine alumina powder (B) having a BET specific surface area of 72 $m^2/g$ and 1.0 part of fine silica powder (B) having a BET specific surface area of 66 $m^2/g$ were externally added to 100 parts of the pulverization toner particles H produced in Synthesis Example 8. Evaluation was also made in the same manner as in Example 14.

Physical properties of the pulverization toner (B) are shown in Table 4, and the results of evaluation in Table 5.

Example 15

Two-component developer (C) was produced in the same manner as in Example 14 except that the suspension polymerization toner (A) used therein was replaced with suspension polymerization toner (C) having a weight-average particle diameter of 6.6 μm, in which, as shown in Table 4, 1.0 part of alkylalkoxysilane-treated fine alumina powder (C) having a BET specific surface area of 120 $m^2/g$ and 1.0 part of fine silica powder (C) having a BET specific surface area of 68 $m^2/g$ were externally added to 100 parts of the polymerization toner particles B produced in Synthesis Example 2. Evaluation was also made in the same manner as in Example 14.

Physical properties of the suspension polymerization toner (C) are shown in Table 4, and the results of evaluation in Table 5.

Example 16

Two-component developer (D) was produced in the same manner as in Example 14 except that the suspension polymerization toner (A) used therein was replaced with suspension polymerization toner (D) having a weight-average particle diameter of 6.6 μm, in which, as shown in Table 4, 1.0 part of alkylalkoxysilane-treated fine alumina powder (D) having a BET specific surface area of 140 $m^2/g$ and 1.0 part of fine silica powder (D) having a BET specific surface area of 22 $m^2/g$ were externally added to 100 parts of the polymerization toner particles C produced in Synthesis Example 3. Evaluation was also made in the same manner as in Example 14.

Physical properties of the suspension polymerization toner (D) are shown in Table 4, and the results of evaluation in Table 5.

Example 17

Two-component developer (E) was produced in the same manner as in Example 14 except that the suspension polymerization toner (A) used therein was replaced with suspension polymerization toner (E) having a weight-average particle diameter of 7.1 μm, in which, as shown in Table 4, 1.0 part of silicon-oil-treated fine alumina powder (E) having a BET specific surface area of 66 $m^2/g$ and 1.0 part of fine silica powder (E) having a BET specific surface area of 23 $m^2/g$ were externally added to 100 parts of the polymerization toner particles D produced in Synthesis Example 4. Evaluation was also made in the same manner as in Example 14.

Physical properties of the suspension polymerization toner (E) are shown in Table 4, and the results of evaluation in Table 5.

Example 18

Two-component developer (F) was produced in the same manner as in Example 14 except that the suspension polymerization toner (A) used therein was replaced with suspension polymerization toner (F) having a weight-average particle diameter of 6.8 μm, in which, as shown in Table 4, 1.0 part of silicon-oil-treated fine alumina powder (F) having a BET specific surface area of 68 $m^2/g$ and 1.0 part of fine silica powder (F) having a BET specific surface area of 71 $m^2/g$ were externally added to 100 parts of the polymerization toner particles D produced in Synthesis Example 4. Evaluation was also made in the same manner as in Example 14.

Physical properties of the suspension polymerization toner (F) are shown in Table 4, and the results of evaluation in Table 5.

Comparative Example 8

Two-component developer (G) was produced in the same manner as in Example 14 except that the suspension polymerization toner (A) used therein was replaced with suspension polymerization toner (G) having a weight-average particle diameter of 7.2 μm, in which, as shown in Table 4, 1.0 part of alkylalkoxysilane-treated fine alumina powder (G) having a BET specific surface area of 210 $m^2/g$ and 1.0 part of fine silica powder (G) having a BET specific surface area of 25 $m^2/g$ were externally added to 100 parts of the suspension polymerization toner particles C produced in Synthesis Example 3. Evaluation was also made in the same manner as in Example 14.

Physical properties of the suspension polymerization toner (G) are shown in Table 4, and the results of evaluation in Table 5.

Comparative Example 9

Two-component developer (H) was produced in the same manner as in Example 14 except that the suspension polymerization toner (A) used therein was replaced with suspension polymerization toner (H) having a weight-average particle diameter of 9.5 μm, in which, as shown in Table 4, 1.0 part of alkylalkoxysilane-treated fine alumina powder (H) having a BET specific surface area of 147 $m^2/g$ and 1.0 part of fine silica powder (H) having a BET specific surface area of 13 $m^2/g$ were externally added to 100 parts of the suspension polymerization toner particles C produced in Synthesis Example 3. Evaluation was also made in the same manner as in Example 14.

Physical properties of the suspension polymerization toner (H) are shown in Table 4, and the results of evaluation in Table 5.

Comparative Example 10

Two-component developer (I) was produced in the same manner as in Example 14 except that the suspension polymerization toner (A) used therein was replaced with suspension polymerization toner (I) having a weight-average particle diameter of 6.1 μm, in which, as shown in Table 4, 1.5 parts of fine silica powder (I) having a BET specific surface area of 151 $m^2/g$ were externally added alone to 100 parts of the suspension polymerization toner particles B produced in Synthesis Example 2. Evaluation was also made in the same manner as in Example 14.

Physical properties of the suspension polymerization toner (I) are shown in Table 4, and the results of evaluation in Table 5.

Comparative Example 11

Two-component developer (J) was produced in the same manner as in Example 14 except that the suspension polymerization toner (A) used therein was replaced with suspension polymerization toner (J) having a weight-average particle diameter of 6.1 μm, in which, as shown in Table 4, 1.5 parts of silicon-oil-treated fine alumina powder (I) having a BET specific surface area of 150 $m^2/g$ were externally added alone to 100 parts of the suspension polymerization toner particles B produced in Synthesis Example 2. Evaluation was also made in the same manner as in Example 14.

Physical properties of the suspension polymerization toner (J) are shown in Table 4, and the results of evaluation in Table 5.

Example 19

Two-component developer (K) was produced in the same manner as in Example 14 except that the suspension polymerization toner (A) used therein was replaced with suspension polymerization toner (K) having a weight-average particle diameter of 6.7 μm, in which, as shown in Table 4, 1.0 part of siloxane-treated fine alumina powder (J) having a BET specific surface area of 122 $m^2/g$ and 1.0 part of fine silica powder (J) having a BET specific surface area of 22 $m^2/g$ were externally added to 100 parts of the polymerization toner particles E produced in Synthesis Example 5. Evaluation was also made in the same manner as in Example 14.

Physical properties of the suspension polymerization toner (K) are shown in Table 4, and the results of evaluation in Table 5.

Example 20

Two-component developer (L) was produced in the same manner as in Example 14 except that the suspension polymerization toner (A) used therein was replaced with suspension polymerization toner (L) having a weight-average particle diameter of 6.4 μm, in which, as shown in Table 4, 1.0 part of alkylalkoxysilane-treated fine alumina powder (A) having a BET specific surface area of 145 $m^2/g$ and 1.0 part of fine silica powder (A) having a BET specific surface area of 68 $m^2/g$ were externally added to 100 parts of the polymerization toner particles G produced in Synthesis Example 7. Evaluation was also made in the same manner as in Example 14.

Physical properties of the suspension polymerization toner (L) are shown in Table 4, and the results of evaluation in Table 5.

Example 21

Two-component developer (M) was produced in the same manner as in Example 14 except that the suspension polymerization toner (A) used therein was replaced with suspension polymerization toner (M) having a weight-average particle diameter of 6.4 μm, in which, as shown in Table 4, 1.0 part of fine alumina powder (K) having a BET specific surface area of 74 $m^2/g$ not hydrophobic-treated and 1.0 part of fine silica powder (K) having a BET specific surface area of 67 $m^2/g$ were externally added to 100 parts of the polymerization toner particles F produced in Synthesis Example 6. Evaluation was also made in the same manner as in Example 14.

Physical properties of the suspension polymerization toner (M) are shown in Table 4, and the results of evaluation in Table 5.

Example 22

The two-component developer (C) having the suspension polymerization toner (C) produced in Example 15 was applied in the developing assembly 36 of the image forming apparatus shown in FIG. 4, and magenta monochromatic images were continuously formed on 50,000 sheets. Evaluation was made in the same manner as in Example 14.

The results of evaluation are shown in Table 6.

Example 23

The two-component developer (D) having the suspension polymerization toner (D) produced in Example 16 was applied in the developing assembly 107 of the image forming apparatus shown in FIG. 5, and black monochromatic images were continuously formed on 50,000 sheets. Evaluation was made in the same manner as in Example 14.

The results of evaluation are shown in Table 6.

Example 24

Figure 3:
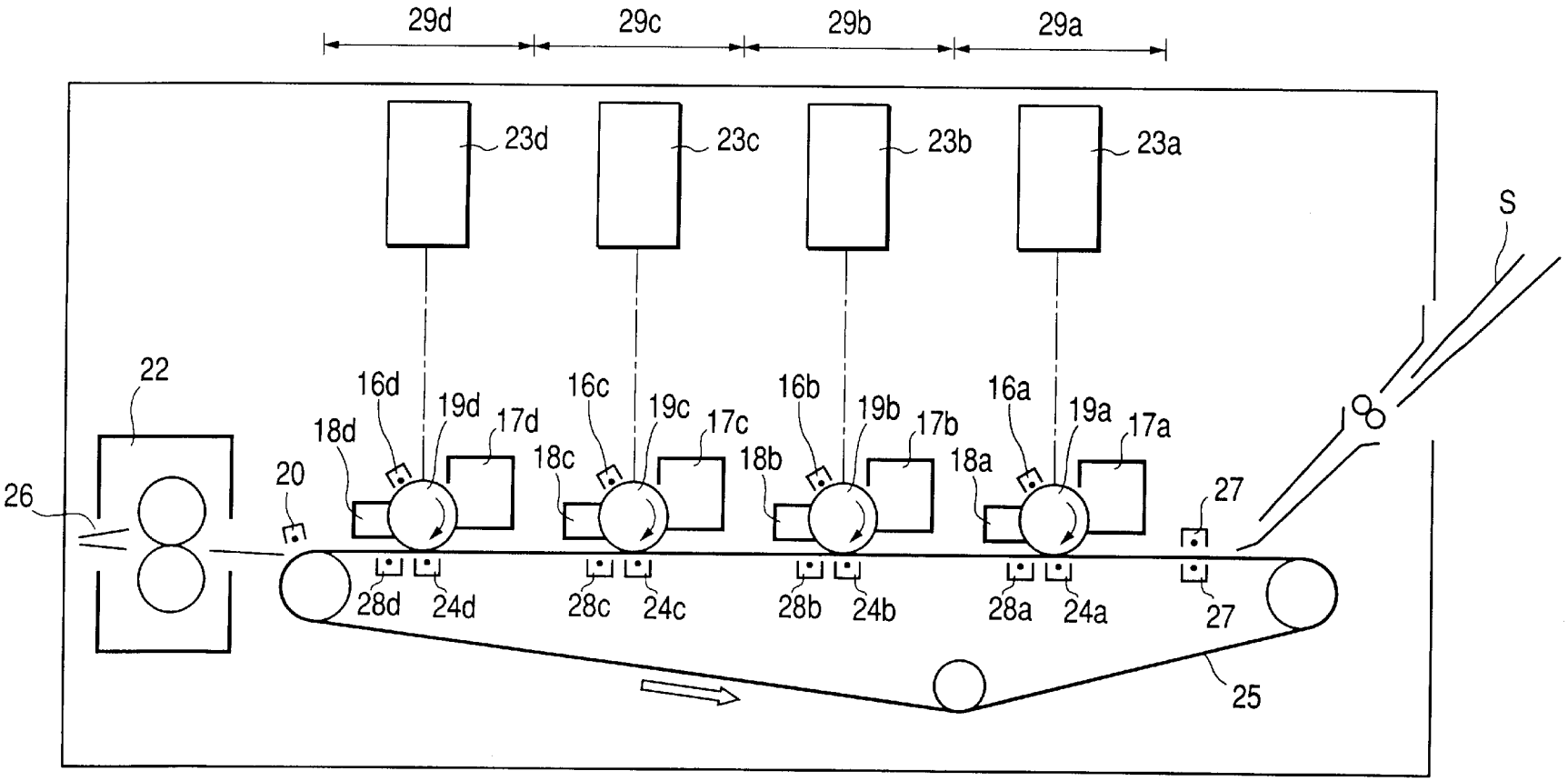
FIG. 3 schematically illustrates still another example of an image forming apparatus that can carry out the image forming method of the present invention.

The two-component developer (E) having the suspension polymerization toner (E) produced in Example 17 was applied in the developing assembly 29*d* of the image forming apparatus shown in FIG. 3, and yellow monochromatic images were continuously formed on 50,000 sheets. Evaluation was made in the same manner as in Example 14.

The results of evaluation are shown in Table 6.

Example 25

The two-component developer (F) having the suspension polymerization toner (F) produced in Example 18 was applied in the developing assembly 34 of the image forming apparatus shown in FIG. 4, and yellow monochromatic images were continuously formed on 50,000 sheets. Evaluation was made in the same manner as in Example 14.

The results of evaluation are shown in Table 6.

Comparative Example 12

The two-component developer (G) having the suspension polymerization toner (G) produced in Comparative Example 8 was applied in the developing assembly 37 of the image forming apparatus shown in FIG. 4, and black monochromatic images were continuously formed on 50,000 sheets. Evaluation was made in the same manner as in Example 14.

The results of evaluation are shown in Table 6.

Comparative Example 13

The two-component developer (I) having the suspension polymerization toner (I) produced in Comparative Example 10 was applied in the developing assembly 105 of the image forming apparatus shown in FIG. 5, and magenta monochromatic images were continuously formed on 50,000 sheets. Evaluation was made in the same manner as in Example 14.

The results of evaluation are shown in Table 6.

Comparative Example 14

The two-component developer (J) having the suspension polymerization toner (J) produced in Comparative Example 11 was applied in the developing assembly 17*b* of the image forming apparatus shown in FIG. 3, and magenta monochromatic images were continuously formed on 50,000 sheets. Evaluation was made in the same manner as in Example 14.

The results of evaluation are shown in Table 6.

Example 26

The two-component developer (K) having the suspension polymerization toner (K) produced in Example 19 was applied in the developing assembly 36 of the image forming apparatus shown in FIG. 4, and magenta monochromatic images were continuously formed on 50,000 sheets. Evaluation was made in the same manner as in Example 14.

The results of evaluation are shown in Table 6.

Example 27

The two-component developer (L) having the suspension polymerization toner (L) produced in Example 20 was applied in the developing assembly 17*c* of the image forming apparatus shown in FIG. 3, and cyan monochromatic images were continuously formed on 50,000 sheets. Evaluation was made in the same manner as in Example 14.

The results of evaluation are shown in Table 6.

Example 28

Evaluation was made in the same manner as in Example 14 except that the magnetic particles of the magnetic-brush charging assembly used therein were replaced with those having an average particle diameter of 150 $\mu$m. As a result, compared with Example 14, solid images were formed in a slightly low uniformity.

Example 29

Using the suspension polymerization toner particles A produced in Synthesis Example 1, the suspension polymerization toner particles B produced in Synthesis Example 2, the suspension polymerization toner particles C produced in Synthesis Example 3 and the suspension polymerization toner particles D produced in Synthesis Example 4, 1.0 part of silicon-oil-treated fine alumina powder (E) having a BET specific surface area of 66 $m^2/g$ and 1.0 part of fine silica powder (E) having a BET specific surface area of 23 $m^2/g$ as shown in Table 4 were externally added to 100 parts of each of the polymerization toner particles A to D to produce suspension polymerization cyan toner (N), suspension polymerization magenta toner (0), suspension polymerization black toner (P) and suspension polymerization yellow toner (Q), respectively.

The above four color toners were each mixed with the ferrite coated carrier used in Example 14 in a weight ratio of 7:100 to produce two-component developers (N) to (Q), respectively. These two-component developers were applied in the developing assemblies 4 to 7 of the image forming apparatus shown in FIG. 2, in such a way that latent images are developed in the color order of yellow, magenta, cyan and black. Thus, monochromatic images and full-color images were formed.

With regard to the formation of full-color images, those formed of multiple toner layers showed a sufficient color-mixing performance and a superior chroma and also had a high image quality. With regard to the formation of respective monochromatic images, evaluation was made in the same manner as in Example 14. As a result, as shown in Table 7, good results were obtained.

TABLE 2

| | Toner | | | |
|---|---|---|---|---|
| | | | Circularity distribution | |
| | Toner No. | Weight-average particle diameter (μm) | Average circularity | Content of particles with circularity of less than 0.950 (% by number) |
| Example: | | | | |
| 1 | Suspension polymerization cyan toner 1 | 6.1 | 0.983 | 11 |
| 2 | Suspension polymerization cyan toner 2 | 6.1 | 0.983 | 11 |
| Comparative Example: | | | | |
| 1 | Pulverization cyan toner 3 | 6.0 | 0.913 | 42 |
| Example: | | | | |
| 3 | Spherical-treated cyan toner 4 | 6.0 | 0.925 | 31 |
| 4 | Spherical-treated cyan toner 5 | 6.0 | 0.953 | 21 |
| Comparative Example: | | | | |
| 2 | Spherical-treated cyan toner 6 | 6.0 | 0.996 | 1.5 |
| 3 | Suspension polymerization cyan toner 7 | 6.1 | 0.984 | 11 |
| 4 | Suspension polymerization cyan toner 8 | 6.5 | 0.927 | 43 |
| Example: | | | | |
| 5 | Suspension polymerization cyan toner 9 | 6.1 | 0.983 | 12 |
| Comparative Example: | | | | |
| 5 | Suspension polymerization cyan toner 10 | 6.1 | 0.983 | 12 |
| Example: | | | | |
| 6 | Suspension polymerization cyan toner 11 | 6.1 | 0.983 | 11 |
| 7 | Suspension polymerization cyan toner 12 | 6.1 | 0.983 | 11 |
| 8 | Suspension polymerization cyan toner 13 | 6.1 | 0.983 | 11 |
| 9 | Suspension polymerization cyan toner 14 | 6.1 | 0.983 | 11 |
| Comparative Example: | | | | |
| 6 | Suspension polymerization cyan toner 15 | 6.1 | 0.983 | 11 |

| | External additive | | | | | | | | | | | | | |
|---|---|---|---|---|---|---|---|---|---|---|---|---|---|---|
| | Inorganic fine powder (A) | | | | | | | Inorganic fine powder (B) | | | | | | |
| | | | | Physical properties of external additive* | | | | | | | Physical properties of external additive* | | | |
| | Type | Content (pbw) | BET specific surface area ($m^2/g$) | Shape factor SF-1 | L/B | Average length (mμm) | (N) | Type | Content (pbw) | BET specific surface area ($m^2/g$) | Shape factor SF-1 | L/B | Average length (mμm) | (N') |
| Example: | | | | | | | | | | | | | | |
| 1 | FTP(1) | 1.0 | 100 | 120 | 1.1 | 50 | 75 | FSP(1) | 1.0 | 43 | 195 | 2.8 | 178 | 17 |
| 2 | FTP(1) | 1.0 | 100 | 120 | 1.1 | 50 | 75 | FSP(2) | 1.0 | 40 | 160 | 2.1 | 160 | 15 |
| Comparative Example: | | | | | | | | | | | | | | |
| 1 | FTP(1) | 1.0 | 100 | 120 | 1.1 | 50 | 72 | FSP(2) | 1.0 | 40 | 160 | 2.1 | 160 | 13 |
| Example: | | | | | | | | | | | | | | |
| 3 | FTP(1) | 1.0 | 100 | 120 | 1.1 | 50 | 70 | FSP(2) | 1.0 | 40 | 160 | 2.1 | 160 | 14 |
| 4 | FTP(1) | 1.0 | 100 | 120 | 1.1 | 50 | 73 | FSP(2) | 1.0 | 40 | 160 | 2.1 | 160 | 15 |
| Comparative Example | | | | | | | | | | | | | | |
| 2 | FTP(1) | 1.0 | 160 | 120 | 1.1 | 50 | 75 | FSP(2) | 1.0 | 40 | 160 | 2.1 | 160 | 16 |
| 3 | FTP(1) | 2.0 | 100 | 120 | 1.1 | 50 | 138 | — | — | — | — | — | — | — |
| 4 | FTP(1) | 1.0 | 100 | 120 | 1.1 | 50 | 74 | FSP(2) | 1.0 | 40 | 160 | 2.1 | 160 | 15 |
| Example: | | | | | | | | | | | | | | |
| 5 | FTP(2) | 1.0 | 92 | 128 | 1.3 | 50 | 68 | FSP(2) | 1.0 | 40 | 160 | 2.1 | 160 | 14 |
| Comparative Example: | | | | | | | | | | | | | | |
| 5 | FTP(1) | 1.0 | 180 | 121 | 1.2 | 50 | 71 | FSP(3) | 1.0 | 26 | 136 | 1.5 | 205 | 9 |

TABLE 2-continued

| | | | | | | | | | | | | | | |
|---|---|---|---|---|---|---|---|---|---|---|---|---|---|---|
| Example: | | | | | | | | | | | | | | |
| 6 | FTP(1) | 0.02 | 100 | 120 | 1.2 | 50 | 4 | FSP(2) | 1.0 | 40 | 160 | 2.1 | 160 | 15 |
| 7 | FTP(1) | 1.0 | 100 | 120 | 1.2 | 50 | 74 | FSP(2) | 2.0 | 40 | 160 | 2.8 | 180 | 35 |
| 8 | FTP(1) | 1.0 | 100 | 120 | 1.2 | 50 | 75 | FSP(4) | 1.0 | 37 | 143 | 1.9 | 115 | 21 |
| 9 | FTP(1) | 1.0 | 100 | 120 | 1.2 | 50 | 74 | FSP(5) | 1.0 | 45 | 205 | 3.1 | 650 | 12 |
| Comparative Example: | | | | | | | | | | | | | | |
| 6 | — | — | — | — | — | — | — | FSP(1) | 2.0 | 43 | 195 | 2.8 | 178 | 34 |

FTP: Fine titanium oxide powder;

FSP: Fine silica powder;

L/B: Length/breadth ratio

*: present on toner particles in FEM photo of toner;

(N): Number of particles per 0.5 × 0.5 area (N'): Number of particles per 1.0 × 1.0 area

TABLE 3

| | | | Running performance | | | (1) Toner | | Transfer | |
|---|---|---|---|---|---|---|---|---|---|
| | | Initial | Image density | | | tribo. | Fog | performance | |
| | Toner No. | stage solid image uniformity | (a) Initial stage | (b) After 30,000 sheet running | (a)–(b) difference | difference(Δ) between L/L–H/H (mC/kg) | (after 30,000 sheet running) (%) | Initial stage (%) | After 30,000 sheet running (%) |
| Example: | | | | | | | | | |
| 1 | Sus. cyan toner 1 | 0.01 | 1.45 | 1.47 | 0.05 | 3.8 | 0.2 | 98.8 | 98.5 |
| 2 | Sus. cyan toner 2 | 0.01 | 1.47 | 1.45 | 0.05 | 4.0 | 0.2 | 98.5 | 98.0 |
| Comparative Example: | | | | | | | | | |
| 1 | Pulv. cyan toner 3 | 0.05 | 1.48 | 1.35 | 0.18 | 8.3 | 1.5 | 96.1 | 94.2 |
| Example: | | | | | | | | | |
| 3 | Sus. cyan toner 4 | 0.03 | 1.45 | 1.40 | 0.09 | 4.5 | 0.2 | 98.2 | 97.1 |
| 4 | Sph. cyan toner 5 | 0.02 | 1.43 | 1.41 | 0.07 | 5.2 | 0.2 | 98.6 | 98.3 |
| Comparative Example: | | | | | | | | | |
| 2 | Sph. cyan toner 6 | 0.07 | 1.41 | 1.31 | 0.21 | 6.5 | 1.8 | 99.1 | 95.2 |
| 3 | Sus. cyan toner 7 | 0.05 | 1.43 | 1.33 | 0.15 | 4.7 | 1.3 | 96.6 | 94.1 |
| 4 | Sus. cyan toner 8 | 0.04 | 1.46 | 1.35 | 0.14 | 5.3 | 1.5 | 96.0 | 94.3 |
| Example: | | | | | | | | | |
| 5 | Sus. cyan toner 9 | 0.03 | 1.46 | 1.43 | 0.06 | 4.3 | 0.3 | 98.7 | 97.9 |
| Comparative Example: | | | | | | | | | |
| 5 | Sus. cyan toner 10 | 0.05 | 1.42 | 1.31 | 0.15 | 4.8 | 1.4 | 98.0 | 95.2 |
| Example: | | | | | | | | | |
| 6 | Sus. cyan toner 11 | 0.03 | 1.45 | 1.40 | 0.08 | 5.8 | 0.5 | 98.2 | 97.0 |
| 7 | Sus. cyan toner 12 | 0.02 | 1.44 | 1.41 | 0.06 | 4.7 | 0.3 | 98.9 | 98.6 |
| 8 | Sus. cyan toner 13 | 0.02 | 1.47 | 1.40 | 0.09 | 4.1 | 0.5 | 98.5 | 98.1 |
| 9 | Sus. cyan toner 14 | 0.04 | 1.41 | 1.40 | 0.05 | 4.5 | 0.4 | 97.8 | 97.5 |
| Comparative Example: | | | | | | | | | |
| 6 | Sus. cyan toner 15 | 0.05 | 1.41 | 1.30 | 0.15 | 8.5 | 1.6 | 96.1 | 95.0 |

(1): Environmental stability
Sus.: Suspension polymerization;
Pulv.: Pulverization;
Sph.: Spherical-treated
L/L: Low-temp./low-humidity environment;
H/H: High-temp./high-humidity environment

TABLE 4

| | Toner | | | | |
|---|---|---|---|---|---|
| | | | | Circularity distribution | |
| | Toner No. | Weight-average particle diameter (μm) | Shape factor SF-1 | Average circularity | Content of particles with circularity of less than 0.950 (% by number) |
| Example: | | | | | |
| 14 | Suspension polymerization toner A | 6.8 | 115 | 0.985 | 9 |
| Comparative Example: | | | | | |
| 7 | Pulverization toner B | 6.5 | 155 | 0.918 | 44 |
| Example: | | | | | |
| 15 | Suspension polymerization toner C | 6.6 | 140 | 0.962 | 25 |
| 16 | Suspension polymerization toner D | 6.6 | 103 | 0.990 | 6 |
| 17 | Suspension polymerization toner E | 7.1 | 118 | 0.980 | 16 |
| 18 | Suspension polymerization toner F | 6.8 | 109 | 0.987 | 10 |
| Comparative Example | | | | | |
| 8 | Suspension polymerization toner G | 7.2 | 103 | 0.988 | 10 |
| 9 | Suspension polymerization toner H | 9.5 | 111 | 0.986 | 10 |
| 10 | Suspension polymerization toner I | 6.1 | 103 | 0.990 | 6 |
| 11 | Suspension polymerization toner J | 6.6 | 106 | 0.985 | 9 |
| Example: | | | | | |
| 19 | Suspension polymerization toner K | 6.7 | 110 | 0.984 | 15 |
| 20 | Suspension polymerization toner L | 6.4 | 132 | 0.947 | 34 |
| 21 | Suspension polymerization toner M | 6.4 | 119 | 0.976 | 23 |

| | External additive Inorganic fine powder (A) | | | | | | | | |
|---|---|---|---|---|---|---|---|---|---|
| | | | | | | Physical properties of external additive* | | | |
| | Type | Content (pbw) | BET specific surface area ($m^2/g$) | (a) Average primary particle diameter of primary particles (mμm) | Percent by number of particles at least twice the (a) | Shape factor SF-1 | L/B | Average length (mμm) | (N) |
| Example: | | | | | | | | | |
| 14 | Fine alumina powder (A) | 1.0 | 145 | 10 | 0 | 118 | 1.1 | 15 | 190 |
| Comparative Example: | | | | | | | | | |
| 7 | Fine alumina powder (B) | 1.0 | 72 | 18 | 0 | 120 | 1.2 | 30 | 143 |
| Example: | | | | | | | | | |
| 15 | Fine alumina powder (C) | 1.0 | 120 | 15 | 0.30 | 123 | 1.2 | 28 | 115 |
| 16 | Fine alumina powder (D) | 1.0 | 140 | 13 | 0.50 | 120 | 1.1 | 25 | 129 |
| 17 | Fine alumina powder (E) | 1.0 | 66 | 19 | 0.40 | 125 | 1.3 | 35 | 90 |
| 18 | Fine alumina powder (F) | 1.0 | 68 | 18 | 0.40 | 124 | 1.3 | 36 | 95 |
| Comparative Example: | | | | | | | | | |
| 8 | Fine alumina powder (G) | 1.0 | 210 | 3 | 0 | 120 | 1.1 | 8 | >200 |
| 9 | Fine alumina powder (H) | 1.0 | 147 | 20 | 0.20 | 119 | 1.1 | 45 | 180 |
| 10 | — | — | — | — | — | — | — | — | — |
| 11 | Fine alumina powder (I) | 1.5 | 150 | 11 | 0 | 118 | 1.1 | 15 | >200 |
| Example: | | | | | | | | | |
| 19 | Fine alumina powder (J) | 1.0 | 122 | 14 | 0.03 | 119 | 1.1 | 28 | 155 |
| 20 | Fine alumina powder (A) | 1.0 | 145 | 10 | 0 | 118 | 1.1 | 15 | 185 |
| 21 | Fine alumina powder (K) | 1.0 | 74 | 17 | 0 | 120 | 1.2 | 31 | 140 |

| | External additive Inorganic fine powder (B) | | | |
|---|---|---|---|---|
| | | BET | (b) Average primary particle diameter | Percent by number of | Pysical properties of external additive present on |

TABLE 4-continued

| | Type | con-tent (pbw) | spe-cific sur-face area ($m^2/g$) | of primary particles making up coalesced particles (mμm) | particles at least twice to three times the (b) | toner particles in FEM photo of toner: Shape fac-tor SF-1 | L/B | Av-erage length (mμm) | (N') |
|---|---|---|---|---|---|---|---|---|---|
| Example: | | | | | | | | | |
| 14 | Fine silica powder (A) | 1.0 | 68 | 25 | 8.00 | 185 | 1.9 | 150 | 19 |
| Comparative Example: | | | | | | | | | |
| 7 | Fine silica powder (B) | 1.0 | 66 | 27 | 6.40 | 180 | 2.0 | 145 | 16 |
| Example: | | | | | | | | | |
| 15 | Fine silica powder (C) | 1.0 | 68 | 25 | 7.40 | 165 | 1.9 | 145 | 17 |
| 16 | Fine silica powder (D) | 1.0 | 22 | 33 | 6.10 | 198 | 2.1 | 195 | 9 |
| 17 | Fine silica powder (E) | 1.0 | 23 | 34 | 9.30 | 205 | 2.2 | 200 | 9 |
| 18 | Fine silica powder (F) | 1.0 | 71 | 25 | 2.50 | 160 | 1.7 | 140 | 17 |
| Comparative Example: | | | | | | | | | |
| 8 | Fine silica powder (G) | 1.0 | 25 | 32 | 9.10 | 205 | 2.6 | 190 | 14 |
| 9 | Fine silica powder (H) | 1.0 | 13 | 25 | 8.20 | 240 | 2.3 | 410 | 5 |
| 10 | Fine silica powder (I) | 1.5 | 151 | 10 | 8.10 | 135 | 1.6 | 70 | 35 |
| 11 | — | — | — | — | — | — | — | — | — |
| Example: | | | | | | | | | |
| 19 | Fine silica powder (J) | 1.0 | 22 | 32 | 11.10 | 190 | 2.0 | 175 | 13 |
| 20 | Fine silica powder (A) | 1.0 | 68 | 25 | 8.00 | 185 | 1.9 | 150 | 18 |
| 21 | Fine silica powder (K) | 1.0 | 67 | 23 | 7.50 | 175 | 1.8 | 140 | 20 |

*: present on toner particles in FEM photo of toner
L/B: Length/breadth ratio
(N): Number of particles per 0.5 × 0.5 area
L/B: Length/breadth ratio
(N'): Number of particles per 1.0 × 1.0 area

TABLE 5

| | Toner No. | Initial: stage solid image uni-formity | Running performance Image density: (a) Ini-tial stage | (b) After 50,000 sheet running | (a)–(b) differ-ence | (1) Toner tribo.: differ-ence(Δ) between L/L–H/H (mC/kg) | Fog (after 50,000 sheet running) (%) | Transfer performance: Ini-tial stage (%) | After 50,000 sheet running (%) |
|---|---|---|---|---|---|---|---|---|---|
| Example: | | | | | | | | | |
| 14 | Sus. toner A | 0.02 | 1.46 | 1.43 | 0.05 | 3.0 | 0.1 | 98.9 | 98.0 |
| Comparative Example: | | | | | | | | | |
| 7 | Pulv. toner B | 0.06 | 1.45 | 1.32 | 0.15 | 11.3 | 1.5 | 95.8 | 93.2 |
| Example: | | | | | | | | | |
| 15 | Sus. toner C | 0.03 | 1.46 | 1.40 | 0.07 | 9.0 | 0.3 | 97.2 | 96.1 |
| 16 | Sus. toner D | 0.03 | 1.45 | 1.44 | 0.04 | 7.5 | 0.3 | 99.0 | 98.2 |
| 17 | Sus. toner E | 0.02 | 1.45 | 1.40 | 0.07 | 9.5 | 0.2 | 98.5 | 97.9 |
| 18 | Sus. toner F | 0.02 | 1.45 | 1.39 | 0.06 | 8.5 | 0.3 | 98.4 | 97.5 |
| Comparative Example: | | | | | | | | | |
| 8 | Sus. toner G | 0.03 | 1.44 | 1.30 | 0.16 | 12.3 | 1.4 | 97.3 | 94.0 |
| 9 | Sus. toner H | 0.05 | 1.40 | 1.28 | 0.15 | 6.8 | 1.7 | 98.2 | 96.9 |
| 10 | Sus. toner I | 0.08 | 1.41 | 1.25 | 0.18 | 10.3 | 1.8 | 95.1 | 93.3 |
| 11 | Sus. toner J | 0.03 | 1.48 | 1.25 | 0.25 | 11.7 | 1.1 | 98.0 | 94.9 |
| Example: | | | | | | | | | |
| 19 | Sus. toner K | 0.03 | 1.45 | 1.38 | 0.07 | 9.4 | 0.4 | 98.3 | 97.4 |

TABLE 5-continued

| | Toner No. | Initial stage solid image uniformity | Running performance Image density (a) Initial stage | (b) After 50,000 sheet running | (a)–(b) difference | (1) Toner tribo. difference(Δ) between L/L–H/H (mC/kg) | Fog (after 50,000 sheet running) (%) | Transfer performance Initial stage (%) | After 50,000 sheet running (%) |
|---|---|---|---|---|---|---|---|---|---|
| 20 | Sus. toner L | 0.04 | 1.41 | 1.37 | 0.07 | 8.8 | 0.4 | 97.0 | 96.0 |
| 21 | Sus. toner M | 0.03 | 1.45 | 1.38 | 0.07 | 5.8 | 0.4 | 97.2 | 96.3 |

(1): Environmental stability
Sus.: Suspension polymerization;
Pulv.: Pulverization
L/L: Low-temp./low-humidity environment;
H/H: High-temp./high-humidity environment

TABLE 6

| | Toner No. | Image forming apparatus | Initial stage solid image uniformity | Running performance Image density (a) Initial stage | (b) After 50,000 sheet running | (a)–(b) difference | (1) Toner tribo. difference(Δ) between L/L–H/H (mC/kg) | Fog (after 50,000 sheet running) (%) | Transfer performance Initial stage (%) | After 50,000 sheet running (%) |
|---|---|---|---|---|---|---|---|---|---|---|
| Example: | | | | | | | | | | |
| 22 | Sus. C | FIG. 4 | A | 1.70 | 1.61 | 0.09 | 9.3 | 0.2 | 98.3 | 96.7 |
| 23 | Sus. D | FIG. 5 | A | 1.65 | 1.59 | 0.06 | 7.8 | 0.3 | 96.5 | 95.6 |
| 24 | Sus. E | FIG. 3 | B | 1.67 | 1.51 | 0.16 | 9.6 | 0.2 | 95.8 | 93.5 |
| 25 | Sus. F | FIG. 4 | B | 1.58 | 1.49 | 0.09 | 8.5 | 0.3 | 95.6 | 94.2 |
| Comparative Example: | | | | | | | | | | |
| 12 | Sus. G | FIG. 4 | D | 1.67 | 1.48 | 0.19 | 10.6 | 1.6 | 89.2 | 85.1 |
| 13 | Sus. I | FIG. 5 | A | 1.72 | 1.51 | 0.21 | 15.6 | 1.7 | 95.2 | 94.8 |
| 14 | Sus. J | FIG. 3 | A | 1.69 | 1.63 | 0.06 | 10.2 | 1.2 | 88.7 | 82.1 |
| Example: | | | | | | | | | | |
| 26 | Sus. K | FIG. 4 | B | 1.56 | 1.47 | 0.09 | 9.5 | 0.4 | 95.4 | 94.6 |
| 27 | Sus. L | FIG. 3 | A | 1.64 | 1.52 | 0.12 | 8.8 | 0.4 | 96.3 | 95.1 |

(1): Environmental stability
Sus.: Suspension polymerization toner
L/L: Low-temp./low-humidity environment;
H/H: High-temp./high-humidity environment

TABLE 7

| Example: | Toner No. | Image forming apparatus | Initial stage solid image uniformity | Running performance Image density (a) Initial stage | (b) After 50,000 sheet running | (a)–(b) difference | (1) Toner tribo. difference(Δ) between L/L–H/H (mC/kG) | Fog (after 50,000 sheet running) (%) | Transfer performance Initial stage (%) | After 50,000 sheet running (%) |
|---|---|---|---|---|---|---|---|---|---|---|
| 29 | Sus. N | FIG. 2 | A | 1.68 | 1.55 | 0.13 | 7.6 | 0.2 | 97.2 | 95.3 |
| | Sus. O | FIG. 2 | A | 1.72 | 1.63 | 0.09 | 6.8 | 0.3 | 96.4 | 95.6 |
| | Sus. P | FIG. 2 | B | 1.61 | 1.55 | 0.06 | 7.2 | 0.3 | 95.2 | 94.8 |
| | Sus. Q | FIG. 2 | B | 1.66 | 1.59 | 0.07 | 8.3 | 0.3 | 95.8 | 95.7 |

(1): Environmental stability
Sus.: Suspension polymerization toner
L/L: Low-temp./low-humidity environment;
H/H: High-temp./high humidity environment

What is claimed is:

1. A toner comprising toner particles and an external additive;

said toner having;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method; and said external additive having, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150.

2. The toner according to claim 1, wherein the average circularity of the toner is from 0.950 to 0.995.

3. The toner according to claim 1, wherein the average circularity of the toner is from 0.960 to 0.995.

4. The toner according to claim 1, wherein the particles with a circularity of less than 0.950 are contained in an amount of from 3% by number to 30% by number.

5. The toner according to claim 1, which has a shape factor SF-1 of from 100 to 150.

6. The toner according to claim 1, which has a shape factor SF-1 of from 100 to 130.

7. The toner according to claim 1, wherein said inorganic fine powder (A) has, on the toner particles, the average particle length in the range of from 15 mμm to 200 mμm.

8. The toner according to claim 1, wherein said inorganic fine powder (A) has, on the toner particles, the average particle length in the range of from 15 mμm to 100 mμm.

9. The toner according to claim 1, wherein said non-spherical inorganic fine powder (B) has, on the toner particles, an average particle length of from 120 mμm to 600 mμm.

10. The toner according to claim 1, wherein said non-spherical inorganic fine powder (B) has, on the toner particles, an average particle length of from 130 mμm to 500 mμm.

11. The toner according to claim 1, wherein said non-spherical inorganic fine powder (B) has, on the toner particles, an average particle length which is larger than the average particle length of said inorganic fine powder (A) on the toner particles.

12. The toner according to claim 1, wherein said non-spherical inorganic fine powder (B) has, on the toner particles, an average particle length which is larger by at least 20 mμm than the average particle length of said inorganic fine powder (A) on the toner particles.

13. The toner according to claim 1, wherein said non-spherical inorganic fine powder (B) has, on the toner particles, an average particle length which is larger by at least 40 mμm than the average particle length of said inorganic fine powder (A) on the toner particles.

14. The toner according to claim 1, wherein said inorganic fine powder (A) has, on the toner particles, the average particle length in the range of from 15 mμm to 100 mμm, and said non-spherical inorganic fine powder (B) has, on the toner particles, an average particle length of from 120 mμm to 600 mμm.

15. The toner according to claim 1, wherein said inorganic fine powder (A) has a specific surface area of from 60 $m^2/g$ to 230 $m^2/g$ as measured by nitrogen absorption according to BET method.

16. The toner according to claim 1, wherein said inorganic fine powder (A) has a specific surface area of from 70 $m^2/g$ to 180 $m^2/g$ as measured by nitrogen absorption according to BET method.

17. The toner according to claim 1, wherein said non-spherical inorganic fine powder (B) has a specific surface area of from 20 $m^2/g$ to 90 $m^2/g$ as measured by nitrogen absorption according to BET method.

18. The toner according to claim 1, wherein said non-spherical inorganic fine powder (B) has a specific surface area of from 25 $m^2/g$ to 80 $m^2/g$ as measured by nitrogen absorption according to BET method.

19. The toner according to claim 1, wherein said inorganic fine powder (A) has, on the toner particles, the shape factor SF-1 in a value of from 100 to 125.

20. The toner according to claim 1, wherein said non-spherical inorganic fine powder (B) has, on the toner particles, the shape factor SF-1 in a value of greater than 190.

21. The toner according to claim 1, wherein said non-spherical inorganic fine powder (B) has, on the toner particles, the shape factor SF-1 in a value of greater than 200.

22. The toner according to claim 1, wherein said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

23. The toner according to claim 1, wherein said inorganic fine powder (A) and said non-spherical inorganic fine powder (B) are present on the toner particle surfaces in a number of at least 7 particles on the average per unit area of 0.5 μm×0.5 μm and in a number of from 1 to 25 particles on the average per unit area of 1.0 μm×1.0 μm, respectively, as viewed on an electron microscope magnified photograph of the toner.

24. The toner according to claim 1, wherein said inorganic fine powder (A) and said non-spherical inorganic fine powder (B) are present on the toner particle surfaces in a number of at least 10 particles on the average per unit area of 0.5 μm×0.5 μm and in a number of from 5 to 25 particles on the average per unit area of 1.0 μm×1.0 μm, respectively, as viewed on an electron microscope magnified photograph of the toner.

25. The toner according to claim 1, wherein;

said toner is a toner having, in circularity distribution of particles measured with a flow type particle image analyzer, an average circularity of from 0.950 to 0.995, containing particles with a circularity of less than 0.950 in an amount of from 2% by number to 40% by number;

said external additive is an external additive having, on the toner particles, at least (i) an inorganic fine powder (A) present in the state of primary particles or secondary particles and having an average particle length of from 15 mμm to 100 mμm and a shape factor SF-1 of from 100 to 130 and (ii) a non-spherical inorganic fine powder (B) formed by coalescence of a plurality of particles and having an average circularity of from 120 mμm to 600 mμm and a shape factor SF-1 of greater than 150; and said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

26. The toner according to claim 1, which contains said inorganic fine powder (A) in an amount of from 0.1 part by weight to 2.0 parts by weight based on 100 parts by weight of the toner.

27. The toner according to claim 1, which contains said non-spherical inorganic fine powder (B) in an amount of from 0.3 part by weight to 3.0 parts by weight based on 100 parts by weight of the toner.

28. The toner according to claim 1, wherein said inorganic fine powder (A) has fine particles selected from the group consisting of fine alumina particles, fine titanium oxide particles, fine zirconium oxide particles, fine magnesium oxide particles, any of these fine particles treated with silica, and fine silicon nitride particles.

29. The toner according to claim 1, wherein said inorganic fine powder (A) has fine particles selected from the group consisting of fine alumina particles, fine titanium oxide particles, and any of these fine particles treated with silica.

30. The toner according to claim 1, wherein said non-spherical inorganic fine powder (B) has fine particles selected from the group consisting of fine silica particles, fine alumina particles, fine titania particles, and fine particles of double oxide of any of these.

31. The toner according to claim 1, wherein said non-spherical inorganic fine powder (B) has fine silica particles.

32. The toner according to claim 1, wherein said inorganic fine powder (A) has fine particles selected from the group consisting of fine alumina particles, fine titanium oxide particles, and any of these fine particles treated with silica, and said non-spherical inorganic fine powder (B) has fine silica particles.

33. The toner according to claim 1, wherein said inorganic fine powder (A) has fine alumina particles, and said non-spherical inorganic fine powder (B) has fine silica particles.

34. The toner according to claim 33, wherein said fine alumina particles have such a particle size distribution that particles with diameters at least twice the average particle diameter are contained in an amount of from 0% by number to 5% by number, and said non-spherical inorganic fine powder (B) have such a particle size distribution that particles with diameters twice to three times the average particle diameter are contained in an amount of from 5% by number to 15% by number.

35. The toner according to claim 33, wherein said fine alumina particles have a specific surface area of from 60 $m^2/g$ to 150 $m^2/g$ as measured by nitrogen absorption according to BET method, and said non-spherical inorganic fine powder (B) has a specific surface area of from 20 $m^2/g$ to 70 $m^2/g$ as measured by nitrogen absorption according to BET method.

36. The toner according to claim 33, wherein said fine alumina particles have been subjected to hydrophobic treatment.

37. The toner according to claim 1, wherein said toner particles contains at least a binder resin and a colorant.

38. The toner according to claim 1, wherein said toner particles contains at least a binder resin, a colorant and a release agent.

39. The toner according to claim 1, wherein said toner particles contains at least a binder resin, a colorant, a release agent and a charge control agent.

40. The toner according to claim 1, wherein said release agent has a weight-average molecular weight of from 300 to 3,000.

41. The toner according to claim 1, wherein said toner particles are particles produced by a polymerization process in which a polymerizable monomer composition containing at least a polymerizable monomer and a colorant is polymerized in a liquid medium in the presence of a polymerization initiator.

42. The toner according to claim 1, wherein said toner particles are particles produced by a suspension polymerization process in which a polymerizable monomer composition containing at least a polymerizable monomer and a colorant is polymerized in an aqueous medium in the presence of a polymerization initiator.

43. The toner according to claim 1, wherein said toner particles are particles produced by suspension polymerization in which a polymerizable monomer composition containing at least a polymerizable monomer, a colorant and a wax as a release agent is polymerized in an aqueous medium in the presence of a polymerization initiator.

44. The toner according to claim 1, wherein said toner particles are particles produced by treating to make spherical, particles produced by a pulverization process comprising the steps of melt-kneading a mixture containing at least a binder resin and a colorant to obtain a kneaded product and pulverizing the kneaded product.

45. A two-component developer comprising a toner having at least toner particles and an external additive, and a carrier, wherein;

said toner has;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 μm to 9.0 μm as measured by Coulter method; and said external additive has, on the toner particles, at least (i) an inorganic fine powder (A) present in the state of primary particles or secondary particles and having an average particle length of from 10 mμm to 400 mμm and a shape factor SF-1 of from 100 to 130 and (ii) a non-spherical inorganic fine powder (B) formed by coalescence of a plurality of particles and having a shape factor SF-1 of greater than 150.

46. The two-component developer according to claim 45, wherein the average circularity of said toner is from 0.950 to 0.995.

47. The two-component developer according to claim 45, wherein the average circularity of said toner is from 0.960 to 0.995.

48. The two-component developer according to claim 45, wherein the particles with a circularity of less than 0.950 are contained in an amount of from 3% by number to 30% by number.

49. The two-component developer according to claim 45, wherein said toner has a shape factor SF-1 of from 100 to 150.

50. The two-component developer according to claim 45, wherein said toner has a shape factor SF-1 of from 100 to 130.

51. The two-component developer according to claim 45, wherein said inorganic fine powder (A) has, on the toner particles, the average particle length in the range of from 15 mμm to 200 mμm.

52. The two-component developer according to claim 45, wherein said inorganic fine powder (A) has, on the toner particles, the average particle length in the range of from 15 mμm to 100 mμm.

53. The two-component developer according to claim 45, wherein said non-spherical inorganic fine powder (B) has, on the toner particles, an average particle length of from 120 mμm to 600 mμm.

54. The two-component developer according to claim 45, wherein said non-spherical inorganic fine powder (B) has, on the toner particles, an average particle length of from 130 mμm to 500 mμm.

55. The two-component developer according to claim 45, wherein said non-spherical inorganic fine powder (B) has, on the toner particles, an average particle length which is larger than the average particle length of said inorganic fine powder (A) on the toner particles.

56. The two-component developer according to claim 45, wherein said non-spherical inorganic fine powder (B) has, on the toner particles, an average particle length which is larger by at least 20 mμm than the average particle length of said inorganic fine powder (A) on the toner particles.

57. The two-component developer according to claim 45, wherein said non-spherical inorganic fine powder (B) has, on the toner particles, an average particle length which is larger by at least 40 mμm than the average particle length of said inorganic fine powder (A) on the toner particles.

58. The two-component developer according to claim 45, wherein said inorganic fine powder (A) has, on the toner particles, the average particle length in the range of from 15 mμm to 100 mμm, and said non-spherical inorganic fine powder (B) has, on the toner particles, an average particle length of from 120 mμm to 600 mμm.

59. The two-component developer according to claim 45, wherein said inorganic fine powder (A) has a specific surface area of from 60 $m^2/g$ to 230 $m^2/g$ as measured by nitrogen absorption according to BET method.

60. The two-component developer according to claim 45, wherein said inorganic fine powder (A) has a specific surface area of from 70 $m^2/g$ to 180 $m^2/g$ as measured by nitrogen absorption according to BET method.

61. The two-component developer according to claim 45, wherein said non-spherical inorganic fine powder (B) has a specific surface area of from 20 $m^2/g$ to 90 $m^2/g$ as measured by nitrogen absorption according to BET method.

62. The two-component developer according to claim 45, wherein said non-spherical inorganic fine powder (B) has a specific surface area of from 25 $m^2/g$ to 80 $m^2/g$ as measured by nitrogen absorption according to BET method.

63. The two-component developer according to claim 45, wherein said inorganic fine powder (A) has, on the toner particles, the shape factor SF-1 in a value of from 100 to 125.

64. The two-component developer according to claim 45, wherein said non-spherical inorganic fine powder (B) has, on the toner particles, the shape factor SF-1 in a value of greater than 190.

65. The two-component developer according to claim 45, wherein said non-spherical inorganic fine powder (B) has, on the toner particles, the shape factor SF-1 in a value of greater than 200.

66. The two-component developer according to claim 45, wherein said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

67. The two-component developer according to claim 45, wherein said inorganic fine powder (A) and said non-spherical inorganic fine powder (B) are present on the toner particle surfaces in a number of at least 7 particles on the average per unit area of 0.5 μm×0.5 μm and in a number of from 1 to 25 particles on the average per unit area of 1.0 μm×1.0 μm, respectively, as viewed on an electron microscope magnified photograph of the toner.

68. The two-component developer according to claim 45, wherein said inorganic fine powder (A) and said non-spherical inorganic fine powder (B) are present on the toner particle surfaces in a number of at least 10 particles on the average per unit area of 0.5 μm×0.5 μm and in a number of from 5 to 25 particles on the average per unit area of 1.0 μm×1.0 μm, respectively, as viewed on an electron microscope magnified photograph of the toner.

69. The two-component developer according to claim 45, wherein;

said toner is a toner having, in circularity distribution of particles measured with a flow type particle image analyzer, an average circularity of from 0.950 to 0.995, containing particles with a circularity of less than 0.950 in an amount of from 2% by number to 40% by number;

said external additive is an external additive having, on the toner particles, at least (i) an inorganic fine powder (A) present in the state of primary particles or secondary particles and having an average particle length of from 15 mμm to 100 mμm and a shape factor SF-1 of from 100 to 130 and (ii) a non-spherical inorganic fine powder (B) formed by coalescence of a plurality of particles and having an average circularity of from 120 mμm to 600 mμm and a shape factor SF-1 of greater than 150; and said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

70. The two-component developer according to claim 45, wherein said toner contains said inorganic fine powder (A) in an amount of from 0.1 part by weight to 2.0 parts by weight based on 100 parts by weight of the toner.

71. The two-component developer according to claim 45, wherein said toner contains said non-spherical inorganic fine powder (B) in an amount of from 0.3 part by weight to 3.0 parts by weight based on 100 parts by weight of the toner.

72. The two-component developer according to claim 45, wherein said inorganic fine powder (A) has fine particles selected from the group consisting of fine alumina particles, fine titanium oxide particles, fine zirconium oxide particles, fine magnesium oxide particles, any of these fine particles treated with silica, and fine silicon nitride particles.

73. The two-component developer according to claim 45, wherein said inorganic fine powder (A) has fine particles selected from the group consisting of fine alumina particles, fine titanium oxide particles, and any of these fine particles treated with silica.

74. The two-component developer according to claim 45, wherein said non-spherical inorganic fine powder (B) has fine particles selected from the group consisting of fine silica particles, fine alumina particles, fine titania particles, and fine particles of double oxide of any of these.

75. The two-component developer according to claim 45, wherein said non-spherical inorganic fine powder (B) has fine silica particles.

76. The two-component developer according to claim 45, wherein said inorganic fine powder (A) has fine particles selected from the group consisting of fine alumina particles, fine titanium oxide particles, and any of these fine particles treated with silica, and said non-spherical inorganic fine powder (B) has fine silica particles.

77. The two-component developer according to claim 45, wherein said inorganic fine powder (A) has fine alumina particles, and said non-spherical inorganic fine powder (B) has fine silica particles.

78. The two-component developer according to claim 77, wherein said fine alumina particles have such a particle size distribution that particles with diameters at least twice the average particle diameter are contained in an amount of from 0% by number to 5% by number, and said non-spherical inorganic fine powder (B) have such a particle size distribution that particles with diameters twice to three times the average particle diameter are contained in an amount of from 5% by number to 15% by number.

79. The two-component developer according to claim 77, wherein said fine alumina particles have a specific surface area of from 60 $m^2/g$ to 150 $m^2/g$ as measured by nitrogen absorption according to BET method, and said non-spherical inorganic fine powder (B) has a specific surface area of from 20 $m^2/g$ to 70 $m^2/g$ as measured by nitrogen absorption according to BET method.

80. The two-component developer according to claim 77, wherein said fine alumina particles have been subjected to hydrophobic treatment.

81. The two-component developer according to claim 45, wherein said toner particles contains at least a binder resin and a colorant.

82. The two-component developer according to claim 45, wherein said toner particles contains at least a binder resin, a colorant and a release agent.

83. The two-component developer according to claim 45, wherein said toner particles contains at least a binder resin, a colorant, a release agent and a charge control agent.

84. The two-component developer according to claim 45, wherein said release agent has a weight-average molecular weight of from 300 to 3,000.

85. The two-component developer according to claim 45, wherein said toner particles are particles produced by a polymerization process in which a polymerizable monomer composition containing at least a polymerizable monomer and a colorant is polymerized in a liquid medium in the presence of a polymerization initiator.

86. The two-component developer according to claim 45, wherein said toner particles are particles produced by a suspension polymerization process in which a polymerizable monomer composition containing at least a polymerizable monomer and a colorant is polymerized in an aqueous medium in the presence of a polymerization initiator.

87. The two-component developer according to claim 45, wherein said toner particles are particles produced by suspension polymerization in which a polymerizable monomer composition containing at least a polymerizable monomer, a colorant and a wax as a release agent is polymerized in an aqueous medium in the presence of a polymerization initiator.

88. The two-component developer according to claim 45, wherein said toner particles are produced by treating to make spherical, particles produced by a pulverization process comprising the steps of melt-kneading a mixture containing at least a binder resin and a colorant to obtain a kneaded product and pulverizing the kneaded product.

89. The two-component developer according to claim 45, which has an apparent density of from 1.2 $g/cm^3$ to 2.0 $g/cm^3$.

90. The two-component developer according to claim 45, which has an apparent density of from 1.2 $g/cm^3$ to 1.8 $g/cm^3$.

91. The two-component developer according to claim 45, which has a degree of compaction of from 5% to 19%.

92. The two-component developer according to claim 45, which has a degree of compaction of from 5% to 15%.

93. The two-component developer according to claim 45, wherein said carrier comprises a magnetic resin carrier containing at least a resin and a magnetic metal oxide.

94. The two-component developer according to claim 93, wherein said magnetic resin carrier contains at least a resin, a magnetic powder and a non-magnetic metal oxide.

95. The two-component developer according to claim 93, wherein said magnetic resin carrier is a carrier produced by polymerization.

96. The two-component developer according to claim 93, wherein said magnetic resin carrier contains a phenol resin as a binder.

97. The two-component developer according to claim 45, wherein said carrier has a weight-average particle diameter of from 15 $\mu$m to 60 $\mu$m.

98. The two-component developer according to claim 45, wherein said carrier has a weight-average particle diameter of from 20 $\mu$m to 45 $\mu$m.

99. An image forming method comprising;

(I) a charging step of electrostatically charging a latent image bearing member on which an electrostatic latent image is to be held;

(II) a latent image forming step of forming the electrostatic latent image on the latent image bearing member thus charged;

(III) a developing step of developing the electrostatic latent image on the latent image bearing member by the use of a toner to form a color toner image; and (IV) a transfer step of transferring to a transfer medium the toner image formed on the latent image bearing member;

wherein;

said toner comprises toner particles and an external additive; and said toner has;

(a) in circularity distribution of particles measured with a flow type particle image analyzer, an average circularity of from 0.920 to 0.995, containing particles with a circularity of less than 0.950 in an amount of from 2% by number to 40% by number; and (b) a weight-average particle diameter of from 2.0 $\mu$m to 9.0 $\mu$m as measured by Coulter method; and said external additive has, on the toner particles, at least (i) an inorganic fine powder (A) present in the state of primary particles or secondary particles and having an average particle length of from 10 m$\mu$m to 400 m$\mu$m and a shape factor SF-1 of from 100 to 130 and (ii) a non-spherical inorganic fine powder (B) formed by coalescence of a plurality of particles and having a shape factor SF-1 of greater than 150.

100. The image forming method according to claim 99, wherein the average circularity of said toner is from 0.950 to 0.995.

101. The image forming method according to claim 99, wherein the average circularity of said toner is from 0.960 to 0.995.

102. The image forming method according to claim 99, wherein the particles with a circularity of less than 0.950 are contained in an amount of from 3% by number to 30% by number.

103. The image forming method according to claim 99, wherein said toner has a shape factor SF-1 of from 100 to 150.

104. The image forming method according to claim 99, wherein said toner has a shape factor SF-1 of from 100 to 130.

105. The image forming method according to claim 99, wherein the primary or secondary particles of said inorganic fine powder (A) have, on the toner particles, the average particle length in the range of from 15 mμm to 200 mμm.

106. The image forming method according to claim 99, wherein said inorganic fine powder (A) has, on the toner particles, the average particle length in the range of from 15 mμm to 100 mμm.

107. The image forming method according to claim 99, wherein said non-spherical inorganic fine powder (B) has, on the toner particles, an average particle length of from 120 mμm to 600 mμm.

108. The image forming method according to claim 99, wherein said non-spherical inorganic fine powder (B) has, on the toner particles, an average particle length of from 130 mμm to 500 mμm.

109. The image forming method according to claim 99, wherein said non-spherical inorganic fine powder (B) has, on the toner particles, an average particle length which is larger than the average particle length of said inorganic fine powder (A) on the toner particles.

110. The image forming method according to claim 99, wherein said non-spherical inorganic fine powder (B) has, on the toner particles, an average particle length which is larger by at least 20 mμm than the average particle length of said inorganic fine powder (A) on the toner particles.

111. The image forming method according to claim 99, wherein said non-spherical inorganic fine powder (B) has, on the toner particles, an average particle length which is larger by at least 40 mμm than the average particle length of said inorganic fine powder (A) on the toner particles.

112. The image forming method according to claim 99, wherein said inorganic fine powder (A) has, on the toner particles, the average particle length in the range of from 15 mμm to 100 mμm, and said non-spherical inorganic fine powder (B) has, on the toner particles, an average particle length of from 120 mμm to 600 mμm.

113. The image forming method according to claim 99, wherein said inorganic fine powder (A) has a specific surface area of from 60 $m^2/g$ to 230 $m^2/g$ as measured by nitrogen absorption according to BET method.

114. The image forming method according to claim 99, wherein said inorganic fine powder (A) has a specific surface area of from 70 $m^2/g$ to 180 $m^2/g$ as measured by nitrogen absorption according to BET method.

115. The image forming method according to claim 99, wherein said non-spherical inorganic fine powder (B) has a specific surface area of from 20 $m^2/g$ to 90 $m^2/g$ as measured by nitrogen absorption according to BET method.

116. The image forming method according to claim 99, wherein said non-spherical inorganic fine powder (B) has a specific surface area of from 25 $m^2/g$ to 80 $m^2/g$ as measured by nitrogen absorption according to BET method.

117. The image forming method according to claim 99, wherein said inorganic fine powder (A) has, on the toner particles, the shape factor SF-1 in a value of from 100 to 125.

118. The image forming method according to claim 99, wherein said non-spherical inorganic fine powder (B) has, on the toner particles, the shape factor SF-1 in a value of greater than 190.

119. The image forming method according to claim 99, wherein said non-spherical inorganic fine powder (B) has, on the toner particles, the shape factor SF-1 in a value of greater than 200.

120. The image forming method according to claim 99, wherein said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

121. The image forming method according to claim 99, wherein said inorganic fine powder (A) and said non-spherical inorganic fine powder (B) are present on the toner particle surfaces in a number of at least 7 particles on the average per unit area of 0.5 μm×0.5 μm and in a number of from 1 to 25 particles on the average per unit area of 1.0 μm×1.0 μm, respectively, as viewed on an electron microscope magnified photograph of the toner.

122. The image forming method according to claim 99, wherein said inorganic fine powder (A) and said non-spherical inorganic fine powder (B) are present on the toner particle surfaces in a number of at least 10 particles on the average per unit area of 0.5 μm×0.5 μm and in a number of from 5 to 25 particles on the average per unit area of 1.0 μm×1.0 μm, respectively, as viewed on an electron microscope magnified photograph of the toner.

123. The image forming method according to claim 99, wherein;

said toner is a toner having, in circularity distribution of particles measured with a flow type particle image analyzer, an average circularity of from 0.950 to 0.995, containing particles with a circularity of less than 0.950 in an amount of from 2% by number to 40% by number;

said external additive is an external additive having, on the toner particles, at least (i) an inorganic fine powder (A) present in the state of primary particles or secondary particles and having an average particle length of from 15 mμm to 100 mμm and a shape factor SF-1 of from 100 to 130 and (ii) a non-spherical inorganic fine powder (B) formed by coalescence of a plurality of particles and having an average circularity of from 120 mμm to 600 mμm and a shape factor SF-1 of greater than 150; and said inorganic fine powder (A) and said non-spherical inorganic fine powder (B) are present on the toner particle surfaces in a number of at least 5 particles on the average per unit area of 0.5 μm×0.5 μm and in a number of from 1 to 30 particles on the average per unit area of 1.0 μm×1.0 μm, respectively, as viewed on an electron microscope magnified photograph of the toner.

124. The image forming method according to claim 99, wherein said toner contains said inorganic fine powder (A) in an amount of from 0.1 part by weight to 2.0 parts by weight based on 100 parts by weight of the toner.

125. The image forming method according to claim 99, wherein said toner contains said non-spherical inorganic fine powder (B) in an amount of from 0.3 part by weight to 3.0 parts by weight based on 100 parts by weight of the toner.

126. The image forming method according to claim 99, wherein said inorganic fine powder (A) has fine particles selected from the group consisting of fine alumina particles, fine titanium oxide particles, fine zirconium oxide particles, fine magnesium oxide particles, any of these fine particles treated with silica, and fine silicon nitride particles.

127. The image forming method according to claim 99, wherein said inorganic fine powder (A) has fine particles selected from the group consisting of fine alumina particles, fine titanium oxide particles, and any of these fine particles treated with silica.

128. The image forming method according to claim 99, wherein said non-spherical inorganic fine powder (B) has fine particles selected from the group consisting of fine silica particles, fine alumina particles, fine titania particles, and fine particles of double oxide of any of these.

129. The image forming method according to claim 99, wherein said non-spherical inorganic fine powder (B) has fine silica particles.

130. The image forming method according to claim 99, wherein said inorganic fine powder (A) has fine particles selected from the group consisting of fine alumina particles, fine titanium oxide particles, and any of these fine particles treated with silica, and said non-spherical inorganic fine powder (B) has fine silica particles.

131. The image forming method according to claim 99, wherein said inorganic fine powder (A) has fine alumina particles, and said non-spherical inorganic fine powder (B) has fine silica particles.

132. The image forming method according to claim 131, wherein said fine alumina particles have such a particle size distribution that particles with diameters at least twice the average particle diameter are contained in an amount of from 0% by number to 5% by number, and said non-spherical inorganic fine powder (B) have such a particle size distribution that particles with diameters twice to three times the average particle diameter are contained in an amount of from 5% by number to 15% by number.

133. The image forming method according to claim 131, wherein said fine alumina particles have a specific surface area of from 60 $m^2/g$ to 150 $m^2/g$ as measured by nitrogen absorption according to BET method, and said non-spherical inorganic fine powder (B) has a specific surface area of from 20 $m^2/g$ to 70 $m^2/g$ as measured by nitrogen absorption according to BET method.

134. The image forming method according to claim 131, wherein said fine alumina particles have been subjected to hydrophobic treatment.

135. The image forming method according to claim 99, wherein said toner particles contains at least a binder resin and a colorant.

136. The image forming method according to claim 99, wherein said toner particles contains at least a binder resin, a colorant and a release agent.

137. The image forming method according to claim 99, wherein said toner particles contains at least a binder resin, a colorant, a release agent and a charge control agent.

138. The image forming method according to claim 99, wherein said release agent has a weight-average molecular weight of from 300 to 3,000.

139. The image forming method according to claim 99, wherein said toner particles are particles produced by a polymerization process in which a polymerizable monomer composition containing at least a polymerizable monomer and a colorant is polymerized in a liquid medium in the presence of a polymerization initiator.

140. The image forming method according to claim 99, wherein said toner particles are particles produced by a suspension polymerization process in which a polymerizable monomer composition containing at least a polymerizable monomer and a colorant is polymerized in an aqueous medium in the presence of a polymerization initiator.

141. The image forming method according to claim 99, wherein said toner particles are particles produced by suspension polymerization in which a polymerizable monomer composition containing at least a polymerizable monomer, a colorant and a wax as a release agent is polymerized in an aqueous medium in the presence of a polymerization initiator.

142. The image forming method according to claim 99, wherein said toner particles are produced by treating to make spherical, particles produced by a pulverization process comprising the steps of melt-kneading a mixture containing at least a binder resin and a colorant to obtain a kneaded product and pulverizing the kneaded product.

143. The image forming method according to claim 99, wherein said developing step is a developing step making use of a two-component developer having said toner and a carrier and developing the electrostatic latent image on the latent image bearing member by the use of said toner of the two-component developer.

144. The image forming method according to claim 143, wherein said two-component developer has an apparent density of from 1.2 $g/cm^3$ to 2.0 $g/cm^3$.

145. The image forming method according to claim 143, wherein said two-component developer has an apparent density of from 1.2 $g/cm^3$ to 1.8 $g/cm^3$.

146. The image forming method according to claim 143, wherein said two-component developer has a degree of compaction of from 5% to 19%.

147. The image forming method according to claim 143, wherein said two-component developer has a degree of compaction of from 5% to 15%.

148. The image forming method according to claim 143, wherein said carrier comprises a magnetic resin carrier containing at least a resin and a magnetic metal oxide.

149. The image forming method according to claim 148, wherein said magnetic resin carrier contains at least a resin, a magnetic powder and a non-magnetic metal oxide.

150. The image forming method according to claim 148, wherein said magnetic resin carrier is a carrier produced by polymerization.

151. The image forming method according to claim 148, wherein said magnetic resin carrier contains a phenol resin as a binder.

152. The image forming method according to claim 143, wherein said carrier has a weight-average particle diameter of from 15 $\mu$m to 60 $\mu$m.

153. The image forming method according to claim 143, wherein said carrier has a weight-average particle diameter of from 20 $\mu$m to 45 $\mu$m.

154. The image forming method according to claim 99, wherein said transfer medium is a recording medium, where the toner image formed on the latent image bearing member is directly transferred to the recording medium, and the toner image transferred to the recording medium is fixed to the recording medium.

155. The image forming method according to claim 99, wherein said transfer medium comprises an intermediate transfer member and a recording medium, where the toner image formed on the latent image bearing member is primarily transferred to the intermediate transfer member, the toner image primarily transferred to the intermediate transfer member is secondarily transferred to the recording medium, and the toner image secondarily transferred to the recording medium is fixed to the recording medium.

156. The image forming method according to claim 99, wherein said steps I to IV are steps comprising;

(i) a charging step of electrostatically charging a latent image bearing member on which an electrostatic latent image is to be held;

(ii) a latent image forming step of forming the electrostatic latent image on the latent image bearing member thus charged;

(iii) a developing step of developing the electrostatic latent image on the latent image bearing member by the use of a color toner to form a color toner image; said color toner being selected from the group consisting of a cyan toner, a magenta toner and a yellow toner; and (iv) a transfer step of transferring to a transfer medium the color toner image formed on the latent image bearing member;

said steps (i) to (iv) being successively carried out at least twice by the use of color toners each having a different color, to form a multiple color toner image on the transfer medium;

wherein;

the cyan toner comprises i) cyan toner particles containing at least a binder resin and a cyan colorant, and ii) said external additive;

the magenta toner comprises i) magenta toner particles containing at least a binder resin and a magenta colorant, and ii) said external additive; and the yellow toner comprises i) yellow toner particles containing at least a binder resin and a yellow colorant, and ii) said external additive.

157. The image forming method according to claim 156, wherein, using four color toners comprising said cyan toner, said magenta toner, said yellow toner and, in addition thereto, a black toner, said steps (i) to (iv) are successively carried out four times by the use of the color toners each having a different color, to form a four-color color toner image on the transfer medium;

said black toner comprising i) black toner particles containing at least a binder resin and a black colorant, and ii) said external additive.

158. The image forming method according to claim 156, wherein said transfer medium is a recording medium, where the toner image formed on the latent image bearing member is directly transferred to the recording medium, and the toner image transferred to the recording medium is fixed to the recording medium.

159. The image forming method according to claim 156, wherein said transfer medium comprises an intermediate transfer member where the toner image formed on the latent image bearing member is primarily transferred to the intermediate transfer member, the toner image primarily transferred to the intermediate transfer member is secondarily transferred to the recording medium, and the toner image secondarily transferred to the recording medium is fixed to the recording medium.

160. The image forming method according to claim 99, which further comprises a cleaning step of collecting the toner remaining of the surface of the latent image bearing member after said transfer step.

161. The image forming method according to claim 160, wherein said cleaning step employs a cleaning-before-development system in which the latent image bearing member surface is cleaned by means of a cleaning member coming into touch with the latent image bearing member surface.

162. The image forming method according to claim 161, wherein said cleaning step in the cleaning-before-development system is carried out after the transfer step and before the charging step.

163. The image forming method according to claim 160, wherein;

a transfer zone in said transfer step, a charging zone in said charging step and a developing zone in said developing step are positioned in the order of the transfer zone, the charging zone and the developing zone with respect to the surface movement direction of the latent image bearing member, and any cleaning member for removing the toner remaining on the surface of the latent image bearing member is not present between the transfer zone and the charging zone and between the charging zone and the developing zone in contact with the surface of the latent image bearing member; and said cleaning step employs a cleaning-at-development system in which a developing assembly holding said toner therein develops the electrostatic latent image held on the latent image bearing member and the developing assembly simultaneously collects the toner remaining on the surface of the latent image bearing member to clean the surface of the latent image bearing member.

164. The image forming method according to claim 163, wherein said latent image bearing member comprises an electrophotographic photosensitive member.

* * * * *

UNITED STATES PATENT AND TRADEMARK OFFICE

CERTIFICATE OF CORRECTION

PATENT NO. : 6,077,635
DATED : June 20, 2000
INVENTOR(S) : Kenji Okado et al.

It is certified that error appears in the above-identified patent and that said Letters Patent is hereby corrected as shown below:

Title page,
Item [56], OTHER PUBLICATIONS,
Line 2, "pp. 111-192 to -192," should read -- pp. III-139 to III-192, --.

Column 2,
Line 18, delete "a technique called";
Line 66, "one of" should read -- one of the --.

Column 3,
Line 24, "in" should read -- in an -- and "leak" should read -- a leak --

Column 4,
Line 4, "solution" should read -- solutions --;
Line 9, "a" should be deleted --;
Line 44, "multi-layer" should read -- multi-layers --.

Column 5,
Line 31, "that" should read -- those --.

Column 8,
Line 48, "of" (first occurrence) should be deleted.

Column 10,
Line 20, "acton" should read -- action --.

Column 14,
Line 24, "the toner" and "has" should be deleted.

Column 16,
Line 5, "an" should be deleted;
Line 38, "mμm" should read -- mμm. --.

Column 18,
Line 44, "weight" should read -- weighed --.

Column 19,
Line 51, "whatever" should read -- whenever --.

Column 21,
Line 14, "be not" should read -- not be --.

UNITED STATES PATENT AND TRADEMARK OFFICE

CERTIFICATE OF CORRECTION

PATENT NO. : 6,077,635
DATED : June 20, 2000
INVENTOR(S) : Kenji Okado et al.

It is certified that error appears in the above-identified patent and that said Letters Patent is hereby corrected as shown below:

Column 22,
Line 38, "layer," should read -- later, --.

Column 23,
Line 9, "70 $M^2/g$" should read -- 70 $m^2/g$ --;
Line 45, "whatever" should read -- whenever --.

Column 24,
Line 46, "to" should read -- to a --.

Column 25,
Line 9, "the-present" should read -- the present --;
Line 25, "the toner" and "has" should be deleted.

Column 26,
Line 45, "the" (first occurrence) should be deleted.

Column 28,
Line 65, "an" (first occurrence) should be deleted.

Column 29,
Line 6, "a" should read -- as --.

Column 31,
Line 62, "2,21" should read -- 2,2' --;
Line 64, "1,11" should read -- 1,1' --;
Line 64, "2,21" should read -- 2.2' --.

Column 32,
Line 8, "a little vary" should read -- vary a little --;
Line 20, "be" should read -- may be --.

Column 33,
Line 8, "acton" should read -- action --;
Line 26, "particles." should read -- particles --;
Line 55, "(ii)" should read -- (II) --.

Column 34,
Line 48, "has" should read -- and has --;
Line 57, "the all" should read -- all the --.

UNITED STATES PATENT AND TRADEMARK OFFICE

CERTIFICATE OF CORRECTION

PATENT NO. : 6,077,635
DATED : June 20, 2000
INVENTOR(S) : Kenji Okado et al.

It is certified that error appears in the above-identified patent and that said Letters Patent is hereby corrected as shown below:

Column 36,
Lines 45 and 49, "particle" should read -- particles --;
Line 60, delete "be";
Line 61, "well take place" should read -- take place well --.

Column 37,
Line 29, "made less occur" should read -- reduced --.

Column 40,
Line 26, "is" should be deleted.

Column 41,
Line 33, "KR 255 and KR 255" should read -- KR 255 --.

Column 44,
Line 49, delete "polystyrene".

Column 47,
Line 27, "more" should be deleted;
Line 28, "occur" should read -- occur more --.

Column 52,
Line 60, "the" (second occurrence) should read -- and the --.

Column 54,
Line 23, "made less" should read -- made to occur --;
Line 24, "occur." should read -- less. --.

Column 55,
Line 45, "also can" should read -- can also --.

Column 57,
Line 64, close up left margin;
Line 65, close up right margin.

Column 58,
Line 46, "mm." should read -- mμm. --.

Column 59,
Line 36, "38 $\mu m^2/kg$)." should read -- 38 $Am^2/kg$). --.

UNITED STATES PATENT AND TRADEMARK OFFICE

CERTIFICATE OF CORRECTION

PATENT NO. : 6,077,635
DATED : June 20, 2000
INVENTOR(S) : Kenji Okado et al.

It is certified that error appears in the above-identified patent and that said Letters Patent is hereby corrected as shown below:

Column 60,
Line 40, "to" (second occurrence) should be deleted.

Column 63,
Line 66, "cooled," should read -- cooling, --.

Column 64,
Lines 31 and 65, "cooled," should read -- cooling, --.

Column 65,
Line 31, "cooled," should read -- cooling, --.

Column 66,
Line 9, "This" should read -- These --.

Column 69,
Line $Ca_3(PO_{4)2}$." should read -- $Ca_3(PO_4)_2$. --.

Column 72,
Line 13, "cooled," should read -- cooling, --.

Column 79,
Table 2, "Comparative Example: 2 FTP(1) 1.0 160"
should read
-- Comparative Example: 2 FTP(1) 1.0 100 --.

Column 81,
Table 3, "Sus. cyan toner 4" should read -- Sph. cyan toner 4 --.

Column 83,
Table 4, "Example" should read -- Example: --.

Column 88,
Table7, "mC/kG) should read -- (mC/kg) --.

UNITED STATES PATENT AND TRADEMARK OFFICE

CERTIFICATE OF CORRECTION

PATENT NO. : 6,077,635
DATED : June 20, 2000
INVENTOR(S) : Kenji Okado et al.

It is certified that error appears in the above-identified patent and that said Letters Patent is hereby corrected as shown below:

Column 89,
Line 2, "comprising" should read -- comprising: --;
Line 3, "additive;" should read -- additive, --.

Column 92,
Line 24, "comprising" should read -- comprising: --.

Column 96,
Line 25, "comprising;" should read -- comprising: --;
Line 48, "method; and" shodul read -- method, --.

Column 98,
Line 27, "wherein;" should read -- wherein, --.

Column 100,
Line 61, "comprising;" should read -- comprising: --.

Column 101,
Line 8, "member;" should read -- member, --;
Line 30, "medium;" should read -- medium, --.

Column 102,
Line 6, "of" (first occurrence) should read -- on --;
Line 20, "wherein;" should read -- wherein --.

Signed and Sealed this

Fifteenth Day of January, 2002

*Attest:*

*Attesting Officer*

JAMES E. ROGAN
*Director of the United States Patent and Trademark Office*